US010940599B2

(12) United States Patent
Reyes et al.

(10) Patent No.: US 10,940,599 B2
(45) Date of Patent: Mar. 9, 2021

(54) BLADE CARTRIDGES AND LOCKABLE SAFETY COVERS

(71) Applicant: Spellbound Development Group, Inc., Newport Beach, CA (US)

(72) Inventors: Carlos Reyes, Rancho Santa Margarita, CA (US); Earl J. Votolato, Newport Beach, CA (US)

(73) Assignee: Spellbound Development Group, Inc., Newport Beach, CA (US)

( * ) Notice: Subject to any disclaimer, the term of this patent is extended or adjusted under 35 U.S.C. 154(b) by 0 days.

(21) Appl. No.: 16/436,769

(22) Filed: Jun. 10, 2019

(65) Prior Publication Data

US 2019/0358840 A1 Nov. 28, 2019

Related U.S. Application Data

(63) Continuation-in-part of application No. 15/943,043, filed on Apr. 2, 2018, now Pat. No. 10,391,655, and a continuation-in-part of application No. 15/144,285, filed on May 2, 2016, now Pat. No. 10,315,325, which is a continuation-in-part of application No. 14/931,093, filed on Nov. 3, 2015, now Pat. No. 10,315,317.

(60) Provisional application No. 62/486,870, filed on Apr. 18, 2017, provisional application No. 62/479,642, filed on Mar. 31, 2017.

(51) Int. Cl.
*B26B 29/02* (2006.01)
*B26B 5/00* (2006.01)

(52) U.S. Cl.
CPC ..... *B26B 29/02* (2013.01); *B26B 5/00* (2013.01)

(58) Field of Classification Search
CPC ..... B26B 29/02; B26B 5/00; B26B 29/00
See application file for complete search history.

(56) References Cited

U.S. PATENT DOCUMENTS 1,426,184 A 8/1922 Hammar
3,736,546 A 5/1973 Jones
(Continued)

FOREIGN PATENT DOCUMENTS

CA 2499895 C 5/2010
CA 2746710 A1 7/2010
WO 2010078007 A3 7/2010

OTHER PUBLICATIONS

USPTO Office action dated Jun. 28, 2017 for U.S. Appl. No. 14/931,093, 7 pages.
(Continued)

*Primary Examiner* — Omar Flores Sanchez
(74) *Attorney, Agent, or Firm* — Fish IP Law, LLP

(57) ABSTRACT

Apparatuses, systems, and methods in which a utility knife includes a blade guard rotatably covering the cutting edge of a blade. The blade guard can be locked and unlocked by a primary mechanism. In addition or alternative to the primary mechanism, the blade guard can be set to provide a maximum exposure of the cutting edge for cutting, a minimum exposure of the cutting edge, a maximum retraction of the blade guard over the cutting edge after performing work, or a minimum retraction of the blade guard. The tensive force required to rotate the blade guard and expose the cutting edge can also be adjusted.

19 Claims, 31 Drawing Sheets

(56) References Cited

U.S. PATENT DOCUMENTS 3,781,988 A * 1/1974 Jones ..... B26B 27/005 30/2
4,157,616 A 6/1979 Lundqvist
4,238,862 A 12/1980 Leatherman
4,531,286 A 7/1985 Vito et al.
4,546,510 A 10/1985 Harrison
4,604,804 A * 8/1986 Sparks ..... B26B 5/00 30/162
4,980,977 A 1/1991 Matin et al.
5,296,715 A 3/1994 Kronberg
5,478,346 A 12/1995 Capewell
5,522,135 A 6/1996 Votolato
5,676,677 A 10/1997 Landis et al.
5,765,289 A 6/1998 Schulz et al.
5,852,874 A 12/1998 Walker
5,933,918 A 8/1999 Wallays
6,029,355 A 2/2000 Carlin
6,032,371 A 3/2000 Chou
6,178,640 B1 1/2001 Votolato
D446,571 S 8/2001 Frazer
6,282,794 B1 9/2001 Cho et al.
6,493,945 B1 12/2002 DeRosa et al.
6,510,611 B2 1/2003 Edwards et al.
6,560,873 B1 5/2003 Ortner et al.
6,857,192 B1 2/2005 Summers et al.
D521,844 S 5/2006 Kempker et al.
7,082,688 B2 8/2006 Votolato
D527,604 S 9/2006 Kempker et al.
7,325,312 B1 2/2008 Janich
D571,180 S 6/2008 Marshall
D575,613 S 8/2008 Jennings
7,475,480 B2 1/2009 Votolato
7,509,742 B2 3/2009 Votolato
7,530,130 B1 5/2009 Frazer
7,533,595 B2 5/2009 Domenico
D605,005 S 12/2009 Benson
7,624,507 B2 12/2009 Bergstrand
7,665,389 B2 2/2010 Frazer
7,870,675 B1 1/2011 Della Polla
D636,248 S 4/2011 Still
D639,631 S 6/2011 Kempker et al.
D649,001 S 11/2011 Still
8,046,922 B2 11/2011 Eby et al.
8,099,868 B1 1/2012 Votolato
8,109,002 B2 2/2012 Frazer
D660,674 S 5/2012 Still
D660,675 S 5/2012 Gringer et al.
8,209,870 B2 7/2012 Votolato et al.
8,322,039 B2 12/2012 De Buyer-Mimeure
D673,440 S 1/2013 Kempker et al.
8,347,509 B2 1/2013 Votolato
D682,065 S 5/2013 Gringer et al.
8,590,163 B1 11/2013 Bagley et al.
8,677,629 B2 3/2014 Logan
8,732,956 B2 5/2014 McGushion et al.
D714,611 S 10/2014 Yu Chen
D714,612 S 10/2014 Gropl et al.
8,857,064 B2 10/2014 Schmidt
8,869,408 B2 10/2014 Votolato
9,061,426 B2 6/2015 Harvey
D752,942 S 4/2016 Rohrbach
9,346,177 B2 5/2016 Mayes
9,352,473 B2 5/2016 Harvey
D767,966 S 10/2016 Standlee
D767,967 S 10/2016 Standlee
2002/0124412 A1 9/2002 Votolato
2003/0079347 A1 5/2003 Davis
2003/0213133 A1 11/2003 Hanna
2004/0154167 A1 8/2004 Yu Chen
2005/0086811 A1 4/2005 Kawasaki
2005/0102844 A1* 5/2005 Addis ..... B26B 5/00 30/299
2005/0217114 A1 10/2005 Votolato
2006/0048389 A1 3/2006 Votolato
2006/0288587 A1 12/2006 Ireland
2007/0068000 A1 3/2007 Onion
2007/0272061 A1 11/2007 Hsieh
2008/0010839 A1 1/2008 Eby et al.
2008/0201960 A1 8/2008 Watanabe
2008/0271255 A1 11/2008 Frazer
2008/0271257 A1 11/2008 Frazer
2008/0271258 A1 11/2008 Frazer
2009/0100683 A1 4/2009 Lion et al.
2009/0151168 A1* 6/2009 Dadam ..... B26B 5/001 30/146
2009/0172889 A1* 7/2009 Votolato ..... B25G 3/00 7/158
2009/0271988 A1* 11/2009 Votolato ..... B26B 5/003 30/158
2010/0192380 A1 8/2010 De Buyer-Mimeure
2010/0263217 A1 10/2010 Baxter et al.
2010/0263219 A1* 10/2010 Kempker ..... B25F 1/02 30/337
2010/0293796 A1 11/2010 Votolato
2011/0167646 A1 7/2011 Schmidt
2013/0298409 A1 11/2013 Jacobs et al.
2013/0326884 A1 12/2013 Harvey
2014/0345144 A1 11/2014 Frazer
2014/0345146 A1 11/2014 Schekalla
2015/0298330 A1 10/2015 Yu Chen
2015/0336283 A1 11/2015 Davis
2017/0120469 A1 5/2017 Votolato et al.

OTHER PUBLICATIONS

USPTO Office action dated Aug. 9, 2018 for U.S. Appl. No. 14/931,093, 27 pages.
USPTO Office action dated Mar. 2, 2018 for U.S. Appl. No. 14/931,093, 11 pages.
USPTO Office action dated Aug. 16, 2018 for U.S. Appl. No. 14/931,093, 11 pages.
USPTO Office action dated Nov. 1, 2017 for U.S. Appl. No. 15/144,285, 7 pages.
USPTO Office action dated Feb. 23, 2018 for U.S. Appl. No. 15/144,285, 21 pages.
USPTO Office action dated Jun. 29, 2018 for U.S. Appl. No. 15/144,285, 5 pages.
USPTO Office action dated Sep. 19, 2018 for U.S. Appl. No. 15/144,285, 5 pages.
Mahoney, The Best Utility Knife, The Sweethome.com, Dec. 13, 2016, 17 pages.
USPTO Notice of Ex Parte Reexamination of U.S. Pat. No. 6,718,640, dated Oct. 7, 2010, 19 pages.
Safecutters.com, Safecutters, Inc., Band/Strap Cutter (SC-1162), 3 pages.
Blackovis.com, SOG RotoHook Fixed Blade Knife, 4 pages.
U.S. Pat. No. 594,984, Patented Dec. 7, 1897, 3 pages.
Theoriginalpinkbox.com, Utility Knife, 5 pages.
PCT International Preliminary Report on Patentability for International Application No. PCT/US2009/068389 dated Jun. 21, 2011, 7 pages.

* cited by examiner

BLADE CARTRIDGES AND LOCKABLE SAFETY COVERS

This application claims the benefit of priority to U.S. Provisional Application No. 62/486,870, filed on Apr. 18, 2017, and U.S. Provisional Application No. 62/479,642, filed on Mar. 31, 2017. This application is also a continuation-in-part of, and claims priority to, U.S. application Ser. No. 15/943,043, filed on Apr. 2, 2018, which is a continuation-in-part of, and claims priority to, U.S. application Ser. No. 15/144,285, filed on May 2, 2016, which is a continuation-in-part of, and claims priority to, U.S. application Ser. No. 14/931,093, filed on Nov. 3, 2015. All extrinsic materials identified herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is utility knives.

BACKGROUND

The background description includes information that may be useful in understanding the present invention. It is not an admission that any of the information provided herein is prior art or relevant to the presently claimed invention, or that any publication specifically or implicitly referenced is prior art.

Safety has been an important concern when using utility knives as many users inadvertently cut themselves with the exposed blades. Some efforts have been made to address this safety concern.

For example, U.S. Pat. No. 8,347,509 teaches a blade cartridge with a blade cover that defaults to a closed position in which the blade cover surrounds the otherwise exposed portion of a blade. A spring is used to push the blade cover into the closed position, and the blade cover remains in the closed position until pressure is applied to push the cover to an open configuration where the blade is exposed for use.

This and all other publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Unfortunately, the '509 patent's blade cartridge and blade cover fails to address several other safety issues, for example, injuries that can occur from an inadvertent detaching of the cartridge or blade from a tool handle.

U.S. Pat. Nos. 7,475,480 and 8,099,868 each strive to solve this problem by featuring a flexing latch to secure the handle to the cartridge. While the cartridge is inserted into the handle, the latches flex into a strained position in order to fit into the receiving channel of the handle. Once the cartridge has been fully inserted into the handle, the latches then return to a relaxed, unstrained position by pushing through openings on either side of the handle. Such a latching mechanism is useful in securing the blade.

Unfortunately, the cartridge is at risk of inadvertent detachment from the handle because the latches are positioned on the handle at a place where users commonly squeeze their thumb and first finger together to grip and manipulate the tool.

Thus, there is still a need for improved and safer utility knives and utility knife components.

SUMMARY OF THE INVENTION

The following description includes information that may be useful in understanding the present invention. It is not an admission that any of the information provided herein is prior art or relevant to the presently claimed invention, or that any publication specifically or implicitly referenced is prior art.

The inventive subject matter provides apparatus, systems, and methods in which a utility knife includes a blade cover that is movable from a locked position to an unlocked position relative to at least one of a blade cartridge, a blade holder, and a tool handle. When the blade cover is in an unlocked position, the blade cover can advantageously be moved (e.g., rotate (partially or fully), pivot, slide, swivel, turn, bend, flex) from a blade covering configuration to a blade exposing configuration.

The blade cover could be biased towards the blade covering configuration, for example, via a spring, such that a force (e.g., from a cutting surface or a user) is required to move to the blade exposing configuration.

In some aspects, contemplated utility knives could comprise a cartridge that is coupled to or includes a blade, and a blade cover coupled to the cartridge. The cartridge could comprise a stem that extends from an end of the cartridge opposite the blade. The stem could include one or more flexible spring arms that each includes a locking member sized and dimensioned to be releasably received by a catch of a tool handle. Advantageously, the spring arms could be configured to flex in opposite directions and towards one another such that the cartridge could readily be removed from the tool handle when desired. Additionally or alternatively, the catches that receive the locking mechanisms could be positioned on top and bottom portions of the tool handle (when the tool is being used), such that unintentional release of the cartridge from the handle during use can be avoided.

In some aspects of the inventive subject matter, utility knives having hook-type cutters are provided. Knives having hook-type cutters can advantageously protect users from inadvertent cuts, since the blade's edge is recessed relative to other portions of the cutter. Viewed from another perspective, the blade's cutting edge is covered on both ends by material that extends out further than the blade's cutting edge. In this manner, the end materials act as a barrier or block to the blade edge for objects that are larger than the narrow space (e.g., less than 20 mm, less than 15 mm, less than 10 mm, less than 5 mm) between the end materials.

Such hook-type cutters have been found to be especially useful in cutting shrink wrap, bubble wrap, straps, bands, cardboard, and other items that are thin and can readily fit within the narrow space between the end portions. Additionally, one or more end portions could include a piercer such that an object can be pierced and cut open with a single swipe or other movement.

Contemplated utility knives could include a cartridge including a movable member, a blade holder portion, a blade, and a hook-type cutter. A blade cover could be movably coupled to the cartridge, and include an opening member that cooperates with the cartridge's movable member to adjust the blade cover between blade covering and blade exposing configurations. For example, the opening member could modify a position or a shape of the movable member relative to the rest of the cartridge.

In some other aspects, a utility knife comprises a cartridge coupled to a blade and including a first blade holder that partially encloses a first side of the blade. A second blade holder (e.g., a blade tip cap) can partially enclose a second side of the blade opposite the first side. The blade can advantageously be recessed relative to the first and second blade holders, thereby forming a hook-type cutter.

The second blade holder could be permanently coupled to the blade (fixedly or movably—e.g., rotatably, pivotably), or could be removably coupled to the blade. For example, the first and second blade holders could be coupled to one another via a flexible connector. When the user wishes to access the portion of the blade covered by the second blade holder, the user could pull the second blade holder away from the blade. The second blade holder being connected to the first blade holder (cartridge) via the connector reduces the risk that the blade tip cover will be lost.

Having a hook-type cutter as described above could help prevent accidents from occurring. For additional safety, a movable cover could be coupled to the cartridge, and be adjustable between two or more positions or configurations.

In still further aspects, a utility knife could comprise a blade at least partially embedded in a blade holder. The blade could comprise first and second ends, and a cutting edge extending there-between. The knife could additionally include a blade cap that is sized and dimensioned to receive a portion of the blade not covered by the blade holder. The blade cap could advantageously be coupled to at least one of the blade and the blade holder in a manner that allows the blade cap to move between first and second positions, wherein the blade cap covers more of the blade's cutting edge when in the first position relative to the second position.

The blade cap could be a separate piece of material that is removable from the blade and blade holder. Additionally or alternatively, the blade cap could be a separate piece of material that is connected to the blade holder (or other portion of a knife cartridge) via a connector. Additionally or alternatively, the blade cap could be attached to the blade holder, blade, or other portion of the cartridge in a manner that allows the blade cap to pivot or rotate relative to the blade edge. In these and other embodiments, the blade cap could be biased to a position that covers more of the blade's edge that when pivoted or rotated using force.

The inventive subject matter further provides apparatus, systems, and methods in which a tool comprises a blade holder coupled to a movable cover that alternatively exposes a first cutting edge and a second cutting edge. A contemplated tool comprises a blade holder that mounts a first cutting edge and a second cutting edge. A movable cover is coupled to the blade holder, such that the movable cover is configured to rotate relative to the blade holder to alternatively expose the first cutting edge and the second cutting edge. It should be appreciated that the movable cover can effectively prevent access to a cutting edge that is not in-use (i.e., not being used to cut) to thereby reduce the risk of injury to users.

In some aspects of the inventive subject matter, the movable cover is biased, such that the movable cover rotates to a position that covers at least one of the first cutting edge and the second cutting edge. In such embodiments, the tool can comprise a biasing member to bias the movable cover to a default position (e.g., a position where at least one cutting edge is covered). For example, the biasing member can be a spiral spring, which is a flexible material (e.g., a flexible plastic or metal) having the shape of a spiral that temporarily deforms when a load is applied (e.g., user presses tool against working surface to rotate movable cover and expose first or second cutting edge), and returns to its original shape when the load is removed (e.g., user lifts tool from working surface to cover first or second cutting edge). Other springs or biasing mechanisms are also contemplated.

It may be useful to restrict the movement of the moveable cover in some instances (e.g., when the tool is not used). In such instances, movable cover can be adjustable between (a) a locked configuration in which the movable cover is restrained from uncovering both the first cutting edge and the second cutting edge, and (b) an unlocked configuration in which the movable cover can uncover at least one of the first and second cutting edges. A movable cover can automatically or manually transition into the locked configuration after a cut is completed by a user. It is contemplated that the tool can further comprise a detent that restricts the movable cover from rotating relative to the blade holder.

Blade holder can comprise a stem having a flexible arm with a locking member. The stem could removably couple with a handle having a slot sized and dimensioned to receive the locking member. Thus, it is contemplated that the blade holder is removable from a handle (e.g., a cartridge having a blade holder and movable cover that removably couples a handle portion). However, in other embodiments, the blade holder is integral with (not removable from without damage) the handle.

In another aspect, a tool comprising a holder and a movable cover is contemplated. The holder mounts a first tool component and a second tool component. The movable cover is configured to move relative to the holder to simultaneously (i) allow access to the first tool component and (ii) restrict access to the second tool component. The movable cover is typically sized and dimensioned, such that the movable cover can rotate to a position that covers both the first and second tool components (e.g., any one of cutting edges, scrapers, screwdrivers, etc.). Contemplated first and second tool components can be any type of powered or unpowered tool, including screwdrivers, blades, scrapers, scissors, hammers, nail removers, piercer, or any combination thereof.

The inventive subject matter further contemplates cartridges (e.g., work piece, tool, etc) having a handle-coupling member configured to reversibly mate with a handle and a blade with a cutting edge. The cartridge further includes a blade guard movable with respect to the blade (and optionally the cutting edge) between a resting position and a first flexed position. Preferably, the blade guard at least partially covers the cutting edge (e.g., covers a portion, covers the entirety, etc) in the resting position. The cartridge also includes a blade guard arrestor that prevents a movement of the blade cover and can be changed from a first setting to a second setting.

In preferred embodiments, the blade guard covers a greater portion of the cutting edge in the resting position than in the first flexed position. Optionally the blade guard arrestor at the first setting prevents the blade guard from completely covering the cutting edge at any time (e.g., resting position, first flexed position, etc). In some embodiments, the blade guard arrestor at the first setting allows the blade guard to cover more of the cutting edge than at the second setting.

It is further contemplated that cartridges of the inventive subject matter include a blade guard retractor, which has an on setting and an off-setting. Preferably, the on setting allows the blade cover to move from the first flexed position to the resting position, though it is contemplated that the on-setting allow movement from the resting position to the first flexed position, or alternatively the off-setting acts to enable or prevent such movement. For example in some embodiments, the off-setting prevents the blade guard from moving from the first flexed position to the resting position.

A blade guard force adjuster is further contemplated in some embodiments. For example, a force is preferably required to move the blade guard from the resting position toward the first flexed position, with the blade guard force adjuster allowing a user to change the force, for example to increase or decrease the force. In preferred embodiments, the blade guard force adjuster can be set by the user between 10N and 0.01N, though rages of 100N to 0.001N, 20N, to 0.01N, 8N to 0.01N, 5N to 0.01N, 3N to 0.01N, and 1N to 0.001N are also contemplated. In preferred embodiments, at least one of the blade guard arrestor, the blade guard retractor, or the blade guard force adjuster is at least partially operated by a mechanism on the handle, for example a dial, trigger, button, switch, slide, ratchet, pin, or lock on the cartridge is at least partially operable via a counterpart on the handle.

In some embodiments, the blade guard arrestor set in the first position prevents the blade guard from completely exposing the cutting edge. Viewed from another perspective, in such setting at least a portion of the cutting edge is exposed at all times. Preferably, the blade guard arrestor set at the first setting allows the blade guard to expose more of the cutting edge than the blade guard arrestor set at the second setting. Embodiments with a blade guard retractor are also contemplated, with an on-setting and an off-setting. Preferably, the on-setting allows the blade cover to move from the first flexed position to the resting position, though it is also contemplated that the off-setting prevents the blade cover from moving from the first flexed position to the resting position, whether alternatively or in combination. Further embodiments are contemplated having a blade guard force adjuster. For example, preferably a force is required to move the blade guard from the resting position toward the first flexed position, and the blade guard force adjuster allows a user to change the force (e.g., increase, decrease, etc). In preferred embodiments, the blade guard force adjuster can be set by the user between 10N and 0.01N, though rages of 100N to 0.001N, 20N, to 0.01N, 8N to 0.01N, 5N to 0.01N, 3N to 0.01N, and 1N to 0.001N are also contemplated. Again, it is contemplated that at least one of the blade guard arrestor, the blade guard retractor, or the blade guard force adjuster is at least partially operated by a mechanism on the handle (e.g., a dial, trigger, button, switch, slide, ratchet, pin, lock, etc on the cartridge is at least partially operable via a counterpart on the handle).

A blade guard of the inventive subject matter is preferably further movable between a resting position and a second flexed position, for example a second fixed position different than the first flexed position. Likewise, it is preferred that a blade guard arrestor of the inventive subject matter can be changed from a first setting to a third setting, for example a third setting different than the second setting. Moreover, a blade guard retractor with an on-setting and an off-setting of the inventive subject matter are contemplated such that the off setting prevents the blade guard from moving from the first flexed position at all.

Further embodiments include a cartridge having a handle-coupling member configured to reversibly mate with a handle, a blade with a cutting edge, a blade guard, and a blade guard force adjuster. The blade guard is preferably movable with respect to the blade between a resting position and a flexed position. For example, the blade guard at least partially covers a portion of the cutting edge in the resting position, with a force required to move the blade guard from the resting position toward the flexed position. The blade guard force adjuster enables a user to change the force required for such movement. In preferred embodiments, the blade guard force adjuster can be set by the user between 10N and 0.01N, though rages of 100N to 0.001N, 20N, to 0.01N, 8N to 0.01N, 5N to 0.01N, 3N to 0.01N, and 1N to 0.001N are also contemplated.

Embodiments further contemplate a blade guard arrestor that prevents a movement of the blade cover, and preferably can be changed from a first setting to a second setting. In some embodiments, (i) the blade guard arrestor set to the first setting prevents the blade guard from completely covering the cutting edge (e.g., a portion of the cutting edge will always be exposed), or (ii) the blade guard arrestor in the first position prevents the blade guard from completely exposing the cutting edge (e.g., a portion of the cutting edge will always be covered).

Various objects, features, aspects and advantages of the inventive subject matter will become more apparent from the following detailed description of preferred embodiments, along with the accompanying drawing figures in which like numerals represent like components.

DETAILED DESCRIPTION OF THE DRAWINGS

The inventive subject matter provides utility knives with a safety cover that is movable from a locked position to an unlocked position (and vice versa), and from a biased unexposed blade configuration to an exposed blade configuration (and vice versa). The utility knives can include a cartridge for a blade and blade cover, and a tool handle that is configured to securely and releasably receive the cartridge.

Figure 1A:
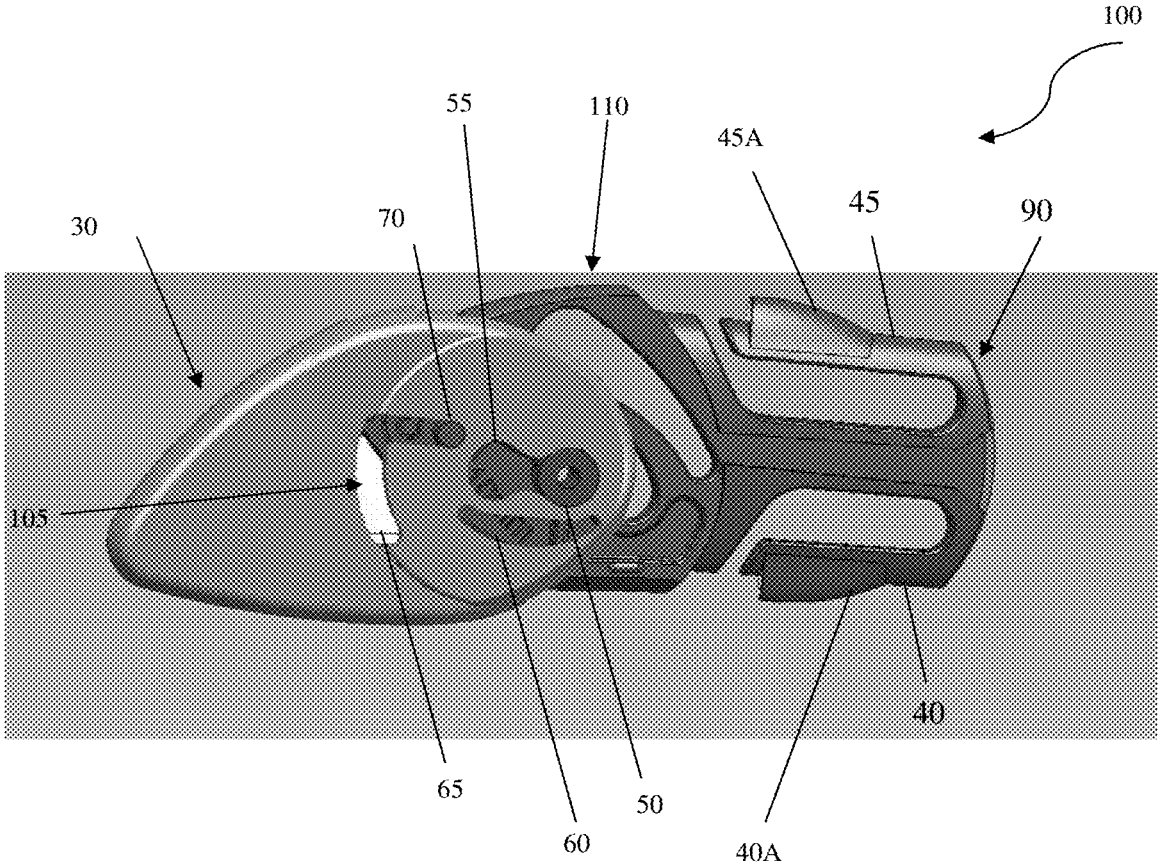
FIG. 1A illustrates a blade cartridge and cover of the inventive subject matter, wherein the cover is in a locked position.
Figure 1B:
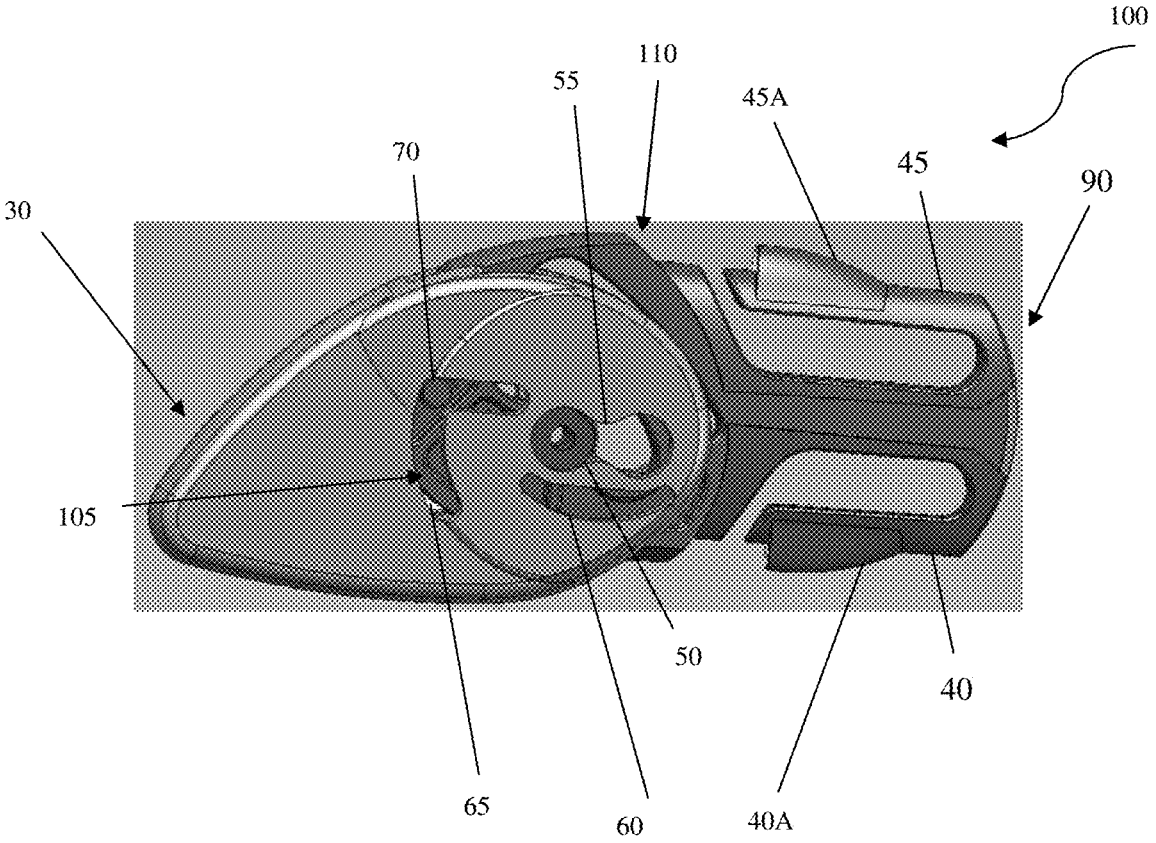
FIG. 1B illustrates the blade cartridge and cover of FIG. 1A, wherein the cover is in an unlocked position.
Figure 1C:
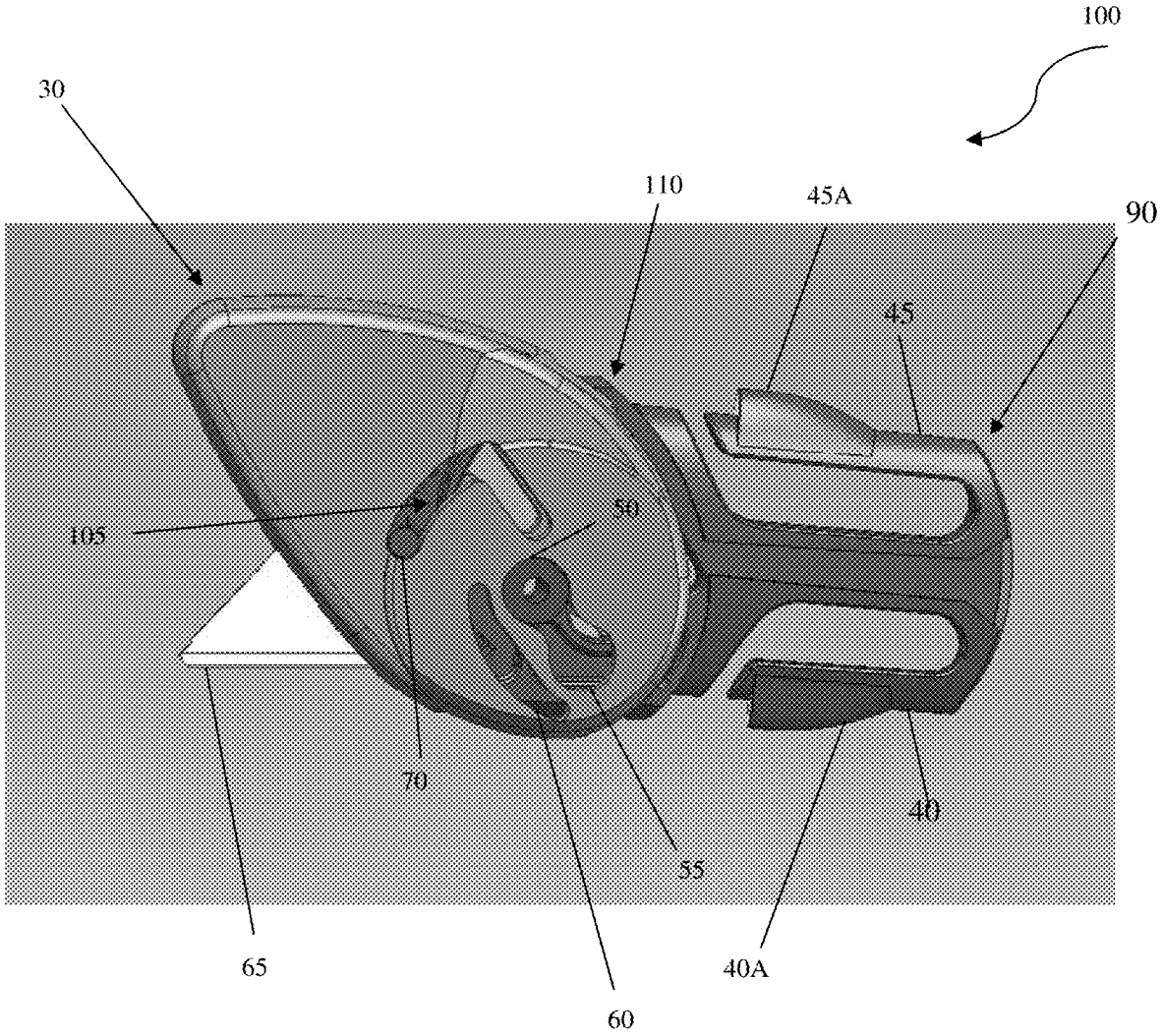
FIG. 1C illustrates the blade cartridge and cover of FIGS. 1A-1B, wherein the cover is in a blade exposing configuration.

FIGS. 1A-1C illustrate a utility knife cartridge 100 of the inventive subject matter. Cartridge 100 comprises blade holder or blade holder component 110, blade 65, stem 90, and blade cover 30. Blade holder 110 and stem 90 could be made from a single piece of material (e.g., injected molded plastic, metal). In other contemplated embodiments, blade holder 110 and stem 90 could be made from separate pieces of material.

Where a separate tool handle is not used with a cartridge of the inventive subject matter, stem 90 could be replaced with or otherwise include a handle. Here, cartridge 100 is one of many cartridges that can be used in combination with a tool handle (e.g., 350 of FIG. 3). In order to allow cartridge 100 to be releasably coupled to the tool handle, stem 90 includes a first arm 40 with a first stem locking member 40A, and a second arm 45 with a second locking member 45A. Each locking member is configured to mate with a catch of a tool handle as further described below.

Blade cover 30 is advantageously configured to move (e.g., slide) relative to the blade holder from a locked position, as shown in FIG. 1A, to an unlocked position, as shown in FIG. 1B. Blade holder 110 comprises a lock protrusion 50 that is configured to cooperate with blade cover's lock opening 55. This allows the blade cover 30 to be locked in a safe position that keeps the blade from being inadvertently exposed, regardless of whether or not the cartridge has been inserted into a tool handle.

Additionally, blade cover 30 is configured to move (e.g., rotate) relative to the blade holder and blade from a blade covering configuration, as shown in FIG. 1B, to a blade exposing configuration, as shown in FIG. 1C. Blade holder 110 comprises a movement protrusion 70 that is configured to cooperate with blade cover's angled channel 105 to allow for rotation of blade cover 30 when it is in an unlocked position.

Here, lock opening 55 and angled channel 105 are shown as extending through a thickness of blade cover 30. However, it should be appreciated that lock protrusion 50 and movement protrusion 70 could additionally or alternatively cooperate with recessed portions or grooves on an inner surface of blade cover 30.

Still further, while blade holder 110 is shown to have the lock and movement protrusions, and blade cover 30 is shown to have the lock opening and angled channel, it should be appreciated that one or more of the protrusions could be included on the blade cover, and one or more of the openings or channels could be included on the blade holder.

In the embodiment shown, lock opening 55 is peanut or nephroid shaped, and includes a narrow central portion between two wider ends. Lock protrusion 50 can be positioned, sized and dimensioned to snugly fit through the narrow central portion when a force towards one of the wider ends is applied by a user. Viewed from another perspective, a user could use at least one of a thumb and forefinger to hold the blade cover and move it towards the stem 90 to unlock the blade cover. Additionally or alternatively, the user could move the blade cover towards the blade 65 to lock the blade cover.

One or more slots (e.g., 60) could be included on blade cover 30 to allow the central portion of lock opening 55 to widen and allow lock protrusion 50 to pass through. Additionally or alternatively, one or more slots could be included on blade cover that allows a user to see blade 65 (or other tool) when blade cover is in a blade covering configuration.

In some embodiments, the lock protrusion 50 could have a varying thickness, and include at least one thinner portion and at least one wider portion. The wider portion(s) could be wider than the narrow central portion of lock opening 55, and thus not sized and dimensioned to pass through the narrow central portion. The thinner portion(s) could be positioned further away from blade holder 110 than the wider portion, such that lock protrusion 50 could be pushed in, and the thinner portion could pass through the narrow central portion of lock opening 55. Additionally or alternatively, the thinner portion could be positioned closer to the blade holder such that the lock protrusion could be pulled out, and the thinner portion could pass through the narrow central portion.

When the blade cover is moved from a locked position (as shown in FIG. 1A) to an unlocked position (as shown in FIG. 1B), movement protrusion 70 could be positioned at a corner of channel 105 such that blade cover 30 can move from a blade covering configuration (as shown in FIG. 1B) to a blade exposing configuration (as shown in FIG. 1C). As illustrated in FIGS. 1A-1C, the channel 105 can include a first sub-channel and a second sub-channel. The movement protrusion 70 could move through first sub-channel when blade cover 30 moves between a locked position and an unlocked configuration. The movement protrusion 70 could move through the second curved sub-channel when blade cover 30 moves between a blade covering configuration and a blade exposing configuration.

In some embodiments, blade cover 30 could be biased towards the blade covering configuration (e.g., via a spring). An exemplary spring biasing mechanism is the curved spring carried in a groove and described in U.S. Pat. No. 8,099,868 to Votolato. When blade cover 30 is in an unlocked position, a user could apply a pressure to a portion of the blade cover, for example, via a cutting surface, and cause the blade to be exposed to apply a cut to the cutting surface (item to be cut). When the pressure is released (e.g., when the knife is moved away from a cutting surface), blade cover 30 could automatically move back to a blade covering configuration.

It should be appreciated that the locking feature (lock opening 55 and lock protrusion 50) can allow a user to repeatedly lock and unlock the cover with a simple movement. A user can simply grab the blade cover with a forefinger and thumb, and pull or push the blade cover slightly away from or towards the knife handle. This can prevent accidental exposure to the cartridge blade when the knife is not in use (e.g., when it is in a pocket of a user, is placed in a toolbox or left unattended, when the cartridge is being coupled to, or removed from, a tool holder.

It is contemplated that cartridge 100 could be replaced with another blade cartridge, for example, when blade 65 becomes dull. Additionally or alternatively, cartridge 100 could be replaced with a different tool cartridge (e.g., screw driver cartridge, saw cartridge, scraper cartridge). The different tool cartridges could be the same as utility knife cartridge 100, except that blade 65 is replaced with a different tool.

Figure 2A:
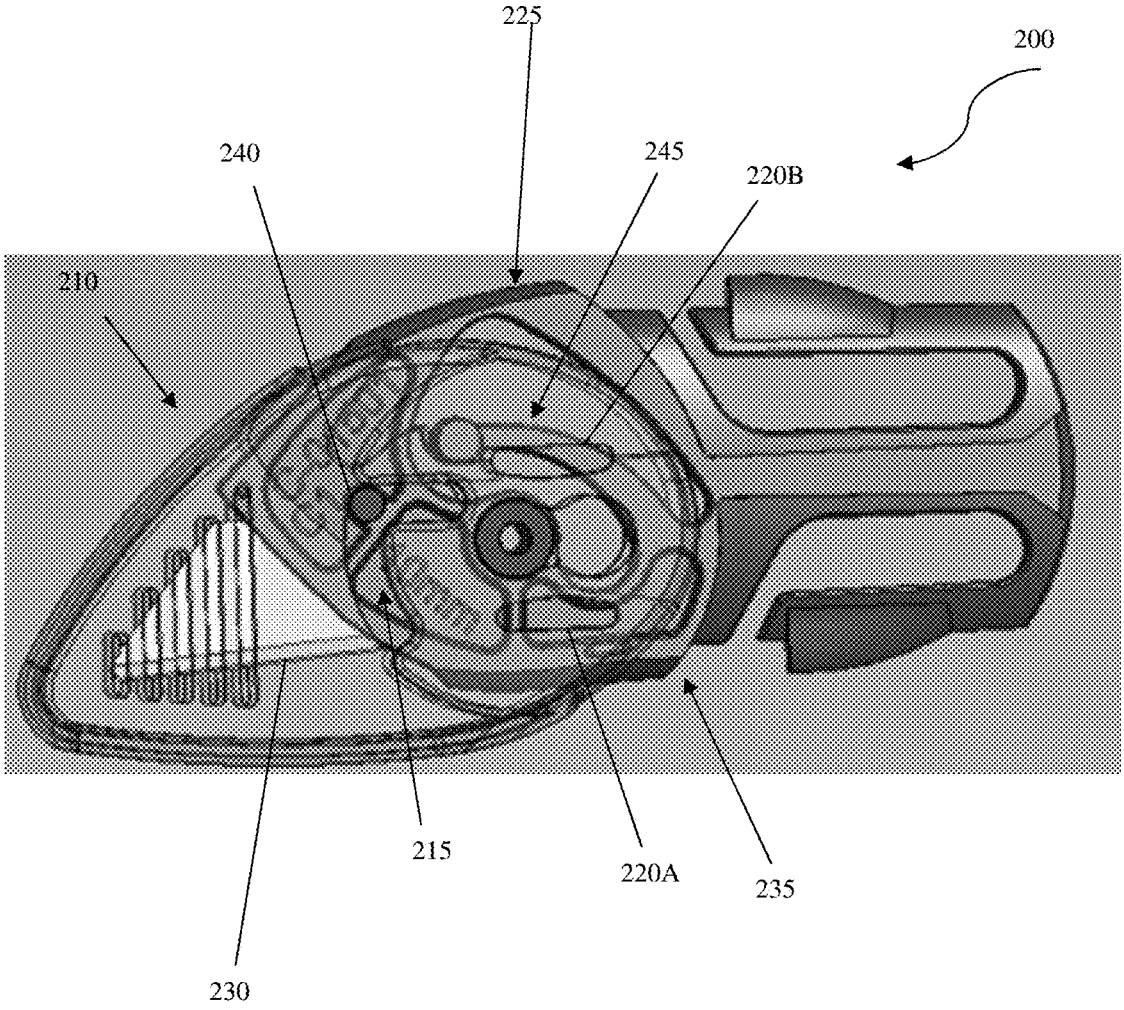
FIG. 2A illustrates another blade cartridge and cover of the inventive subject matter, wherein the cover is in an unlocked position and a blade covering configuration.
Figure 2B:
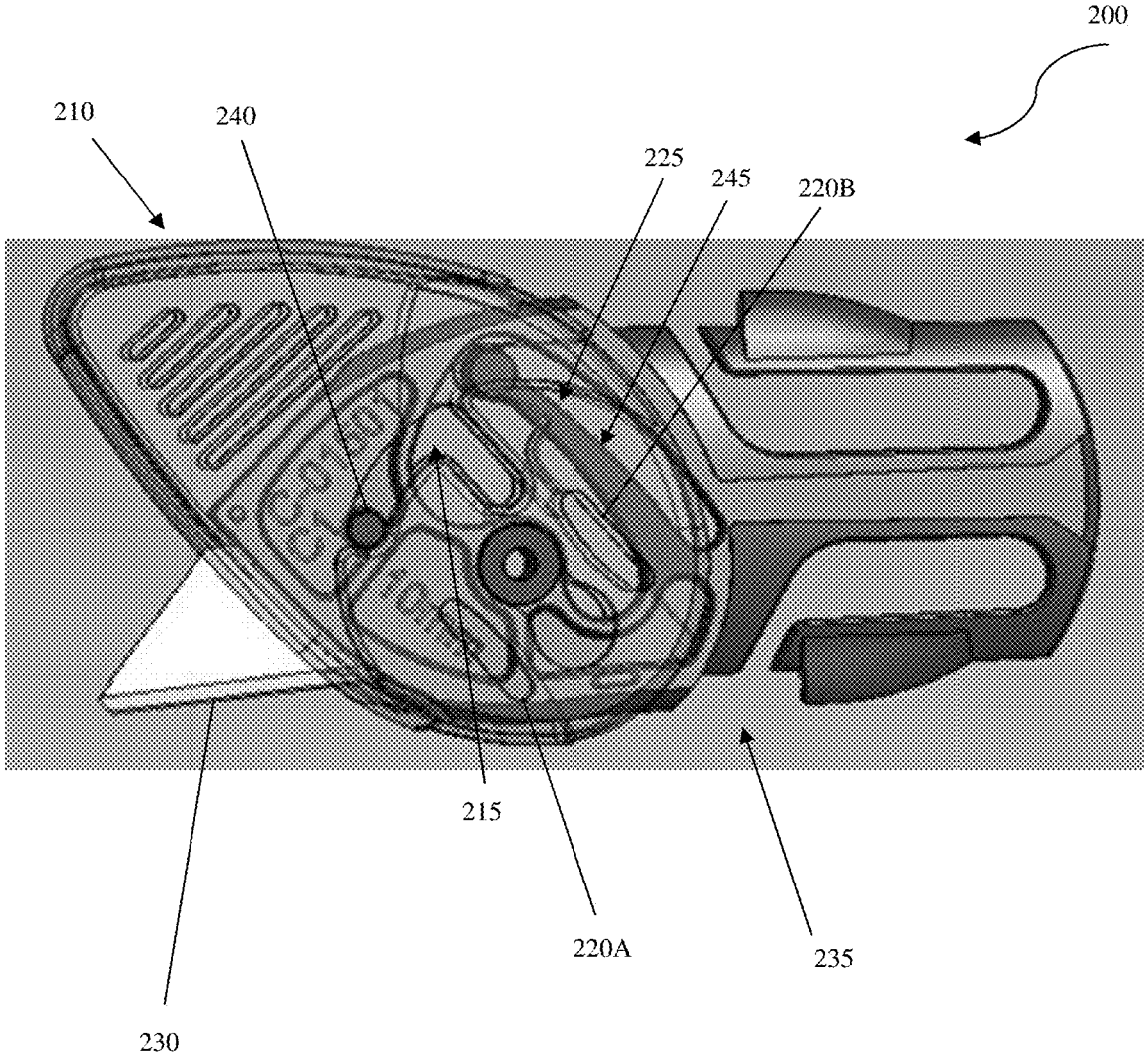
FIG. 2B illustrates the blade cartridge and cover of FIG. 2A, wherein the cover is in an unlocked position and a blade exposing configuration.

FIGS. 2A-2B illustrate another utility knife cartridge 200 of the inventive subject matter. Cartridge 200 includes blade holder 235 having a stem, blade 230, and a partially transparent blade cover 210. Cartridge 200 includes a lock opening and lock protrusion similar to those described in FIGS. 1A-IC. Cartridge 200 also includes slots 220A and 220B that provide some flexibility to blade cover 210. Furthermore, cartridge 200 includes a movement protrusion 240 that cooperates with channel 215 to allow blade cover 210 to adjust between locked and unlocked positions, and between blade covering (closed) and blade exposing (open) configurations.

In some embodiments, a cartridge blade cover could default/be biased to a closed position in which the blade cover surrounds the otherwise exposed portion of a blade. A spring (e.g., a curved spring) could be included, which pushes the blade cover into the closed position. The blade cover could remain in the closed position until pressure is applied to push the cover to an open configuration where the blade is exposed for use.

Additionally or alternatively to a spring, cartridge 200 could include a movable member 245 that can bias the blade cover in the closed position. When blade cover 210 is moved to an open configuration by a cutting surface or other force, blade cover 210 can cause movable member 245 to flex or straighten to a strained position within through-hole or recessed portion 225 in which movable member 245 is positioned (as shown in FIG. 2B).

Figure 3:
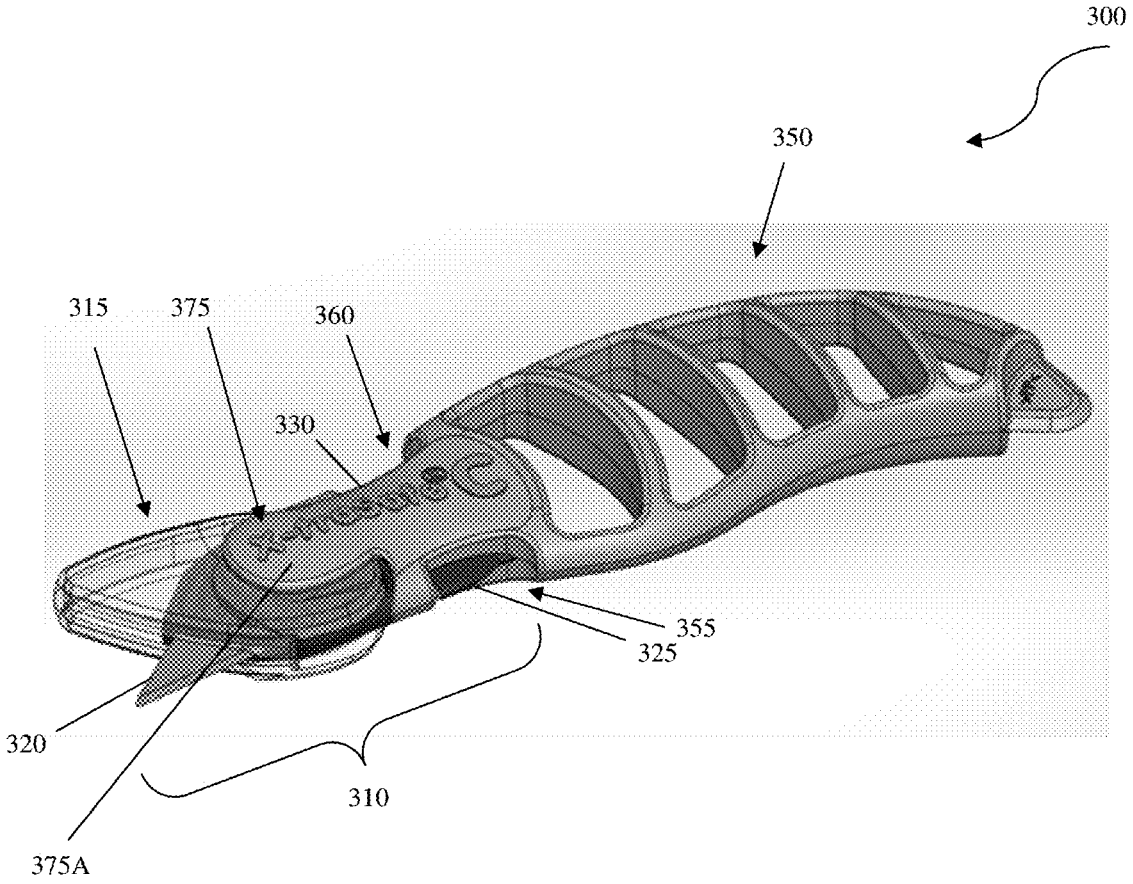
FIG. 3 illustrates a utility knife of the inventive subject matter.

As discussed above, cartridges of the inventive subject matter could include stems that are configured to be releasably received by one or more tool handles of the inventive subject matter. FIG. 3 illustrates a utility knife 300, which includes a cartridge 310 releasably locked into place on tool handle 350, and an anti-tamper guard.

Cartridge 310 includes a blade holder, blade 320, blade cover 315, and a stem that includes two flexible arms that include two locking members (325, 330). In one embodiment, the stem and flexible arms are configured such that considerable pressure is required to depress the two flexible arms. In another embodiment, only slight pressure is required to depress the two flexible arms. Further, in some embodiments, after pressure is released from the two flexible arms, the arms return back to their original positions. In a further embodiment, only when the two flexible arms are depressed is cartridge 310 able to fit into tool handle 350, while in another only one flexible arm must be depressed.

Tool handle 350 includes a first catch 355 sized and dimensioned to receive a first locking member (e.g., 40A, 325), and a second catch 360 sized and dimensioned to receive a second locking member (e.g., 45A, 330). In the embodiment shown, catch 355 is located on a bottom edge of knife 300, and catch 360 is located on a top edge of knife 300. When cartridge 310 is locked with tool handle 350, the two flexible arms can be flexed towards each other (away from their resting positions) to allow locking members 325 and 330 to snap into catches 355 and 360, respectively. From another perspective, the flexible arms of cartridge 310 could be configured such that, in a relaxed position, locking members 325 and 330 rest snugly and securely within catches 355 and 360.

The receiving end of the opening of the tool holder can be sized and dimensioned to receive the arms of cartridge 310 in a way that momentarily depresses those arms, allowing for locking members 325 and 330 to slide into the tool handle opening, and then to snap back to lock into place in catches 355 and 365 located on the vertical plane or spine of the handle.

When removing cartridge 310 for replacement, a user can simply squeeze or pinch the stem arms together via locking members 325 and 330, allowing cartridge 310 to be pulled out from tool handle 350. In some embodiments, the force required to depress the stem arms is great, while in others slight pressure is sufficient.

Cartridge 310 can further be configured such that, while inserting cartridge 310 into tool handle 350, cartridge 310 is shifted into a locked configuration where blade cover 315 cannot move in relation to blade 320. This can be accomplished, for example, by reversing the orientation of angled channel 105 such that a pushing motion along blade cover 315 toward tool handle 350 slides the lock protrusion along the angled channel into a locked conformation.

Cartridge 310 can further be configured such that, while removing cartridge 310 from tool handle 350, cartridge 310 is shifted into a locked configuration where blade cover 315 cannot move in relation to blade 320. This can be accomplished, for example, by using the orientation of angled channel 105 such that a pulling motion along blade cover 315 away from tool handle 350 slides the lock protrusion along the angled channel into a locked conformation.

Whereas known utility knives included spring arms protruding along the horizontal axis and perpendicular to the orientation of the blade, cartridges of the inventive subject matter can advantageously include flexible arms on the vertical plane, and in the same direction as the orientation of the blade. Viewed from another perspective, when knife 300 is used to make a cut, a user can grab left and right sides of the blade without inadvertently releasing the cartridge from the tool handle.

Furthermore, knife 300 additionally includes an anti-tamper guard 375, which protects blade cover 315 from being tampered with or taken off of cartridge 310 when cartridge 310 is coupled with tool handle 350. As illustrated, tool handle 350 could comprise anti-tamper guard 375, which could at least partially surround first and second side surfaces of blade cover 315. More specifically anti-tamper guard 375 can include a first side portion 375A and a second side portion substantially parallel to front side portion 375A. The first and second side portions form a gap sized and dimensioned to receive a thickness of cartridge 310, including a portion of blade cover 315.

The outer surface of one or both of the side portions could include a logo, design or other marking. The inner surface of one or both side portions could include protrusions that are sized and dimensioned to couple with an aperture or recesses of a lock protrusion (e.g., 50 in FIG. 1A). For example, each of the two portions could include a protrusion such that the two protrusions face one another. These two protrusions could couple with a through-hole or recessed portions of a lock protrusion via a snap fit or any other suitable mechanism.

An anti-tamper guard as described above could advantageously protect against unwanted tampering of the blade cover, yet allow the blade cover to move between unlocked, locked positions, and closed and open configurations. Anti-tamper guards are further described and shown in FIGS. 7A-7D.

Figure 4:
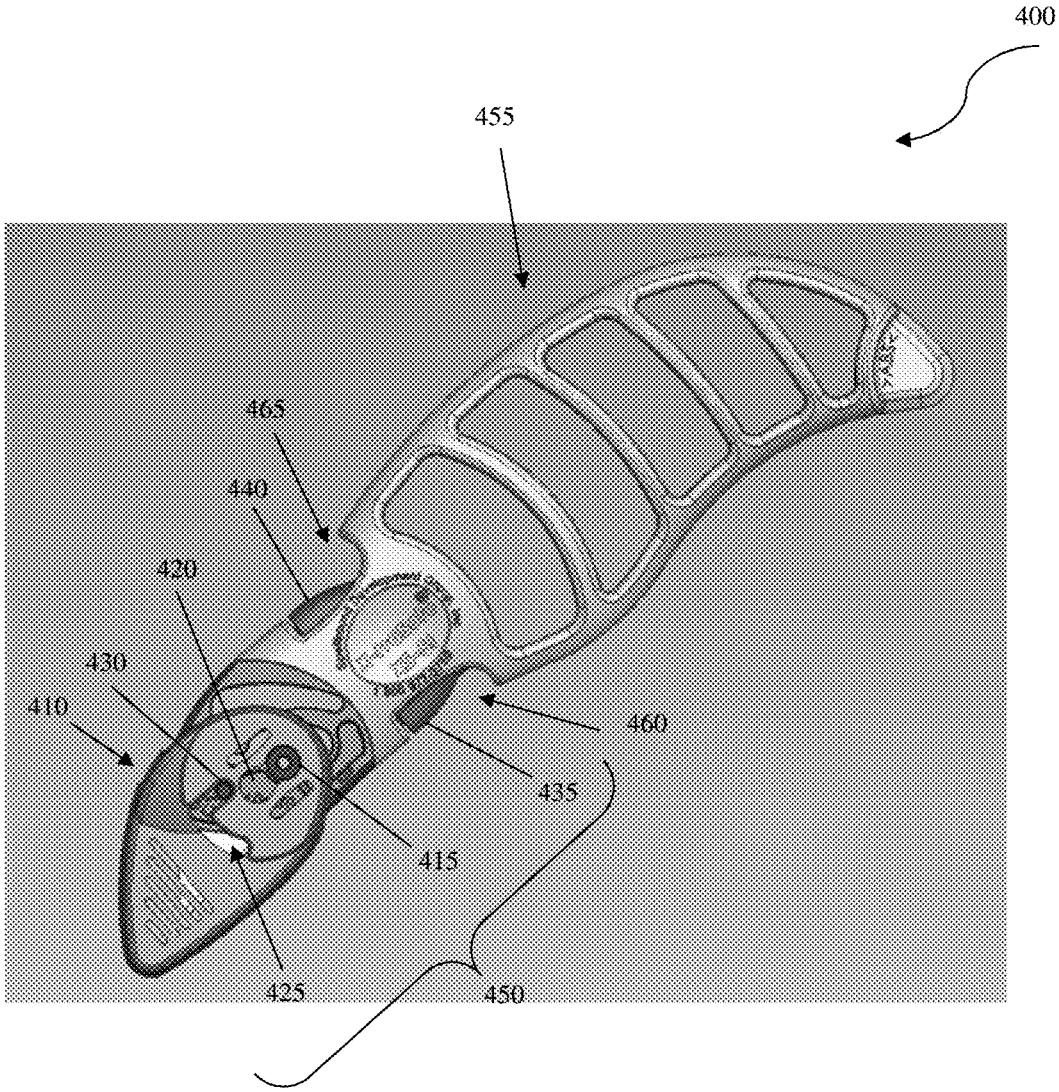
FIG. 4 illustrates another utility knife of the inventive subject matter.

FIG. 4 illustrates another utility knife 400 of the inventive subject matter. Knife 400 includes handle 455 and cartridge 450. Cartridge 450 includes a blade holder, blade, blade cover 410, and two flexible arms including locking members 435 and 440. Handle 455 includes first and second catches 460 and 465, which are sized and dimensioned to block locking members 435 and 440 in place.

Cartridge 450 is similar to the cartridges shown in FIGS. 1A-IC and FIGS. 2A-2B, and includes mechanisms that allow blade cover 410 to move between locked and unlocked positions, and between closed and open configurations. As illustrated, blade cover 410 is in a locked position. A user could use his thumb and forefinger, a cutting surface, or any other suitable force to move blade cover 410 towards handle 455 such that locking protrusion 415 moves to an opposite end of lock opening 420 (unlocked position). This would position moving protrusion 430 within the corner of angled channel 425, and allow a user to rotate blade cover 410 to a blade exposing (open) configuration. Some contemplated channels allow blade cover 410 to rotate between 25-75 degrees, more preferably between 25-65 degrees, and even more preferably between 25-55 degrees.

Figure 5A:
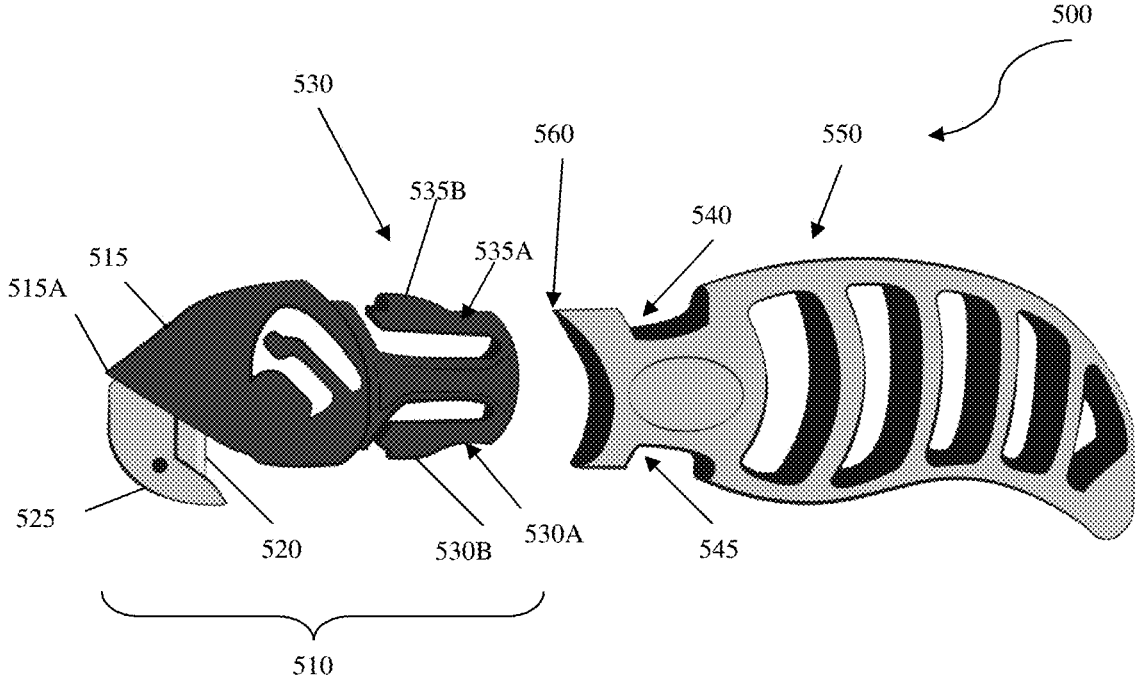
FIG. 5A illustrates another embodiment of a utility knife, including a blade cartridge and a tool handle.
Figure 5B:
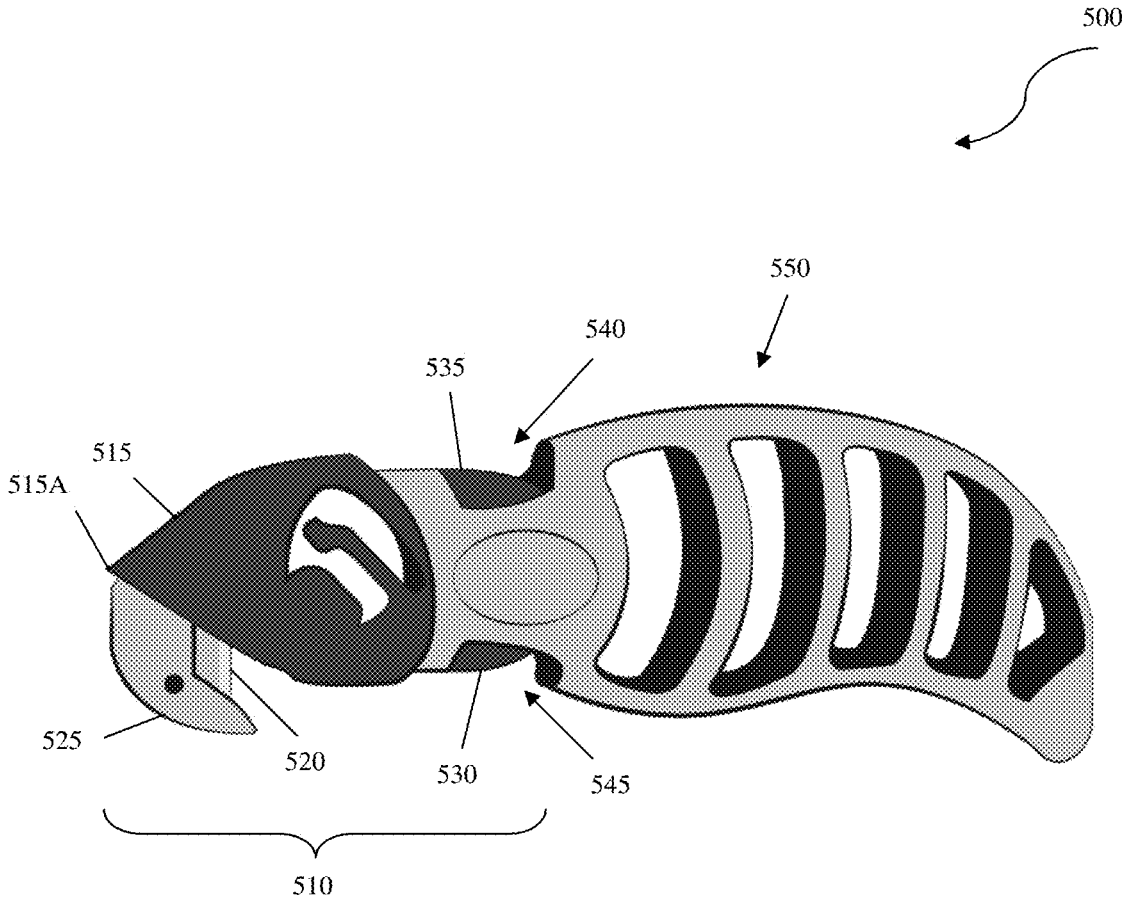
FIG. 5B illustrates the utility knife of FIG. 5A, wherein the blade cartridge is locked into the tool handle.

FIGS. 5A and 5B illustrate yet another utility knife 500 of the inventive subject matter. FIG. 5A shows cartridge 510 and handle 550 separated from one another, and FIG. 5B shows the components coupled together.

Cartridge 510 includes a blade holder (or blade holder portion) 515, blade 520, blade top shield 525, and a stem 530 that includes two flexible arms 530A, 535A having two locking members 530B, 535B. The stem 530 and flexible arms 530A, 535A are configured such that a pressure is required to depress the two flexible arms 530A, 535A. After a pressure is released from the two flexible arms 530A, 535A, they return back to their original positions. It is contemplated that one or both of the flexible arms 530A, 535A will need to be squeezed towards one another in order to releasably couple with handle 550's catches 540 and 545.

Tool handle 550 includes a first catch 540 sized and dimensioned to receive a first locking member 535B, and a second catch 545 sized and dimensioned to receive a second locking member 530B. In the embodiment shown, catch 545 is located on a bottom edge of knife 500, and catch 540 is located on a top edge of knife 500. When cartridge 510 is locked with tool handle 550 as shown in FIG. 5B, the two flexible arms can be flexed towards each other (away from their resting positions) to allow locking members 535B and 530B to snap into catches 540 and 545, respectively. From another perspective, the flexible arms of cartridge 510 could be configured such that, in a relaxed position, locking members 535B and 530B rest snugly and securely within catches 540 and 545.

The receiving end 560 of the opening of the tool handle can be sized and dimensioned to receive the arms of cartridge 510 in a way that momentarily depresses those arms, allowing for locking members 530B and 535B to slide into the tool handle opening, and then to snap back to lock into place in catches 540 and 545 located on the vertical plane or spine of the handle.

When removing cartridge 510 for replacement, a user can simply squeeze or pinch the stem arms 535A and 530A together via locking members 535B and 530B, allowing cartridge 510 to be pulled out from tool handle 550.

It should be appreciated that a blade cover as described in FIGS. 1-4 (e.g., blade cover 315) could advantageously be used with cartridge 510. Cartridge 510 could include a lock protrusion (e.g., 50 in FIG. 1A), which could be coupled with a blade cover lock opening (e.g., 55 in FIG. 1A). Cartridge 510 could also include a movement protrusion (e.g., 70 in FIG. 1A), which could be coupled with a blade cover channel (e.g., 105) as described above. Viewed from another perspective, cartridge 510 could be identical to cartridges 100, 310 or 200, which include blade covers, except for the positioning of blade 520 and the inclusion of blade top shield 525.

As shown in FIGS. 5A-5B, blade holder 515, blade 520, blade top shield 525 are configured such that a blade cover may not be required. An edge of blade holder 515 and an edge of blade top shield (referred to herein from time to time as blade cap, second blade holder, or blade tip cap) 525 define a recessed area that includes blade 520. Only a small portion of blade 520's edge is exposed (e.g., less than 2 cm, less than 1.5 cm, less than 1 cm), and the exposed edge portion is recessed relative to an end of blade top shield 525, which could comprise a piercer or a blunt tip. Viewed from another perspective, cartridge 510 is configured such that an object will not be cut by blade 520 unless placed within a recess defined by an edge of a blade holder and an edge of a blade top shield. In preferred embodiments, blade top shield 525's end or tip could extend at least 1 mm, at least 2 mm, at least 5 mm, or even at least 10 mm or more further towards the cartridge stem than blade 520's edge. Additionally or alternatively, blade holder 515's tip 515A could extend further away from the cartridge stem than blade top shield (e.g., at least 1 mm, at least 2 mm, at least 5 mm or even more), and could comprise a pointed tip that acts as a piercer.

Figure 6A:
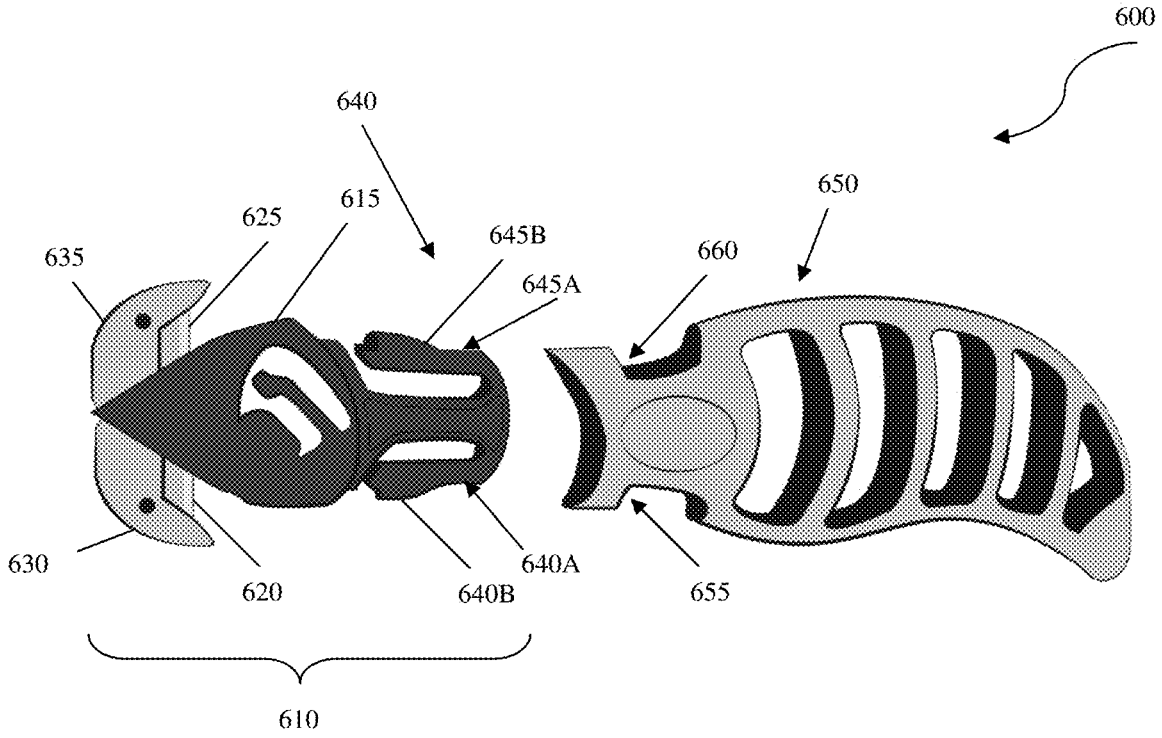
FIG. 6A illustrates yet another embodiment of a utility knife, including a blade cartridge and tool handle.
Figure 6B:
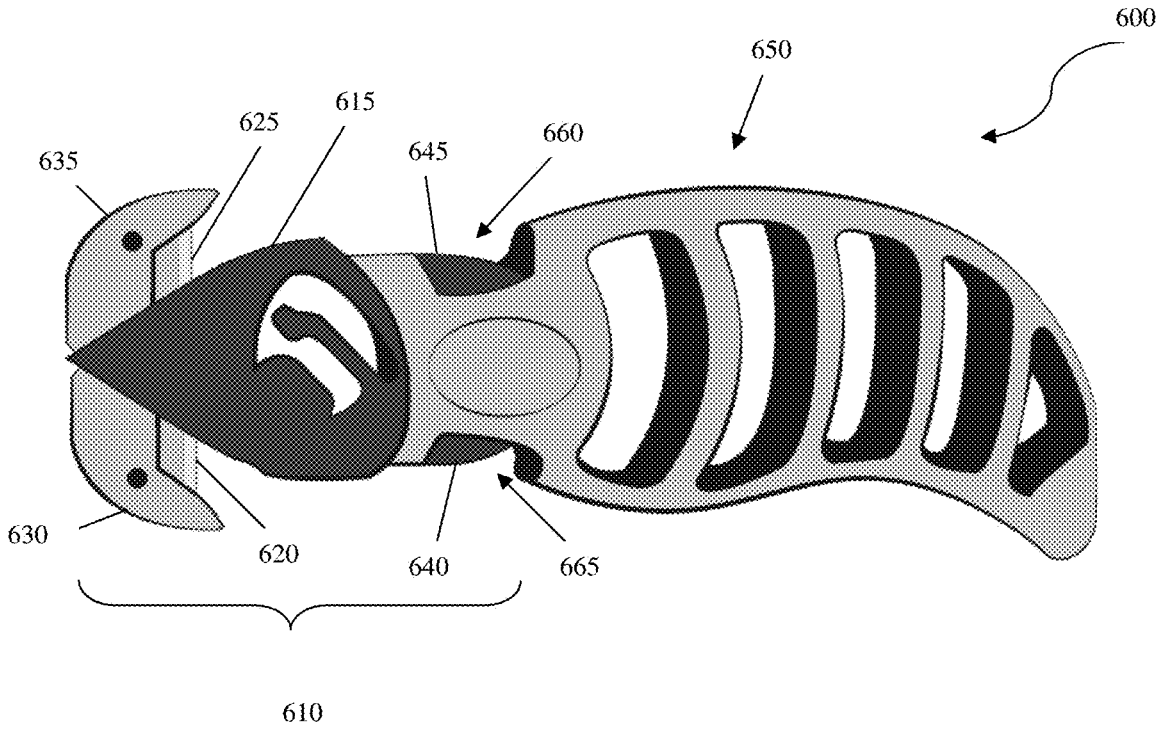
FIG. 6B illustrates the utility knife of FIG. 6A, wherein the cartridge is locked into the tool handle.

FIGS. 6A-6B illustrate yet another utility knife 600, which can be used with or without a blade cover. Utility knife 600 is similar to knife 500, and includes a cartridge 610 and tool handle 650. Cartridge 610 comprises a blade holder 615 and a stem 640 including two flexible arms 645A, 640A having locking members 645B and 640B. Handle 650 comprises two catches 660 and 655 that are sized and dimensioned to receive locking members 645B and 640B, respectively. Cartridge 610, however, includes two blade top shields 635 and 630, each of which are coupled to blade holder 615 and at least partially define a recess.

An edge of blade holder 615 and an edge of blade top shield 635 define a recessed area that includes blade 625. Only a small portion of blade 625's edge is exposed (e.g., less than 2 cm, less than 1.5 cm, less than 1 cm), and the exposed edge portion is recessed relative to an end of blade top shield 635, which could comprise a piercer or a blunt tip.

Viewed from another perspective, cartridge 610 is configured such that an object will not be cut by blade 625 unless placed within a recess defined by an edge of a blade holder and an edge of a blade top shield. A different edge of blade holder 615 and an edge of blade top shield 630 define a recessed area that includes blade 620. Only a small portion of blade 620's edge is exposed, and the exposed edge portion is recessed relative to an end of blade top shield 630, which could comprise a piercer or a blunt tip.

Similarly to utility knife 500, each blade top shield 635 or 630's end or tip could extend at least 1 mm, at least 2 mm, at least 5 mm, or even at least 10 mm or more further towards the cartridge stem than blade 625 or 620's edge.

In some aspects of the inventive subject matter, a cartridge can include a movable member, a blade holder, and a blade. A blade cover coupled to the cartridge can include an opening member, and be configured to move from a closed configuration to an open configuration via an interaction of the opening member and the movable member. Additionally or alternatively, the blade could compose a hook-type cutter, and include an exposed edge portion that is recessed relative to at least one of the blade holder and a blade tip cover. FIGS. 7A-7D illustrate a utility knife 700 having such features.

Figure 7A:
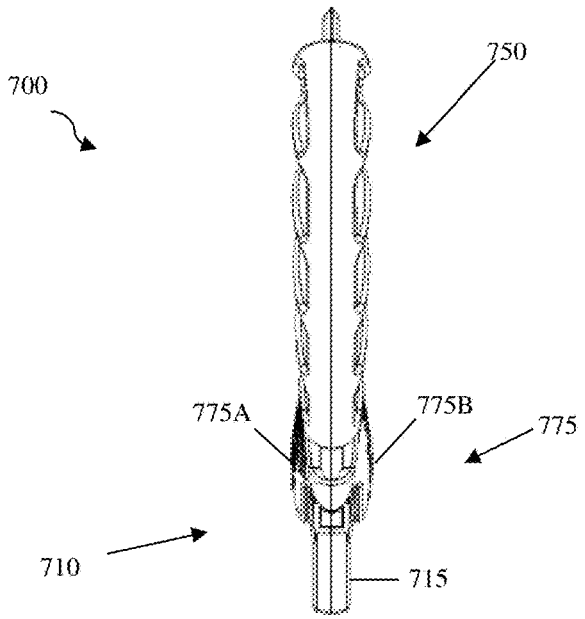
FIGS. 7A-7D illustrate a utility knife of the inventive subject matter having a hook type cutter.
Figure 7B:
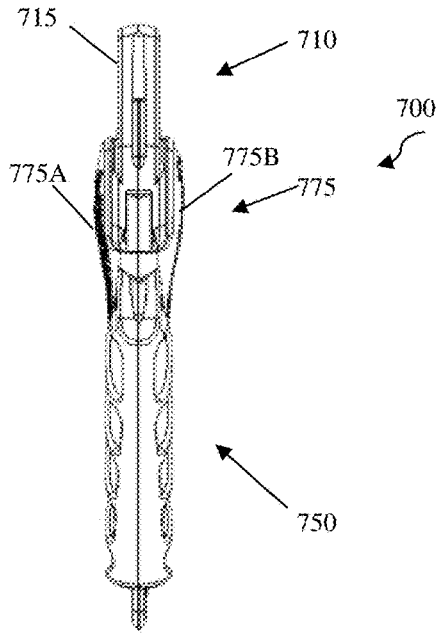

FIG. 7A is a top view of knife 700, which includes handle 750, cartridge 710 removably coupled to handle 750, anti-tamper guard 775 having first and second sides (775A, 775B), and blade cover 715. As can more clearly be seen in the bottom view of FIG. 7B and the side views of FIGS. 7C and 7D, the first and second sides 775A, 775B of anti-tamper guard 775 form a gap that is sized and dimensioned to receive at least portions of cartridge 710 and blade cover 715.

Anti-tamper guard 775 protects blade cover 715 from being tampered with or taken off of cartridge 710 when cartridge 710 is coupled with tool handle 750. First and second sides 775A, 775B are substantially parallel to one another, and positioned, sized and dimensioned to receive a thickness of blade cover 715.

It should be appreciated that the cartridge and blade cover of knife 700 could function similarly to the cartridge and blade cover shown in FIG. 1A. For example, cartridge 710 could include a blade holder, a blade, a stem having two flexible arms, and a lock protrusion (e.g., 50 of FIG. 1A). Blade cover 715 could include a lock opening (e.g., 55 of FIG. 1A), and be configured to move (e.g., slide) relative to the blade holder from a locked position, as shown in FIG. 1A, to an unlocked position, as shown in FIG. 1B. In this manner, blade cover 715 can be locked in a safe position that keeps the blade from being inadvertently exposed, regardless of whether or not the cartridge has been inserted into a tool handle.

Additionally or alternatively, blade cover 715 could be configured to move (e.g., rotate) relative to the blade holder and blade from a blade covering configuration, as shown in FIG. 1B, to a blade exposing configuration, as shown in FIG. 1C. For example, the blade holder could comprise a movement protrusion (e.g., 70 of FIG. 1A) that is configured to cooperate with blade cover's angled channel (e.g., 105 of FIG. 1A) to allow for rotation of blade cover 715 when it is in an unlocked position.

In some other embodiments, blade cover 715 could be configured to move from a blade covering configuration to a blade exposing configuration, but not be configured to move between a locked position and an unlocked position. Additionally, the blade cover could be biased to a blade covering configuration (e.g., via a spring).

In some other embodiments, blade cover could be configured to move between only two positions—away and towards a cartridge stem via a lock opening of the blade cover and a lock protrusion of the cartridge, or vice versa. When blade cover is positioned towards the cartridge stem, the blade edge could be entirely covered by the blade cover. When blade cover is positioned away from the cartridge stem, the blade edge could be exposed. The blade cover could be biased towards a blade covering position, wherein the lock protrusion could be positioned within one wide end of the nephroid lock opening, similar to what is shown in FIG. 1B. When a force is applied, the blade cover could move towards a blade exposing position, wherein the lock protrusion could be positioned within the other wide end of lock opening, similar to what is shown in FIG. 1A.

Figure 7C:
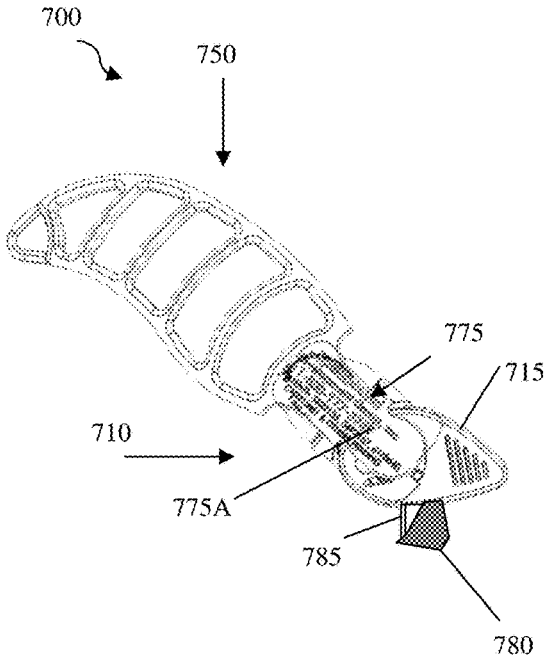
Figure 7D:
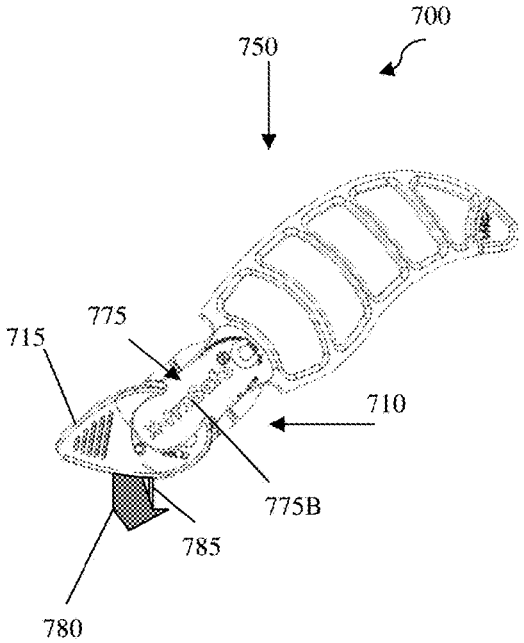

The outer surface of one or both of the first and second sides 775A, 775B could include a logo, design or other marking (as shown in FIGS. 7C and 7D). An inner surface of one or both sides could include a protrusion that is sized and dimensioned to couple with an aperture or recess of a lock protrusion (e.g., 50 in FIG. 1A). For example, each of the two portions could include a protrusion, and the two protrusions could face one another. These two protrusions could couple with a through-hole or recessed portions of a lock protrusion via a snap fit or any other suitable mechanism.

Figure 9:
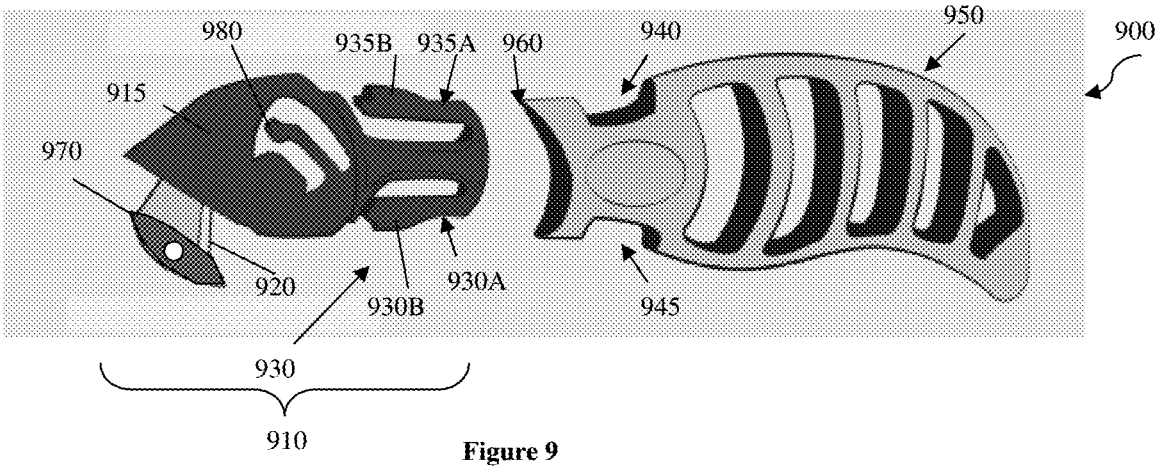
FIG. 9 illustrates another utility knife having a blade tip cap.
Figure 10:
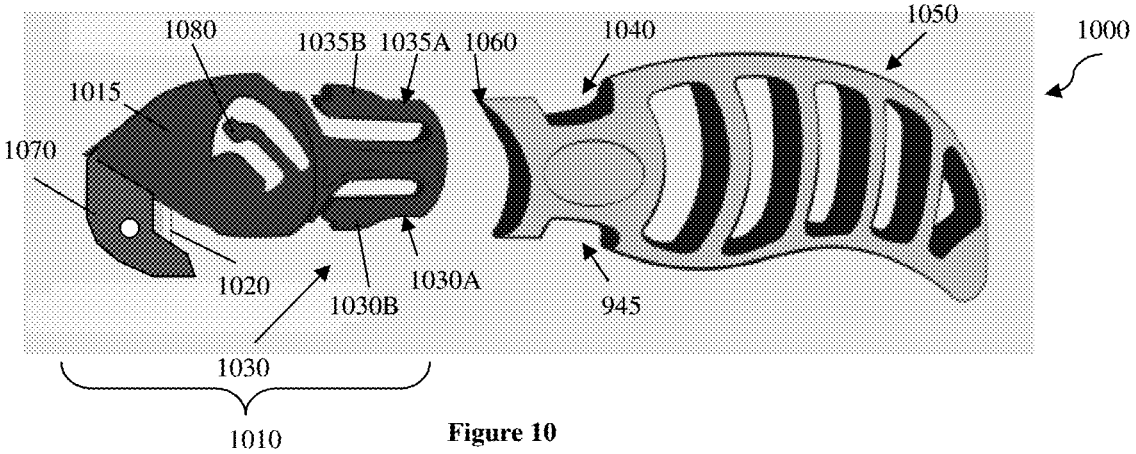
FIG. 10 illustrates yet another utility knife having a blade tip cap.

Knife 700 could also include a blade tip cover 780, which can be sized and dimensioned to receive at least a portion of blade 785. Blade tip cover 780 could be fixedly attached to blade 785, movably but permanently attached to blade 785 or other portion of cartridge 710, or removably coupled to blade 785 via a suitable mechanism. Some exemplary knives having different blade tip covers are illustrated in FIGS. 8-10, but it should be appreciated that any suitable cover that is sized and dimensioned to securely receive a portion of a blade that not secured within a cartridge blade holder is contemplated.

Figure 8:
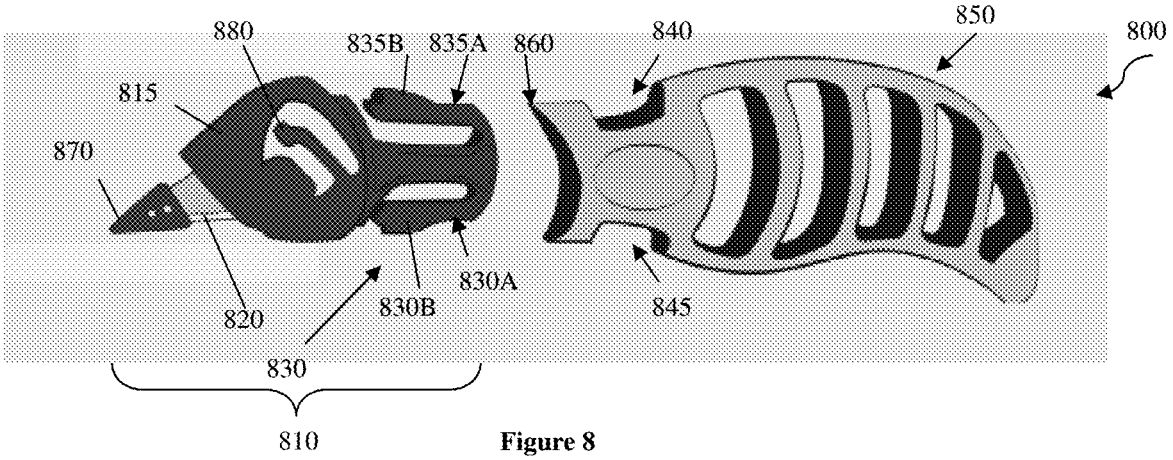
FIG. 8 illustrates a utility knife having a blade tip cap.

FIG. 8 illustrates utility knife 800, which includes a handle 850 and cartridge 810. Cartridge 810 includes a blade holder 815, which secures blade 820 in place, and blade tip cap 870, which advantageously provides protection against inadvertent cuts by creating a hook-type cutter with blade 820 and blade holder 815. Cartridge 810 also includes a moving member or biasing member 880 positioned within a recess or through-hole of cartridge, which is configured to flex when a pressure is applied, for example, by a blade cover's opening member. Stem 830 of cartridge 810 includes two flexible arms 830A, 835A, each of which include a locking member 830B, 835B, respectively.

Stem 830 is sized and dimensioned to be received by an opening 860 of handle 850. Arms 835A and 830A can be squeezed towards one another to allow locking members 835B, 830B to pass through opening 860, and snap or otherwise be released into first and second catches 840, 845, respectively.

The portion of blade 820 that is not secured within blade holder 815 is triangular in shape and includes a pointy end. Blade tip cap 870 is similarly triangular in shape, and is sized and dimensioned to receive the pointy end of blade 820, leaving an exposed blade portion between blade holder 815 and blade tip cap 870. Viewed from another perspective, the exposed portion of blade 820's edge is recessed relative to blade holder 815 and blade tip cap 870, and forms a hook-type cutter.

FIG. 9 illustrates another utility knife 900 including a hook type cutter. Cartridge 910 includes a blade holder 915, which secures blade 920 in place, and blade tip cap 970. Cartridge 910 also includes a biasing member 980 positioned within a recess or through-hole of cartridge, which is configured to flex when a pressure is applied, for example, by a blade cover's opening member. Stem 930 of cartridge 910 includes two flexible arms 930A, 935A, each of which include a locking member 930B, 935B, respectively.

Stem 930 is sized and dimensioned to be received by an opening 960 of handle 950. Arms 935A and 930A can be squeezed towards one another to allow locking members 935B, 930B to pass through opening 960, and snap into first and second catches 940, 945, respectively.

The portion of blade 920 that is not secured within blade holder 915 is trapezoidal or trapezium in shape, and includes two pointy ends. A first pointy end is sharp and includes the blade's cutting edge. A second pointy end has a greater thickness, and is not typically used to create a cut. Blade tip cap 970 can comprise any suitable shape, and is sized and dimensioned to receive the first and second pointy ends of blade 920, leaving an exposed blade portion between blade holder 915 and blade tip cap 970.

FIG. 10 illustrates yet another utility knife 1000 including a hook type cutter. Cartridge 1010 includes a blade holder 1015, which secures blade 1020 in place, and blade tip cap 1070. Blade holder 1050 and blade tip cap 1070 cooperate to cover the entirety of blade 1020, exclusive of a portion of a cutting edge.

Cartridge 1010 also includes a biasing member 1080 positioned within a recess or through-hole of cartridge, which is configured to flex when a pressure is applied, for example, by a blade cover's opening member. It should be appreciated that biasing member 1080 is optional, and may not be included in embodiments not including a rotating blade cover. Stem 1030 of cartridge 1010 includes two flexible arms 1030A, 1035A, each of which include a locking member 1030B, 1035B, respectively.

Stem 1030 is sized and dimensioned to be received by an opening 1060 of blade holder 1050. Arms 1035A and 1030A can be squeezed towards one another to allow locking members 1035B, 1030B to pass through opening 1060, and release into first and second catches 1040, 1045, respectively.

Blade 1020 is a quadrilateral, but could alternatively comprise any other suitable shape. Blade 1020 includes an outer perimeter, at least part of which comprises a cutting edge. Blade tip cap 1070 extends from blade holder 1015 and around the outer perimeter of blade 1020 that is not covered by blade holder 1015, leaving only a small portion of blade 1020's cutting edge accessible. The accessible portion of blade 1020's cutting edge could have any suitable length, including for example, between 1-20 mm, between 1-15 mm, between 1-10 mm, between 5-15 mm, or between 5-10 mm, 10-15 mm. Viewed from another perspective, it is contemplated that blade holder 1015 and blade tip cap 1070 could enclose at least 50%, at least 70%, at least 80%, or even 90% or more of blade 1020's outer perimeter.

In some preferred embodiments, the blade is positioned relative to the blade holder 1015 and blade tip cap 1070 such that the exposed blade edge portion is recessed, thereby forming a hook type cutter. Viewed from another perspective, the blade tip cap and an edge of blade holder 1050 each extend further towards the cartridge stem 1030 than blade 1020's cutting edge. Viewed from yet another perspective, the blade holder and blade tip cap form a notch or recess in which blade 1020 (including its cutting edge) is disposed.

It should be appreciated that the knives of FIGS. 8, 9 and 10 could each include an anti-tamper guard, or any other feature described throughout the application.

Figure 11A:
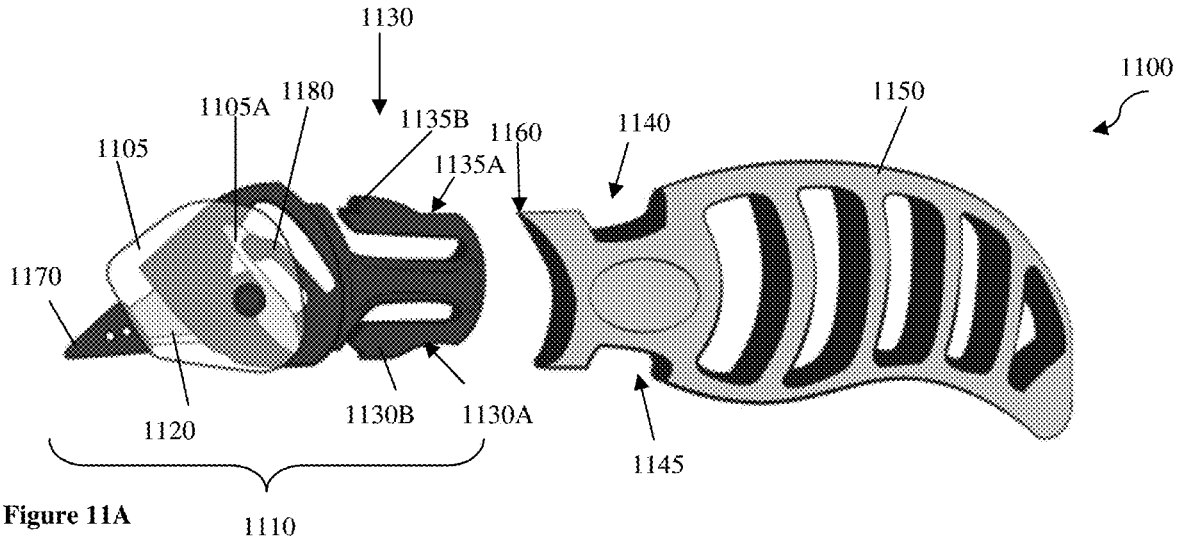
FIGS. 11A-11C illustrate a utility knife having a blade tip cap and a blade cover.
Figure 11B:
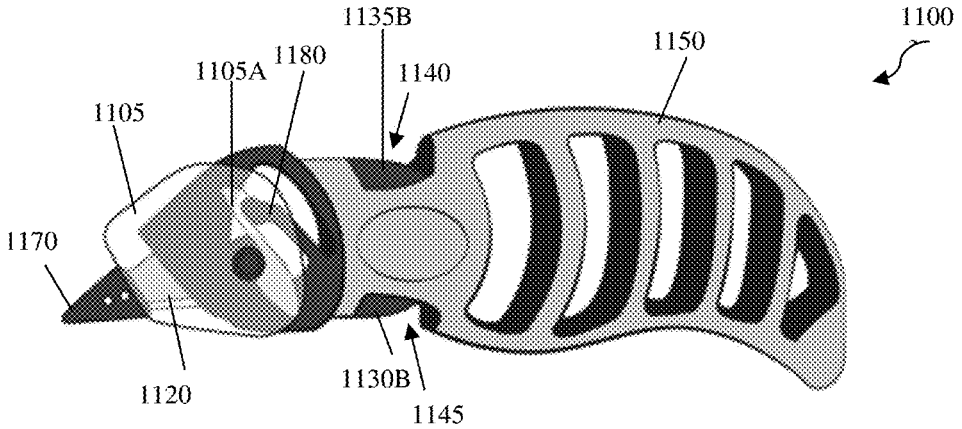
Figure 11C:
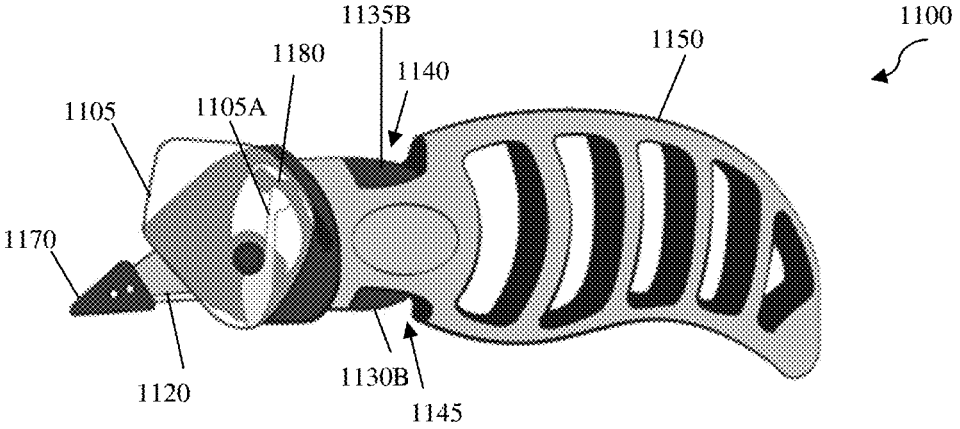

FIGS. 11A-11C illustrate a utility knife of the inventive subject matter similar to the knives of FIGS. 8-10, and including a blade cover 1005 that is configured to rotate relative to cartridge 1110. FIG. 11A illustrates blade cover 1105 in a closed position, with cartridge 1110 removed from handle 1150. FIG. 11B illustrates blade cover in a closed position, with cartridge 1110 coupled with handle 1150. FIG. 11C illustrates blade cover in an open position, with cartridge 1110 coupled with handle 1150.

Utility knife 1100 includes cartridge 1110 and tool handle 1150. Cartridge 1110 includes a blade holder, which secures blade 1120 in place, and blade tip cap 1170. Cartridge 1110 also includes a biasing member 1180 positioned within a recess or through-hole of cartridge 1110. Biasing member 1180 is configured to flex when a pressure is applied by blade cover's opening member 1105A, as further described below. In some preferred embodiments, the cartridge is sized and dimensioned such that the biasing member can move at least 25 mm in at least one direction, at least 20 mm in at least one direction, at least 15 mm in at least one direction, at least 10 mm in at least one direction, or at least 5 mm in at least one direction.

Stem 1130 of cartridge 1110 includes two flexible arms 1130A, 1135A, each of which include a locking member 1130B, 1305B, respectively. Stem 1130 is sized and dimensioned to be received by an opening 1160 of handle 1150. Arms 1135A and 1130A can be squeezed towards one another to allow locking members 1135B, 1130B to pass through opening 1160, and snap into first and second catches 1140, 1145, respectively.

Opening member 1105A comprises a stem that leads to a nub or protuberance. Biasing member 1180 similarly includes a stem that leads to a nub or protuberance, and the nubs of the two members face one another. When blade cover 1105 is in a closed position, biasing member 1180's nub is positioned beneath opening member 1105's nub. As a force is applied to blade cover 1105 in order to expose blade 1120, biasing member 1180's nub moves up towards opening member 1105A's nub, aligns with opening member 1105's nub, and then sits above opening member 1105's nub.

It should be appreciated that opening member 1105A could be less flexible than biasing member 1180 such that opening member 1105A does not change shape when blade cover 1105 is moved. Additionally or alternatively, opening member 1105A could be positioned on blade cover 1105 such that opening member 1105A does not or cannot move, even when a pressure is applied. For example, opening member 1105A could be fixedly attached to, or comprise an extension of, an inner surface of blade cover 1105.

Methods of making cartridges as described are also contemplated. A cartridge as detailed in FIGS. 1A-11C can be assembled by fixing a blade to a cartridge. The blade can be made of metal, plastic, ceramic, wood, bone, keratin, enamel, carbon, stone, obsidian, glass, diamond, or any other material suitable for cutting or applying directed pressure. Further, the blade may be straight, curved, round, angled, serrated, sharpened, dulled, or otherwise configured as appropriate for the desired use. The cartridge may be a single piece or the composite of several pieces. The pieces could be of the same material (e.g., injection molded plastic) or of a range of materials.

A cartridge as described above can be made by fixing a blade cover to the blade holder. The blade cover can be an integral part of the blade holder and can be made of the same material as the blade holder. For example, the blade cover and blade holder can be made of a single piece of flexible rubber or rigid plastic. Further, the blade cover and blade holder can be made primarily of the same material as an integral piece, while the blade holder is further comprised of other components or materials. The blade cover and the blade holder can also be separate components, and can be made of different materials or the same material. The blade cover can be fixed to the blade holder by means that permit the blade cover to rotate (partially or fully), pivot, slide, swivel, turn, bend, flex or otherwise move in relation to the blade.

A cartridge as described above can also be made such that the blade cover and the blade holder are attached at a junction. The junction can be further configured such that a part of the junction prevents or allows the blade cover to move in relation to the blade, while another part of the junction provides the avenue or means for the blade cover to move in relation to the blade. The means of preventing or allowing movement, and restricting the direction of movement, of the blade cover in relation to the blade can be an integral part of the junction between the blade cover and the cartridge, or can be a separate component. Further, the components can be made of the same or different materials.

A cartridge as described above can further be made by fixing flexible arms to the blade holder. The flexible arms can be a separate component from the blade holder or can be an integral aspect of the blade holder. The flexible arms and blade holder can be made of the same material or of different materials. The flexible arms can be configured such that they depress while being inserted into a tool handle, and then return to an undepressed position once completely inserted into the tool handle.

The inventive subject matter provides tools including two or more tool components (e.g., powered or unpowered screwdrivers, blades, scrapers, scissors, hammers, nail removers, piercer, or any combination thereof), and at least one movable cover including a guard portion configured to move from a covered position to a working position that exposes at least one tool component that was previously covered. For example, it is contemplated that a movable cover is configured to rotate relative to a holder to alternatively expose a first tool component and a second tool component. In some embodiments, the movable cover could be spring loaded, and a locking mechanism (e.g., detent) could be provided to restrict movement of the movable cover.

It should be appreciated that movable covers of the inventive subject matter reduce the number of injuries to users by shielding against sharp tool components (e.g., cutting edges of blades, scrapers, screwdrivers). For example, where a movable cover is provided as part of a removable cartridge, a user need not touch the sharp tool components to replace the cartridge. Instead, the user could simply use the movable cover (covering some or all tool components) to remove and replace the cartridge from the handle. In the rare instance that a cartridge of the inventive subject matter detaches from the handle inadvertently (e.g., where a user grabs or operates the tool incorrectly), the cartridge as a whole could easily be seen and removed to prevent user injury, whereas a replaceable blade or other sharp object could easily be lost and only found after it causes an injury.

Figure 18A:
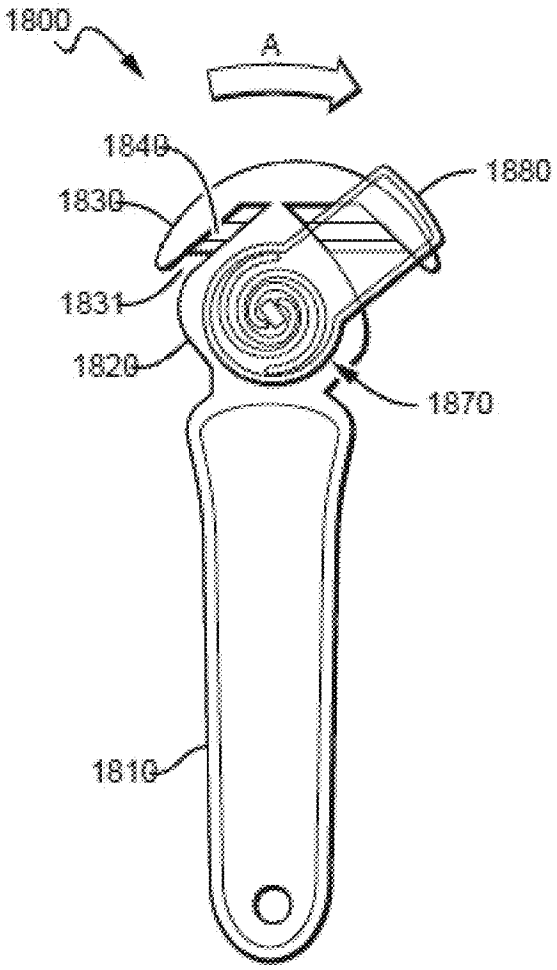
FIGS. 18A-18C show front views an embodiment of a tool having a movable cover.
Figure 18B:
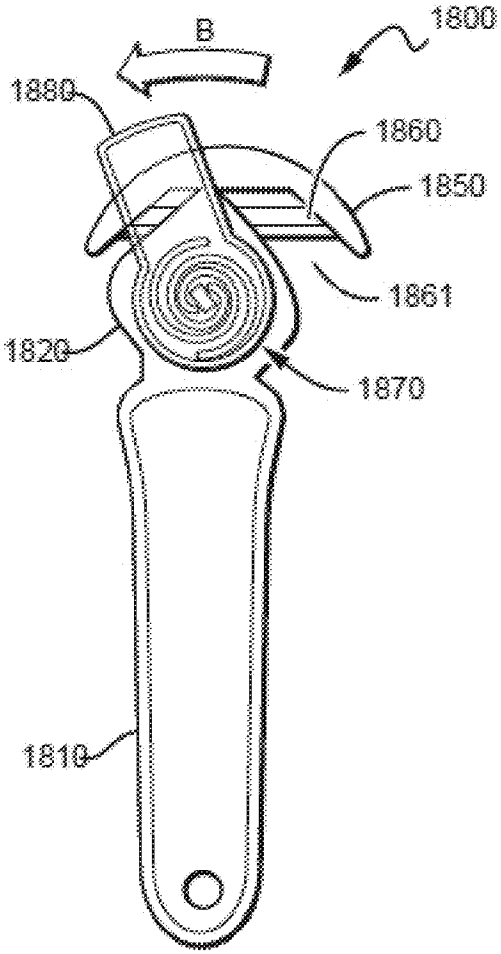
Figure 18C:
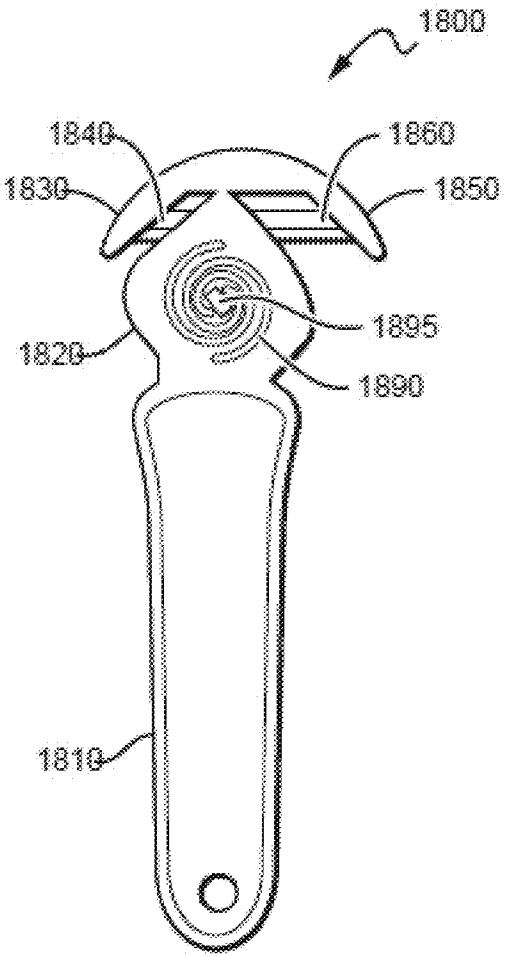

FIGS. 18A-18C illustrate a single unitary designed tool 1800 in which some or all of the tool head components are an integral part of the handle. More specifically, tool 1800 includes a handle portion 1810 that is integral with (not removable from without damage) several tool head components. The tool head components include tool holder portion 1820, a first tool component 1840, a first overhanging shield 1830, a second tool component 1860, a second overhanging shield 1850, a biasing member 1890, and a movable cover 1870 having a guard portion 1880. Movable cover 1870 could be rotatable or otherwise movable such that it moves between positions (e.g., a position covering first tool component 1840, a position covering a second tool component 1860, a position not covering any tool component).

Tool 1800's tool components (1840, 1860) are first and second cutting edges that form hook knives in combination with overhanging shields 1830 and 1850. The first hook knife (1830, 1840) has a first channel 1831 suitable for thinner objects (e.g., paper, shrink wrap, string, tape, fabric), while the second hook knife (1840, 1860) has a second channel 1861 suitable for wider objects (e.g., rope, cardboard, bubble wrap). Tool holder portion 1820 can be a blade holder mounting a single blade having the first and second cutting edges, or alternatively, mounting a first blade having the first cutting edge and a second blade having a second cutting edge.

Knives or tools having hook-type cutters can advantageously protect users from inadvertent cuts, as the blade's edge is recessed. Tool holder portion 1820 (or blade holder) is sized and dimensioned to cover ends of each of the first and second cutting edges. As shown in FIGS. 18A-18C, overhand shields 1830 and 1850 of tool holder portion 1820 cover the outer ends of the first and second cutting edges and a center portion of tool holder portion 1820 covers the inner ends of the first and second cutting edges.

First channel 1831 and second channel 1861 are formed by covering both ends of each end of the first and second cutting edges. In this manner, tool holder portion 1820 acts as a barrier or blocks the first and second cutting edges from objects that are larger than first channel 1831 or second channel 1861. As described above, first channel 1831 is typically narrower than second channel 1861. It is contemplated that first channel 1831 and second channel 1861 can be any suitable width, including between 1-20 mm, between 1-15 mm, between 1-10 mm, or between 5-15 mm, between 5-10 mm, or between 10-15 mm. In another example, first channel 1831 and second channel 1861 can be less than 20 mm, less than 15 mm, less than 10 mm, or less than 5 mm.

Such hook-type cutters have been found to be especially useful in cutting shrink wrap, bubble wrap, straps, bands, cardboard, and other items that are thin and can readily fit within at least one of first channel 1831 and second channel 1861. It is contemplated that a hook type cutter could be used to cut larger or thicker items, depending on the width of first channel 1831 and second channel 1861 leading to the first and second cutting edges. Additionally, it is contemplated that the end of at least one of overhand shields 1830 and 1850 could include a piercer such that an object can be pierced and cut open with a single swipe or other movement.

It may seem counterintuitive to at least some skilled in the art to include a movable cover over a tool component specifically designed to avoid injuries. However, Applicant surprisingly discovered that even hook knives, especially hook knives having wider angled channels, could pose a significant risk of injury. It was discovered that including a movable cover could help reduce or even eliminate such risks, and it does not require significant added costs.

Although the figures herein generally illustrate tools and tool cartridges including two hook knife or recessed cutting edges, it should be appreciated that contemplated tools and tool cartridges could include any suitable tool components of any suitable sizes (e.g., screwdrivers, blades, scrapers, nail removers, piercer, or any combination thereof).

In the embodiment shown, tool holder portion 1820 is a blade holder that mounts first and second tool components 1840 and 1860. First and second tool components 1840 and 1860 can be first and second cutting edges, respectively. Tool holder portion 1820 can further include a biasing member 1890 that biases movable cover 1870 to a default position. Biasing member 1890 can be a spiral spring, which is a flexible material (e.g., a flexible plastic or metal) having the shape of a spiral that temporarily deforms when a load is applied (e.g., user presses tool against working surface to rotate movable cover and expose first or second cutting edge), and returns to its original shape when the load is removed (e.g., user lifts tool from working surface to cover first or second cutting edge). As shown, biasing member 1890 includes a series of spiraled apertures or grooves. Movable cover 1870 could include one or more pins or protrusions that are inserted into a cavity or recess 1895 of biasing member 1890 to thereby transfer rotational force from movable cover 1870 to biasing member 1890.

To operate tool 1800 and make a cut using second tool component 1860, a user could press tool 1800 against a work surface to temporarily move movable cover 1870, such that guard portion 1880 rotates in direction B and exposes second tool component 1860 via second channel 1861. It is contemplated that the spiraled apertures of grooves of biasing member 1890 are temporarily deformed while movable cover 1870 is moved from its default position (covering second tool component 1860 as shown in FIG. 18A). Upon completing the cut or lifting tool 1800 from the work surface, movable cover 1870 could automatically move in direction A, such that guard portion 1880 covers second tool component 1860 for storage or until further use. Thus, movable cover 1870 is configured to rotate relative to tool holder portion 1820 to alternatively expose first tool component 1840 (in FIG. 18A) and second tool component 1860 (in FIG. 18B).

It should be appreciated that guard portion 1880 of movable cover 1870 is configured to move relative to the tool holder portion 1820 and to simultaneously (i) act as a physical barrier and restrict access to first tool component 1840 via first channel 1841 and (ii) allow access to second tool component 1860 via second channel 1861 for cutting (FIG. 18B), or vice versa (FIG. 18A). Although movable cover 1870 is biased to cover second tool component 1860 in the example above, it is contemplated that movable cover 1870 can be biased to cover first tool component 1840. In such embodiment, a user can press tool 1800 against a work surface to temporarily move movable cover 1870 in direction A to expose first tool component 1840, and movable cover 1870 would move in direction B upon completing the cut or lifting tool 1800 from the work surface. Regardless of the biasing direction, biasing member 1890 can be any type of spring that provides a directional bias to a default position, and requires a force (e.g., from a cutting surface or a user) to move movable cover 1870 away from the default position. The spring force could be exerted by any material with elastic properties, could be integrally built into the tool as a unitary design, or could be a separate component that is assembled into the tool.

It is contemplated that the movable cover 1870 could be manually retracted (pushed away from a tool component) and contracted (pushed over the tool component) without any biasing direction. Additionally or alternatively, movable cover 1870 could manually retract but automatically be contracted by a spring, elastic or other force. Additionally or alternatively, movable cover 1870 could manually contract but automatically be retracted by a spring, elastic or other force. It is also contemplated that a detent can be used to restrict movement of movable cover 1870. For example, a detent can be used to (i) prevent movement of movable cover 1870 when tool 1800 is not used, and (ii) allow movement of movable cover 1870 when tool 1800 is pressed against a work surface (i.e., allow movement only when a pre-determined force is applied to the movable cover).

In some embodiments, handle portion 1810 and tool holder portion 1820 are made from a single piece (e.g., an injection molded piece of plastic). In some embodiments, the handle portion 1810, the tool holder portion 1820, and the first and second overhanging shields 1830 and 1850 are made from a single piece. The biasing member 1890 could be coupled with, affixed to, or form a part of tool holder portion 1820, although it is also contemplated that biasing member 1890 could be positioned on any portion of tool 1800 that allows it to cover at least a portion of at least one of the tool components. It should be appreciated a single unitary designed tool (as shown in FIG. 18A) can have a second tool holder portion that mounts third and/or fourth tool components. The second tool holder portion can be disposed on the same end of a handle or on opposite ends of the handle. Additionally, or alternatively, the first and second tool holder portions can have the same or different combinations of tool components.

Figure 12A:
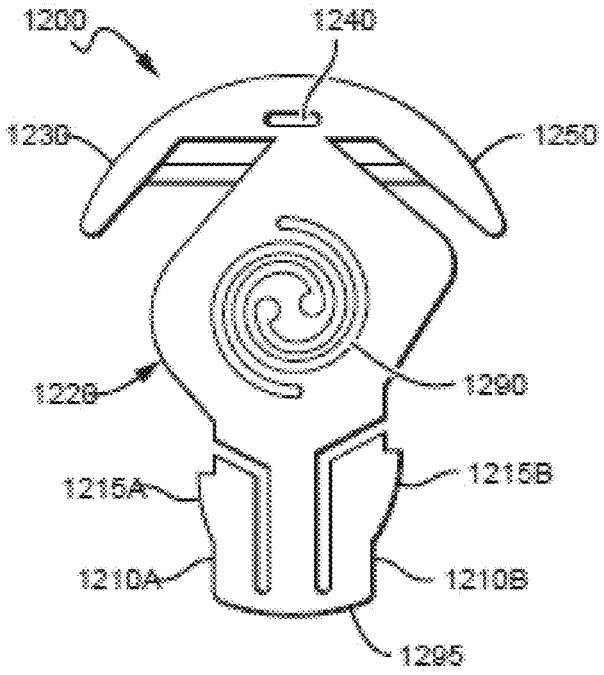
FIGS. 12A-12B show front views of an embodiment of a cartridge with and without a movable cover.

In FIG. 12A, a multi-tool removable cartridge 1200 is shown without a movable cover. Tool cartridge 1200 includes a tool holder portion 1220, which is sized and dimensioned to hold one or more tool components (e.g., blade(s) with cutting edges) in place. Tool holder portion 1220 includes a shield having overhanging shields 1230 and 1250, and an aperture 1240 which allows dust and other debris trapped in tool cartridge 1200 to escape. Tool holder portion 1220 also includes a biasing member 1290, which can be any type of spring that provides a directional bias to a default position, and requires a force (e.g., from a cutting surface or a user) to move a movable cover away from the default position as described above.

Tool holder portion 1220 can also include a stem 1295 having a first flexible spring arm 1210A and a second flexible spring arm 1210B. First flexible spring arm 1210A includes a first locking member 1215A, and second flexible spring arm 1210B includes a second locking member 1215B. First locking member 1215A and second locking member 1215B extend outwardly, and are sized and dimensioned to be received and locked in place by a slot of a handle. As shown in FIG. 12A, first flexible spring arm 1210A and second flexible spring arm 1210B have different lengths, with second flexible spring arm 1210B being between 5-20% longer than first flexible spring arm 1210A. However, it should be appreciated that each of the first and second arms could have any suitable lengths, including the same length.

Figure 12B:
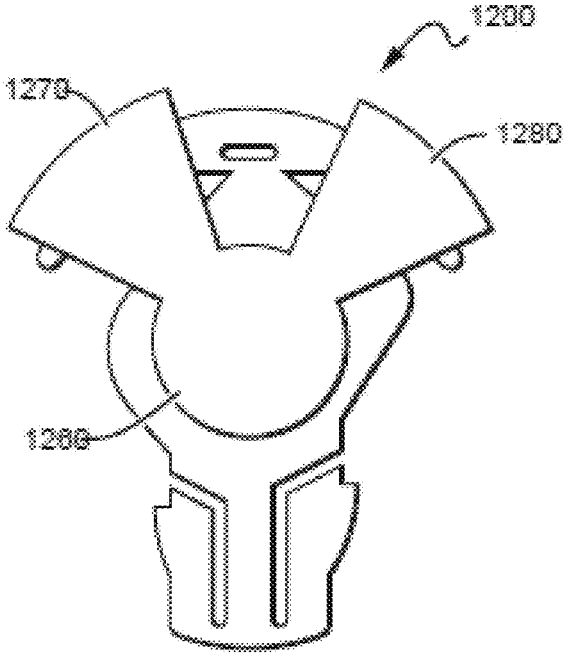

In FIG. 12B, movable cover 1260 is coupled with tool holder portion 1220, and includes a first guard portion 1270 that is configured to be positioned over a first tool component, and a second guard portion 1280 that is configured to be positioned over a second tool component. Movable cover 1260 is biased towards a default position wherein each of cover portions 1270 and 1280 are positioned over a tool component (see FIGS. 14D and 14G). A user or a working surface could cause movable cover 1260 to move from the default position in a direction that exposes the first tool component or the second tool component. In other embodiments, movable cover 1260 can be coupled to tool holder portion 1220 without any directional bias.

Figure 13:
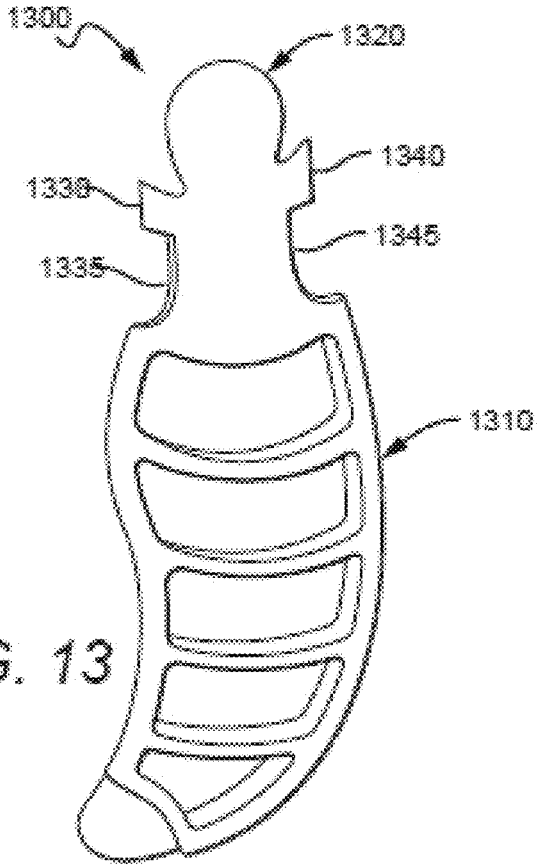
FIG. 13 shows a front view of an embodiment of a handle configured to releasably couple with the tool cartridge shown in FIGS. 12A-12B.

FIG. 13 illustrates a tool handle 1300, which tool cartridge 1200 or any other suitable tool cartridge described herein could releasably couple with. Tool handle 1300 includes a gripping portion 1310 and a tool cartridge receiving portion 1320. Tool cartridge receiving portion 1320 comprises a cavity sized and dimensioned to receive at least a portion of stem 1295, and includes slots 1335 and 1345, which are sized and dimensioned to receive first locking member 1215A and second locking member 1215B of first and second spring arms 1210A and 1210B. It is contemplated that first and second locking members 1215A and 1215B extend through slots 1335 and 1345 at positions below protrusions 1330 and 1340.

Figure 14C:
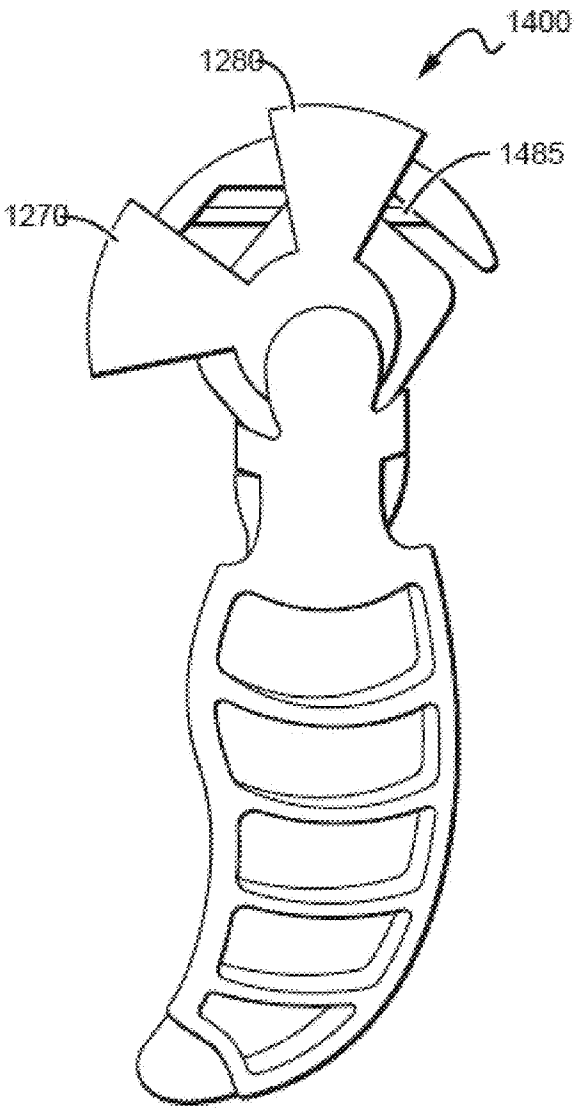
FIGS. 14B-14G show front perspective views of the movable cover exposing first and second cutting edges of the tool of FIG. 14A.
Figure 14B:
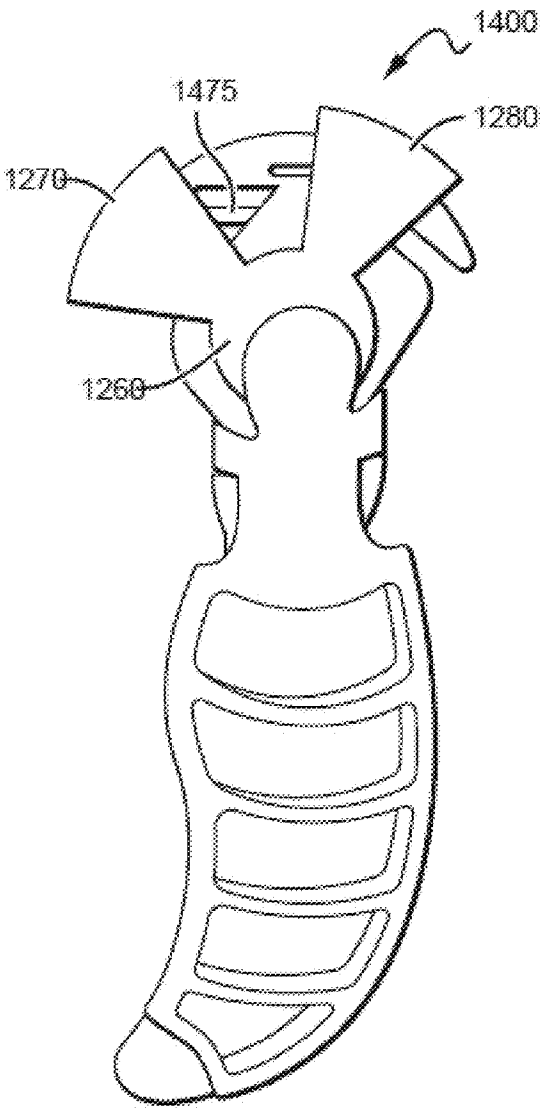
Figure 14A:
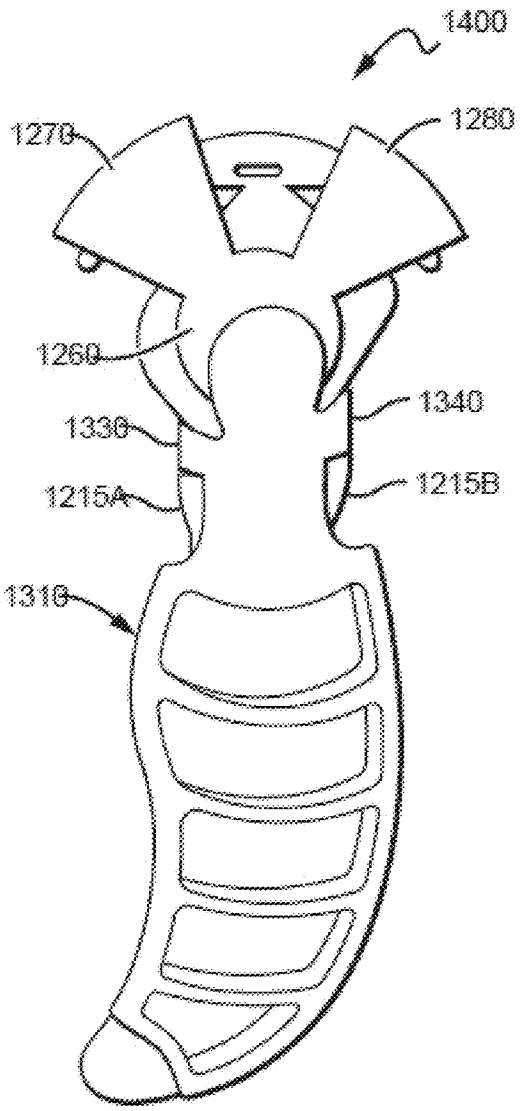
FIG. 14A shows a front view of an embodiment of a tool having the cartridge of FIGS. 12A-12B coupled with the handle of FIG. 13.

FIG. 14A illustrates a multi-tool 1400, which is a combination of tool cartridge 1200 and tool handle 1300. As illustrated, tool cartridge 1200 is coupled with tool handle 1300 via tool receiving portion 1320, slots 1335 and 1345, and locking members 1215A and 1215B of spring arms 1210A and 1210B. Movable cover 1260 of tool cartridge 1200 is partially seated within tool receiving portion 1320 of tool handle 1300. Preferably, movable cover 1260 and tool receiving portion 1320 are coupled to one another in a manner that allows guide portions 1270 and 1280 to move relative to the tool components (e.g., blades, screwdrivers, scrapers).

Tool handle 1300 includes a first slot 1335 sized and dimensioned to receive first locking member 1215A of spring arm 1210A, and a second slot 1340 sized and dimensioned to receive second locking member 1215B of spring arm 1210B. When stem 1295 of tool cartridge 1200 is inserted into tool receiving portion 1320 of tool handle 1300, flexible arms 1210A and 1210B of tool cartridge 1200 can flex towards each other (away from their resting positions) and snap into their resting position when locking members 1215A and 1215B extend through slots 1335 and 1345, respectively. From another perspective, flexible arms 1210A and 1210B of cartridge 1200 could be configured such that, in a relaxed position, locking members 1215A and 1215B rest snugly and securely within slots 1335 and 1345 between gripping portion 1310 and protrusions 1330 and 1340.

To remove tool cartridge 1200 from tool handle 1300, a user can squeeze locking members 1215A and 1215B and pull on tool cartridge 1200. Additionally or alternatively, slots 1335 and 1345 that receive locking members 1215A and 1215B could be disposed on a top portion of tool handle 1300 (above gripping portion 1310), such that unintentional release of tool cartridge 1200 from tool handle 1300 during use can be avoided by a user holding gripping portion 1310.

Figure 14F:
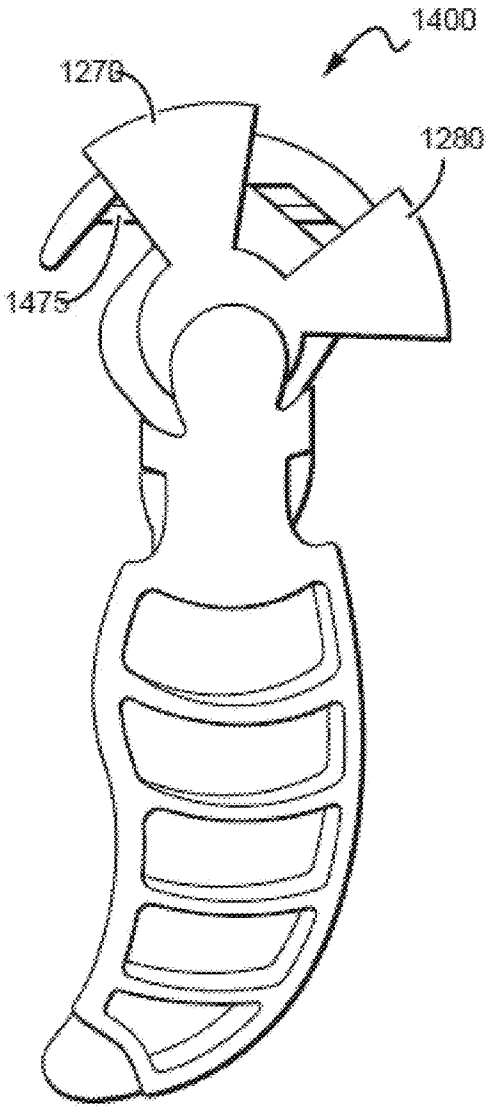
Figure 14E:
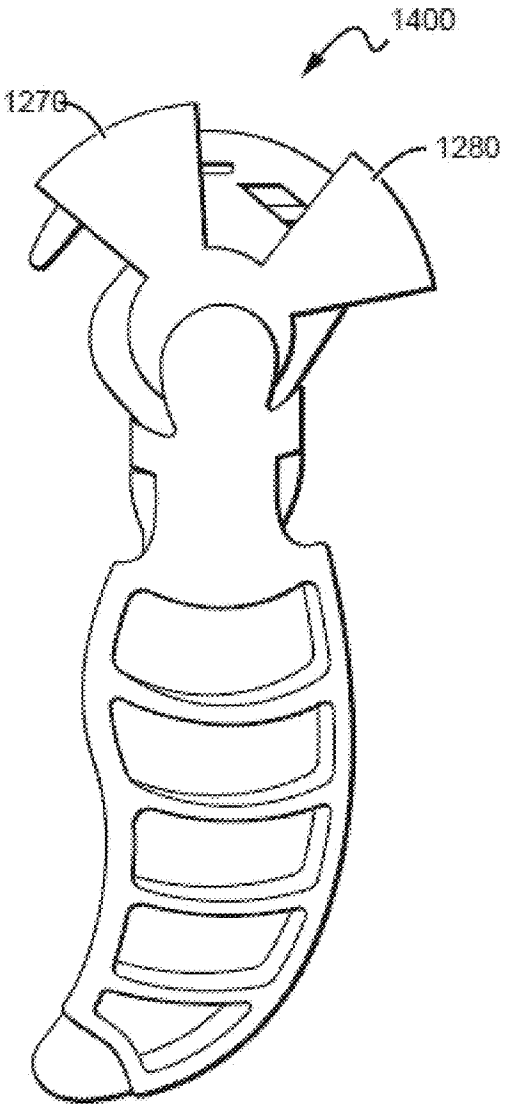
Figure 14D:
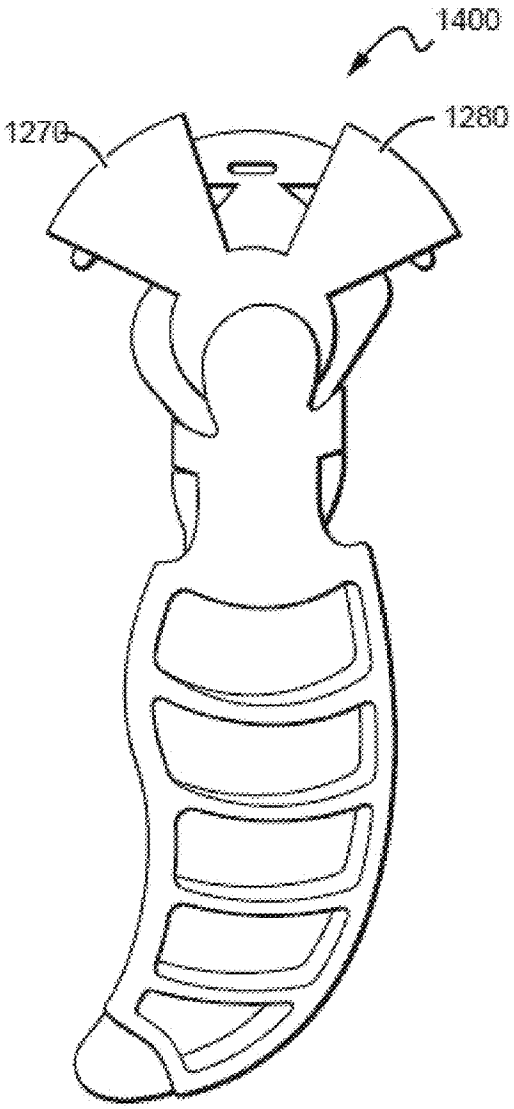

FIGS. 14B-14G illustrate a multi-tool 1400 as movable guard 1260 is bi-directionally moved relative to one or more tool components. In FIGS. 14B-14C, movable guard 1260 is moved such that second guard portion 1280 rotates from a default position (see FIG. 14A) to expose second tool component 1485 (e.g., a second cutting edge). First guard portion 1270 also rotates such that a portion of first tool component 1475 (e.g., a first cutting edge) is exposed. However, first guard portion 1270 continues to act as a barrier to the channel that leads to first tool component 1475 to thereby prevent a user from being injured by first tool component 1475. Preferably, the rotational range of movable cover 1260 is limited such that first guard portion 1270 does not rotate beyond a first edge 1460 (see FIG. 14G) of the tool cartridge 1200 when second tool component 1485 is exposed. Once the user releases movable cover 1260, first and second guard portions 1270 and 1280 automatically return to cover first and second tool components 1475 and 1485 simultaneously, as shown in FIG. 14D.

Figure 14G:
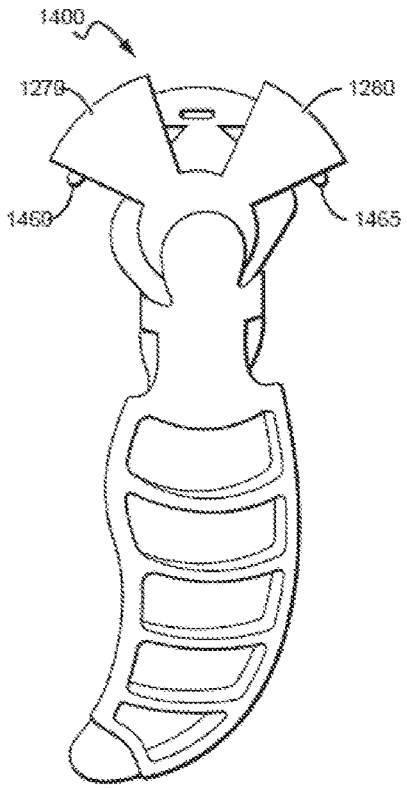

In FIGS. 14E-14F, movable guard 1260 is moved such that first guard portion 1270 rotates from a default position (see FIG. 14A) to expose first tool component 1475 (e.g., a first cutting edge). Second guard portion 1280 also rotates such that a portion of second tool component 1485 is exposed. However, second guard portion 1280 continues to act as a barrier to the channel that leads to second tool component 1485 to thereby prevent a user from being injured by second tool component 1485. Preferably, the rotational range of movable cover 1260 is limited such that second guard portion 1280 does not rotate beyond a second edge 1465 (see FIG. 14G) of the tool cartridge 1200 when first tool component 1475 is exposed. Once the user releases movable cover 1260, first and second guard portions 1270 and 1280 automatically return to cover first and second tool components 1475 and 1485 simultaneously, as shown in FIG. 14G.

Figure 15:
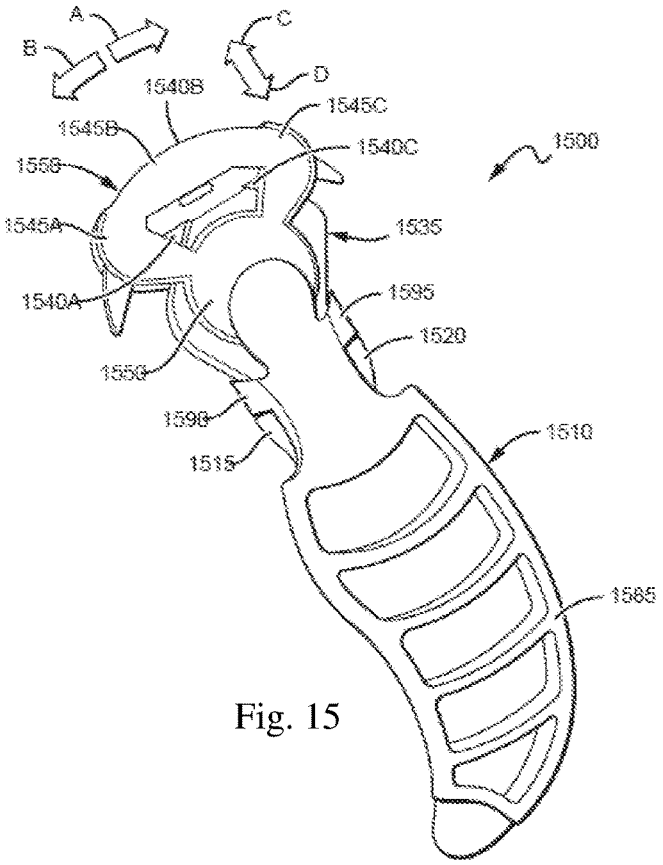
FIG. 15 shows a front perspective view of an embodiment of a tool having a movable cover and three tool components.

FIG. 15 illustrates another embodiment of a multi-tool 1500 including three tool components and cover portions. Tool cartridge 1535 comprises locking members 1515 and 1520 coupled with tool handle 1510 via slots as described in the above embodiments. Tool cartridge 1535's locking members 1515 and 1520 are disposed between a gripping portion 1585 and protrusions 1590 and 1595 of tool handle 1510. Tool cartridge 1535 includes three tool components, and a movable cover 550 that is configured to move in four different directions (A, B, C, and D directions).

Movable cover 1550 could be moved in Direction A from a default position (as shown in FIG. 15) in order to move first guard portion 1545A and expose a first tool component 1540A. Additionally, movable cover 1550 could be moved in Direction B from default position (as shown in FIG. 15) in order to move second guard portion 1545C and expose a second tool component 1540C. Movable cover 1550 can be coupled to a biasing member or a spring that allows movable cover 1550 to rotate in Directions A and B.

Movable cover 1550 could also be moved in Direction D from a default position (as shown in FIG. 15) to move third guard portion 1545B and expose a third tool component 1540B (e.g., a scraper). It is contemplated that movable cover 1550 could be moved in Direction C manually or automatically (via a spring force) once tool 1500 is lifted from working surface or a user force applied to movable cover 1550 is removed to thereby cover third tool component 1540B using third guard portion 1545B.

Figure 16:
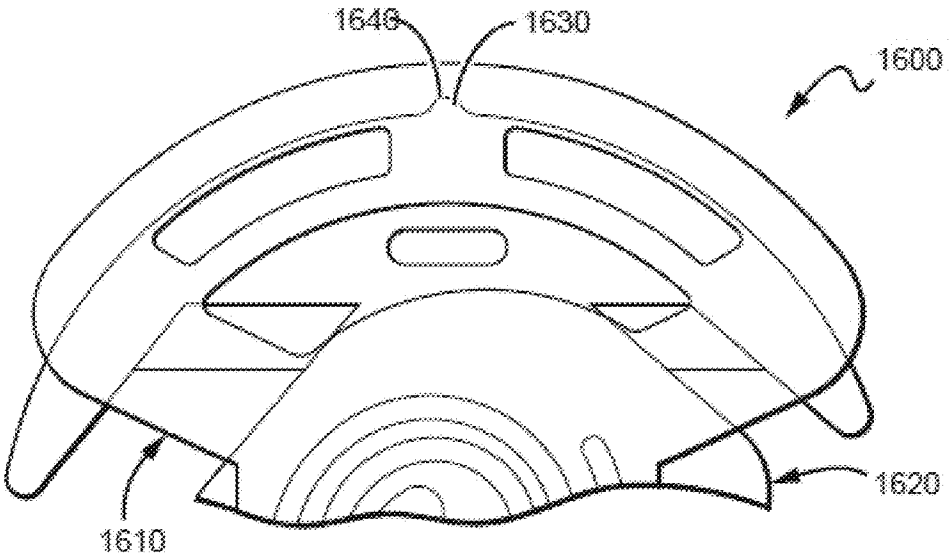
FIG. 16 shows an enlarged front view of an embodiment of a tool having a detent to restrict movement of the movable cover.

FIG. 16 shows an enlarged view of a tool 1600 having a movable cover 1610 and a tool holder portion 1620. Movable cover 1610 and tool holder portion 1620 can include any of the elements (guard portions, tool components, biasing member, stem, locking members, etc.) described in the above embodiments. Furthermore, it is contemplated that tool 1600 can further comprise a detent to restrict movement of movable cover 1610 with respect to tool holder portion 1620. For example, tool holder portion 1620 can comprise a protrusion 1630 that extends from a top end of tool holder portion 1620, and movable cover 1610 can comprise a recess 1640 sized and dimensioned to receive protrusion 1630 to restrict movement. In such example, movable cover 1610 would be prevented from rotating when tool 1600 is not being used. However, it is contemplated that a pre-determined force applied to movable cover 1610 (e.g., pressing the tool onto a working surface or manually rotating the movable cover) can remove protrusion 1630 from recess 1640 to expose a tool component (e.g., a cutting edge, scraper, etc.).

Once the pre-determined force is removed, movable cover 1610 can automatically rotate (via a spring force) to a default position where protrusion 1630 rotates into recess 1640 or an additional manual force may be applied to rotate protrusion 1630 into recess 1640. In other embodiments, a protrusion is disposed on movable cover 1610 and a recess is disposed on tool holder portion 1610. It is contemplated that such detent systems can be applied to tools described in the various other embodiments (e.g., tools 1100, 1400, 1500).

Viewed from another perspective, it is contemplated that the movable cover is adjustable between (a) a locked configuration in which the movable cover is restrained from uncovering both a first cutting edge and a second cutting edge, and (b) an unlocked configuration in which the movable cover can uncover at least one of the first and second cutting edges. The transition between the locked and unlocked configuration can be accomplished by use of a pre-determined amount of force (e.g., pushing tool against a work surface or manually rotating the movable cover). Alternatively, the transition between locked and unlocked can require manual override (e.g., a button/trigger/actuator that triggers a locking/unlocking mechanism). When the movable cover is moved back to cover the tool components, the locking mechanism could reset to lock the movable cover in place until the user manually causes the lock to release again.

For example, a user could press a tool against a work surface (e.g., a surface to be cut) or manually rotate the movable cover to expose a tool component (e.g., a cutting edge) whereby the force applied by the surface or manual rotation transitions the movable cover from a locked to an unlocked configuration. Once the desired action (e.g., a cut through the work surface, screwing a screw through work surface, etc.) is completed, the movable cover could automatically (i) move to cover the tool component, and (ii) transition from the unlocked configuration to the locked configuration once the tool component is covered. It is contemplated that the steps of covering the tool component and/or transitioning from the unlocked configuration to the locked configuration can be manual (i.e., require user input). In other embodiments, the tool can be designed to require a user to manually unlock (via button, lever, handle, compression on an area of tool, etc.) movable cover in order to move movable cover and expose the first tool component. In such embodiment, movable cover would not move regardless if pressed against a work surface unless it was manually unlocked by the user.

It should also be appreciated that the tool can be designed to lock movable cover in a position that exposes a first tool component (e.g., cutting edge), such that a user is required to manually unlock movable cover so that movable cover rotates to cover the first tool component. For example, a user can press the tool against a work surface (e.g., a surface to be cut) or manually rotate the movable cover to expose a tool component (e.g., a cutting edge) whereby the force applied by the surface or manual rotation moves the movable cover to (i) expose the first tool component, and (ii) transition the movable cover into a locked configuration. Once the desired action (e.g., a cut through the work surface, screwing a screw through work surface, etc.) is completed, a user can manually unlock (via button, lever, handle, compression on an area of tool, etc.) movable cover in order to (i) automatically or manually move movable cover to cover the first tool component, and (ii) transition movable cover from the locked configuration to the unlocked configuration.

Figure 17:
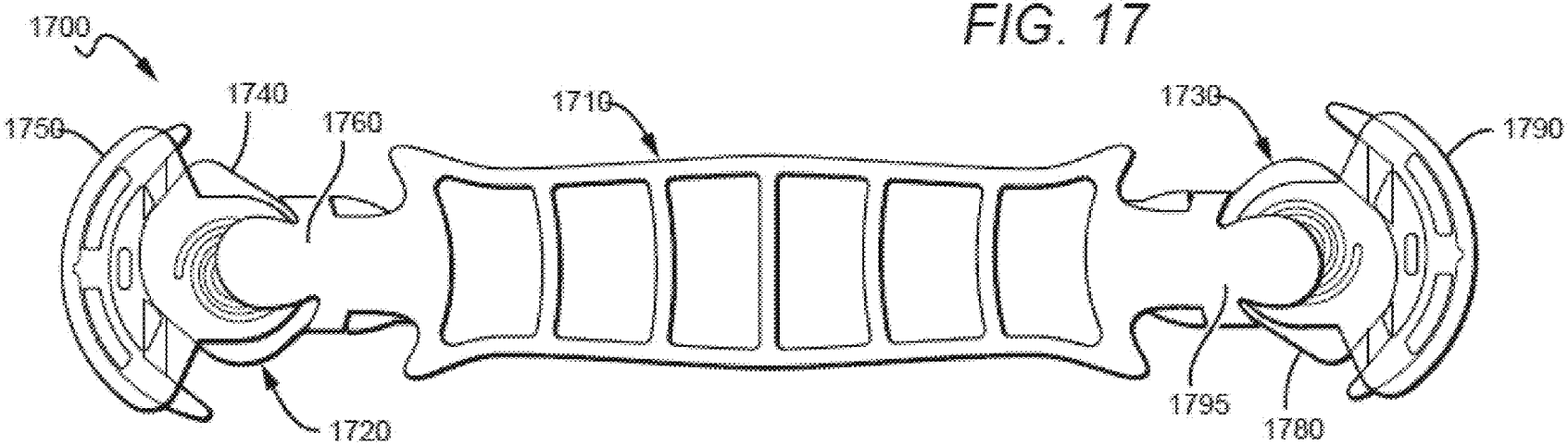
FIG. 17 shows a front view of an embodiment of a tool having first and second cartridges.

Although many of the embodiments describe a tool handle that receives one cartridge, it is contemplated that a tool handle can receive more than one cartridge. For example, FIG. 17 shows a tool 1700 having a tool handle 1710 that receives a first cartridge 1720 and a second cartridge 1730. First cartridge 1720 includes a tool holder portion 1740 and a movable cover 1750. It is contemplated that first cartridge 1720 can have the same configuration as the cartridges described above (e.g., cartridges 1200 and 1535). First cartridge 1720 includes a biasing member that biases movable cover 1750 to cover a first and second tool component (e.g., first and second cutting edges). However, a user or a working surface can temporarily rotate movable cover 1750 to alternatively expose the first tool component and the second tool component.

As shown in FIG. 17, first cartridge 1720 can be inserted into tool handle 1710 through a first receiving portion 1760 using the same method described above (see, e.g., tool cartridge 1200 inserted/removed from tool handle 1300). First receiving portion 1760 is disposed on a first end of tool handle 1710. A second cartridge 1730 can be inserted in a second receiving portion 1795 on a second end of tool handle 1710. Second cartridge 1730 includes a tool holder portion 1780 and a movable cover 1790. It is contemplated that second cartridge 1730 can have the same configuration as the cartridges described above (e.g., cartridges 1200 and 1535). Second cartridge 1730 can be inserted into tool handle 1710 through second receiving portion 1795 using the same method described above (see, e.g., tool cartridge 1200 inserted/removed from tool handle 1300).

First cartridge 1720 could be the same as second cartridge 1730 as shown in FIG. 17. In other words, first cartridge 1720 and second cartridge 1730 can have the same elements (e.g., tool holder portion, movable cover, biasing member, first and second tool components, etc.) in the same configuration. However, in other embodiments, first cartridge 1720 could be different from second cartridge 1730. For example, first cartridge 1720 and second cartridge 1730 could have at least one of different tool components, different types of movable covers (e.g., a rotatable vs. slidable), different number of tool components (e.g., two components vs. three components), different types of tool components (e.g., blades vs. scraper) and different elements (e.g., with movable cover vs. without movable cover).

As shown in FIG. 17, tool handle 1710 can receive two cartridges on opposite ends of the handle. It is contemplated that a handle can include additional receiving portions to receive more cartridges along the body of the handle. In other embodiments, a tool can have two receiving portions on the same end of a handle (e.g., adjacent to one another) that each receives a cartridge. In another embodiment, a tool can have a first receiving portion on first end of a handle and a second receiving portion on an area of the handle between the first end and a second end of the handle.

Although many of the embodiments described rotational movement to expose a first or second tool component, it is contemplated that a movable cover can pivot, slide, swivel, turn, bend or flex to uncover a first or second tool component. Additionally, or alternatively, it is contemplated that a movable cover can be slid or rotated to uncover both first and second tool components (e.g., first and second cutting edges). Additionally, or alternatively, it is contemplated that first and second guard portions that cover first and second tool components can move independently from one another (e.g., guard portions are disposed on different movable covers).

Methods of making tools as described are also contemplated. A cartridge having first and second cutting edges can be assembled by fixing a blade (having two cutting edges) or two blades (each having one cutting edge) to the cartridge. The blade can be made of metal, plastic, ceramic, wood, bone, keratin, enamel, carbon, stone, obsidian, glass, diamond, or any other material suitable for cutting or applying directed pressure. Further, the blade may be straight, curved, round, angled, serrated, sharpened, dulled, or otherwise configured as appropriate for the desired use. The cartridge and tool handle may be a single piece or the composite of several pieces. The cartridge and tool handle could be of the same material (e.g., injection molded plastic) or of a range of materials.

The movable cover can be an integral part of the blade holder and can be made of the same material as the blade holder. For example, the movable cover and blade holder can be made of a single piece of flexible rubber or rigid plastic. Further, the movable cover and blade holder can be made primarily of the same material as an integral piece, while the blade holder is further comprised of other components or materials. The movable cover and the blade holder can also be separate components, and can be made of different materials or the same material. The movable cover can be fixed to the blade holder by means that permit the blade cover to rotate (partially or fully), pivot, slide, swivel, turn, bend, flex or otherwise move in relation to the blade.

The movable cover and the blade holder can be attached at a junction. The junction can be further configured such that a part of the junction prevents or allows the movable cover to move in relation to the blade holder, while another part of the junction provides the avenue or means for the movable cover to move in relation to the blade holder. The means of preventing or allowing movement, and restricting the direction of movement, of the movable cover in relation to the blade holder can be an integral part of the junction between the blade movable and the blade holder, or can be a separate component. Further, the components can be made of the same or different materials.

A cartridge having a blade holder (or tool holder portion) as described above can further be made by fixing flexible spring arms to the blade holder. The flexible arms can be a separate component from the blade holder or can be an integral aspect of the blade holder. The flexible arms and blade holder can be made of the same material or of different materials. The flexible arms can be configured such that they flex inwardly from a rest position while being inserted into a tool handle, and then return to the rest position once completely inserted into the tool handle.

Figure 19A:
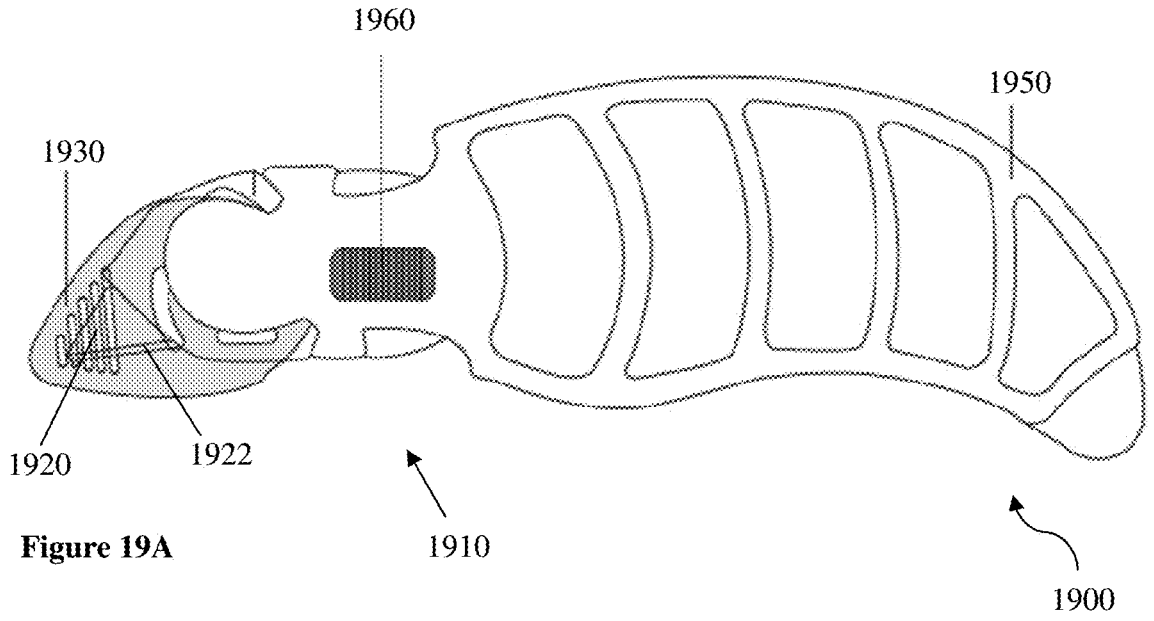
FIGS. 19A-19D show side views of an embodiment of a cartridge having an adjustable blade guard coupled to a handle having a mechanism to adjust the blade guard.
Figure 19B:
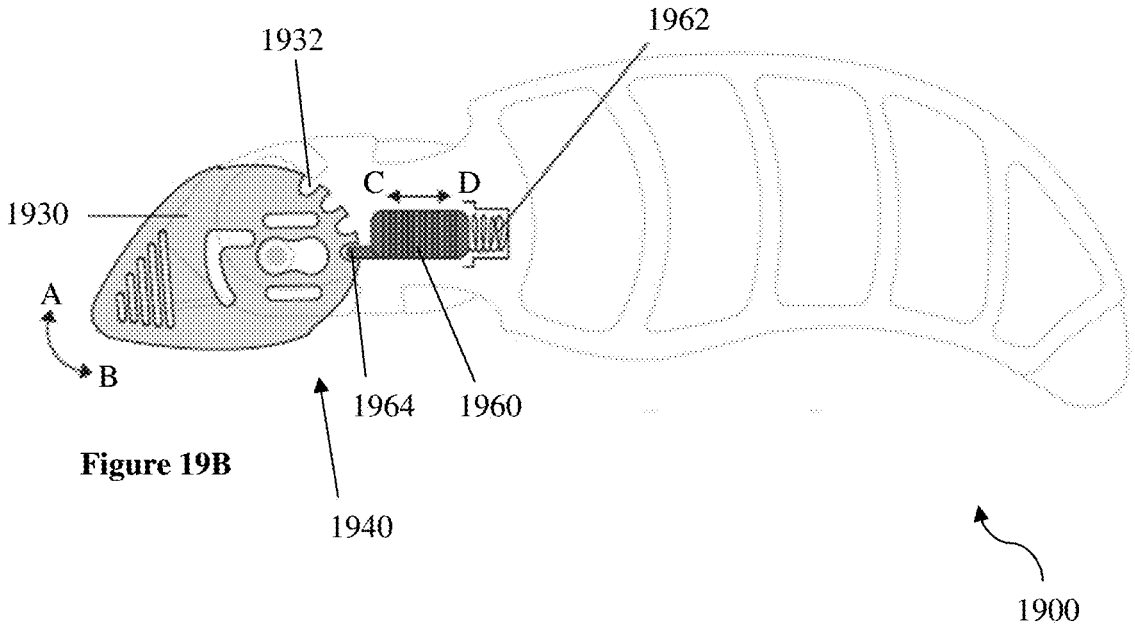
Figure 19C:
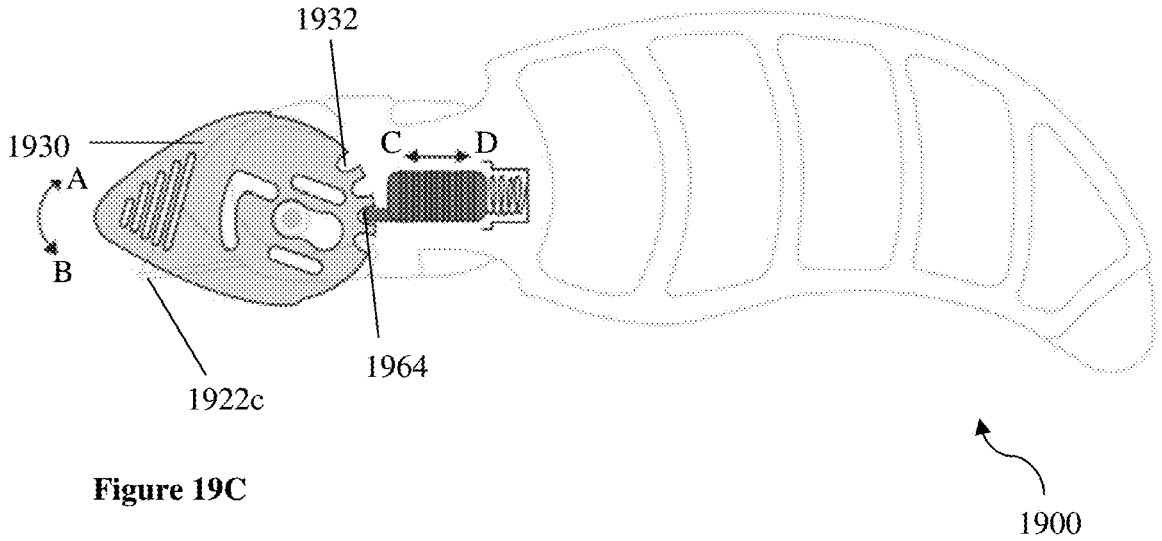
Figure 19D:
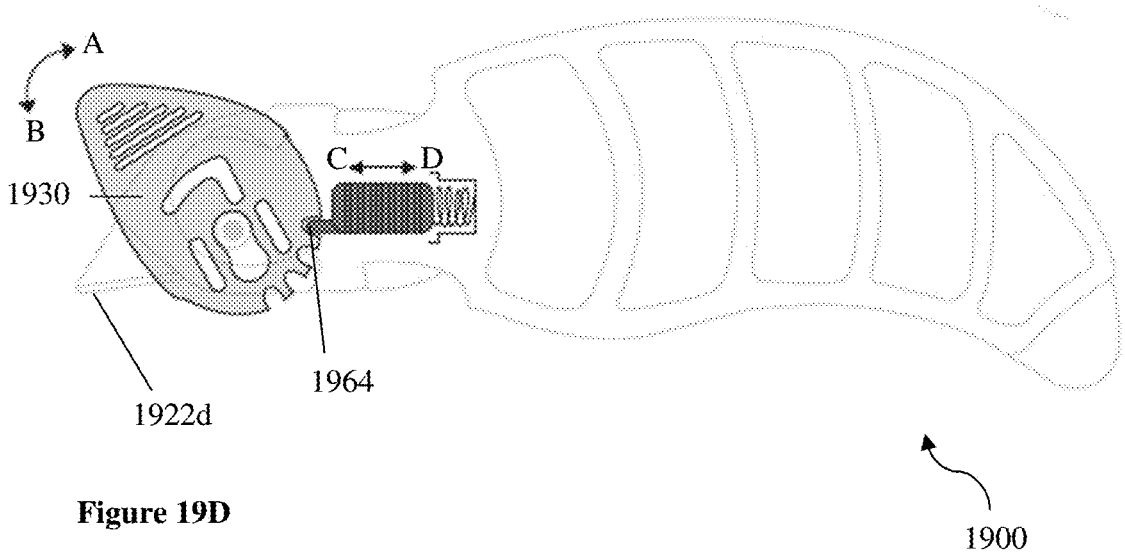

FIGS. 19A-19D depict an embodiment of a cartridge of the inventive subject matter having an adjustable blade guard coupled to a handle having a mechanism to adjust the blade guard. Tool 1900 of FIG. 19A includes cartridge 1910 and handle 1950. Cartridge 1910 includes blade 1920 with cutting edge 1922, which is covered by blade guard 1930. In the conformation of FIG. 19A, blade guard 1930 obstructs cutting edge 1922 such that no portion of cutting edge 1922 is exposed or available for cutting. Blade guard 1930 is rotatable about blade 1920 to expose portions of cutting edge 1922 for cutting, as depicted in FIGS. 19C and 19D. Handle 1950 incorporates blade guard adjuster 1960 (aka, blade guard arrestor), which interacts with portions of cartridge 1910 to enable or restrict the range of rotation of blade guard 1930, in turn enabling or restricting exposure of portions of cutting edge 1922 for cutting applications. While the present embodiment depicts blade guard adjuster as present on handle 1950 and interacting with portions of cartridge 1910 (e.g., blade guard 1930), embodiments are contemplated where a blade guard adjuster is incorporated solely in cartridge 1910, incorporated solely in handle 1950, or is an optional feature added to either the cartridge, the handle, or the assembled tool 1900 as an additional part.

FIG. 19B depicts additional features of tool 1900. Portions of tool 1900 are transparent to reveal locking mechanism 1940, which is used to lock blade guard 1930 as disclosed above with respect to FIGS. 1A-1C and 2A-2B, for example. FIG. 19B also reveals features of blade guard adjuster 1960, including spring 1962 and pin 1964, as well as range of motion of blade guard adjuster 1960 laterally in directions C and D. In this view, groves 1932 (four in this embodiment) along edges of blade guard 1930 proximal to blade guard adjuster 1960 are also apparent.

In the conformation of FIG. 19B, locking mechanism 1940 is in an unlocked conformation, permitting rotation of blade guard adjuster in directions A and B to expose portions of cutting edge 1922 (A direction) as well as cover of the cutting edge (B direction). Spring 1962 applies a force on blade guard adjuster 1960 in the C direction such that, where pin 1964 is aligned with one of groves 1932, blade guard adjuster moves in the C direction and pin 1964 engages one of groves 1932 to lock blade guard adjuster 1930 in the present conformation. In the depiction of FIG. 19B, blade guard adjuster can be viewed as a "double safety" mechanism, as blade guard 1930 is not free to rotate and expose portions of cutting edge 1922, even though locking mechanism 1940 is in the unlocked position. In general, to expose a portion of cutting edge 1922, a user must slide blade guard adjuster in the D direction, against the force of spring 1962, to disengage pin 1964 from one of groves 1932, thus permitting rotation of blade guard 1930 to expose portions of cutting edge 1922 (e.g., rotation in the A direction).

FIG. 19C depicts tool 1900 in a conformation where blade guard 1930 is locked in a position exposing a relatively small portion of blade edge 1922, depicted as portion 1922*c*. In the present conformation, a user simultaneously slid blade guard adjuster 1960 in direction D while pressing the edge of blade guard 1930 that covers blade 1920 against a work surface for cutting, causing blade guard 1930 to rotate in direction A. Blade guard adjuster 1960 was then released, allowing it to move in direction C and for pin 1964 to engage with one of groves 1932, fixing blade guard 1930 in a position exposing portion 1922*c* of cutting edge 1922.

FIG. 19D depicts tool 1900 in a conformation where blade guard 1930 is locked in a position exposing a relatively large portion of blade edge 1922, depicted as portion 1922*d*. In this conformation, a user simultaneously slid blade guard adjuster 1960 in direction D while pressing the edge of blade guard 1930 that covers blade 1920 against a work surface for cutting, causing blade guard 1930 to rotate in direction A. Blade guard adjuster 1960 was then released, allowing it to move in direction C and for pin 1964 to engage with one of groves 1932, fixing blade guard 1930 in a position exposing portion 1922*d* of cutting edge 1922.

Spring 1962 can be replaced by appropriate elements that provide a force on blade guard adjuster 1960 in direction C, and are preferably finger or thumb-operable by an adult user to slide blade guard adjuster 1960 in direction D (e.g., requiring between 15N and 3N, 10N and 3N, 5N and 3N, or 3N and 2N of force to slide), and thus free blade guard 1930 for rotation in directions A or B.

Groves 1932 can also have leading or trailing edges of each grove sloped (and preferably edges of pin 1964 compatibly sloped) to allow blade guard to rotate in either direction A or B without requiring a user to manipulate blade guard adjuster 1960. For example, when pressure is applied to blade guard 1930 in the A direction, groves 1932 and pin 1964 can meet at a relatively flat edge/interface generally perpendicular to the rotation of blade guard 1930 in direction A, thus requiring a user to slide blade guard adjuster 1960 in direction D to permit rotation. Conversely, groves 1932 and pin 1964 can meet at a sloped or curved edge/interface generally obtuse to the rotation of blade guard 1930 in direction A, such that pressure applied against blade guard 1930 in direction A is sufficient to slide blade guard adjuster 1960 in direction C, enabling blade guard 1930 to rotate in direction A and expose portions of cutting edge 1922. Likewise, the edges of groves 1932 and pin 1964 can also be fashioned to meet in generally perpendicular or obtuse edges/interfaces to the rotation of blade guard 1930 in direction B, thus preventing or permitting, respectively, the rotation of blade guard 1930 back to a position that at least partially (preferably completely) obstructs cutting edge 1922 from use for cutting applications. Such grove and pin configurations can be combined or used in single applications to provide rotation of blade guard 1930 in either direction A or B, with or without requiring the user to slide blade guard adjuster 1960 in direction D.

Figure 20A:
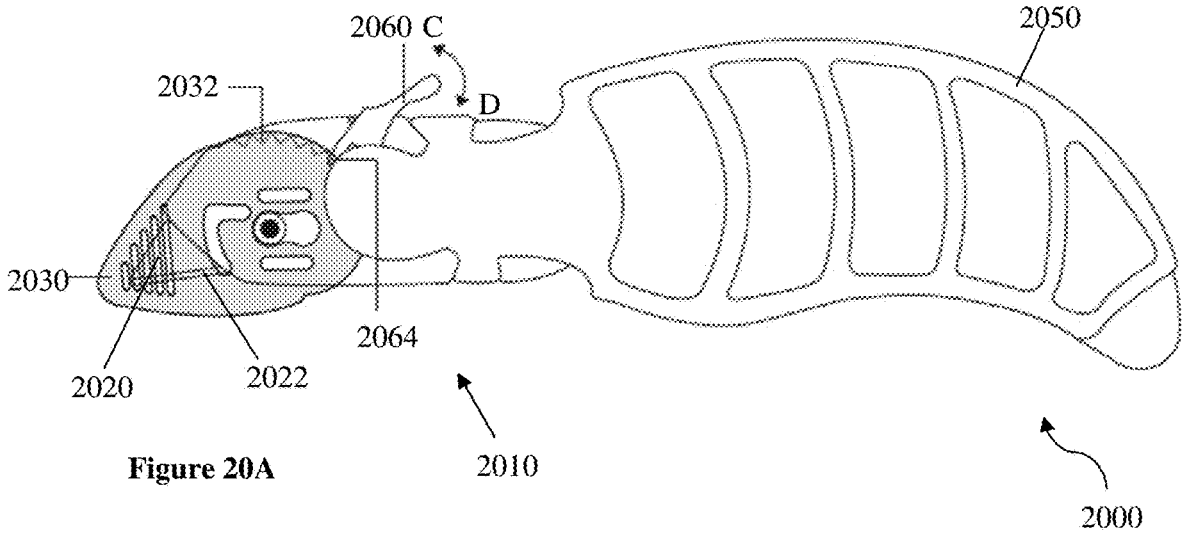
FIGS. 20A-20D show side views of an embodiment of a cartridge having an adjustable blade guard and a mechanism to adjust the blade guard, coupled to a handle.
Figure 20B:
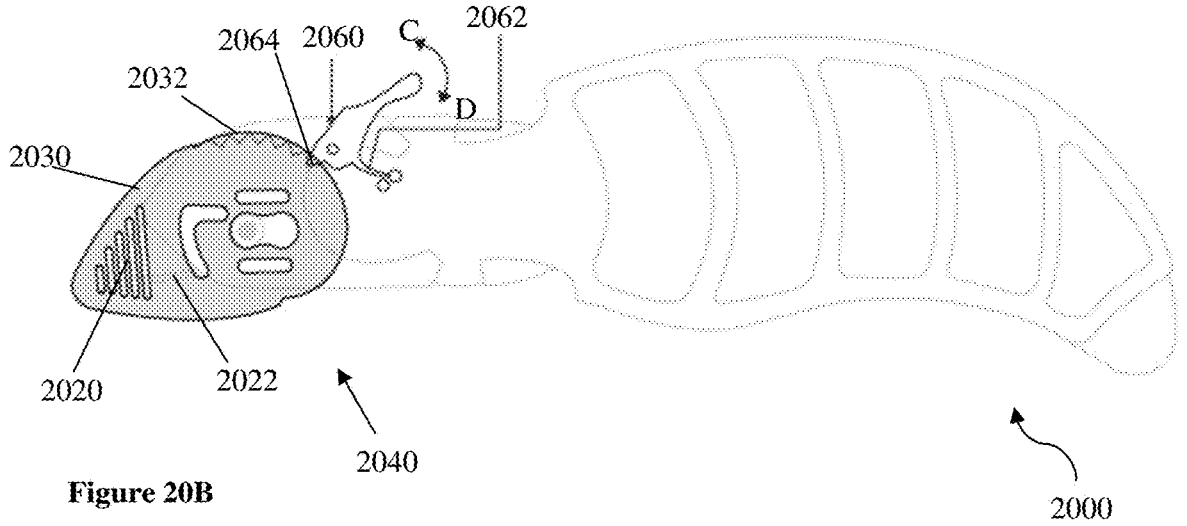
Figure 20C:
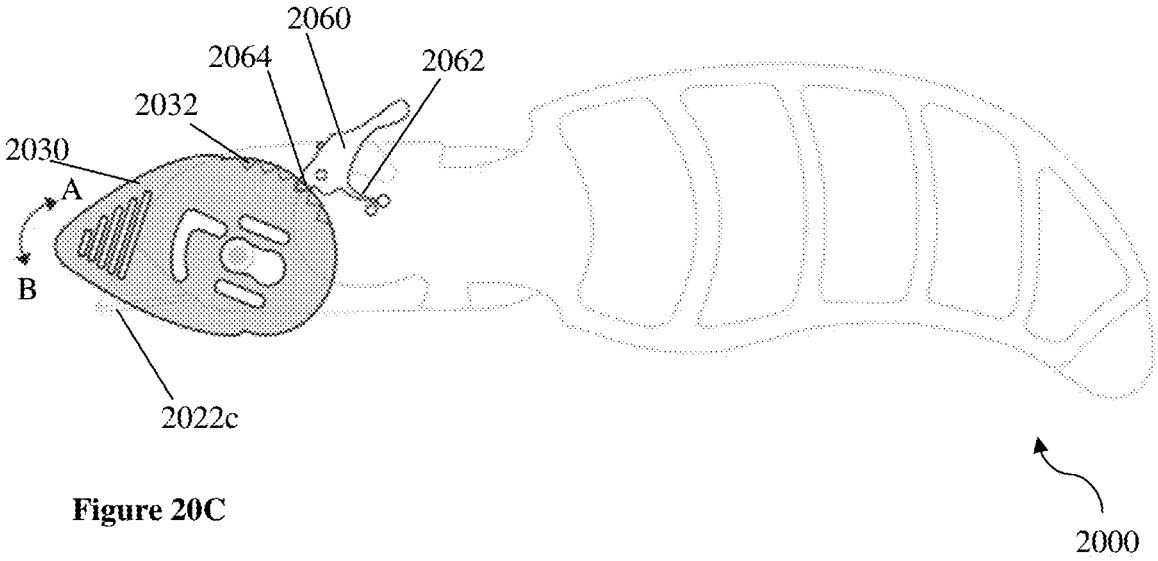
Figure 20D:
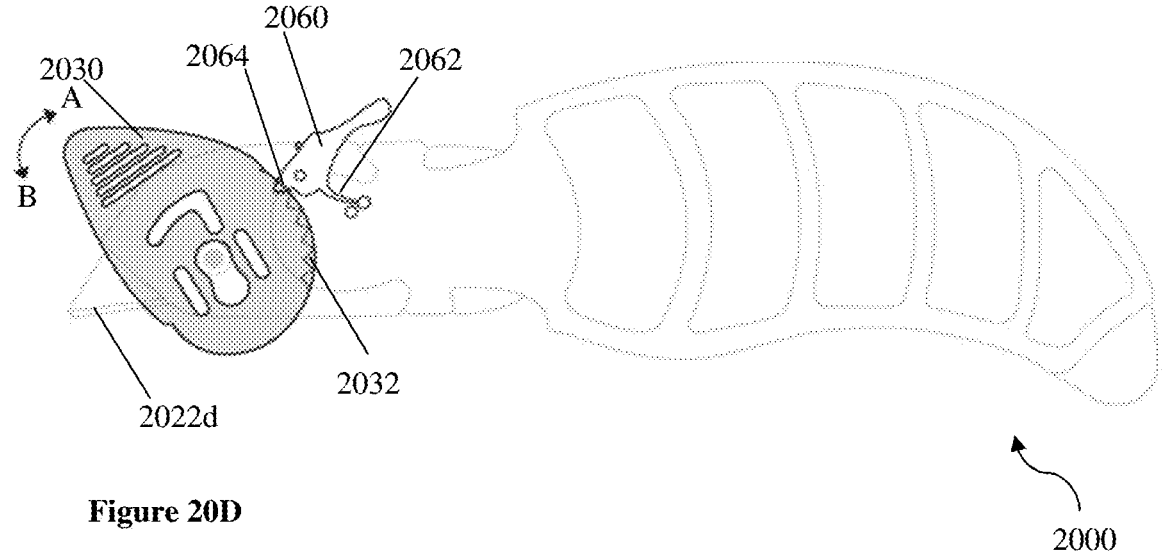

FIGS. 20A-20D depict a further embodiment of tools and cartridges of the inventive subject matter. Tool 2000 of FIG. 20A includes cartridge 2010 and handle 2050. Cartridge 2010 includes blade 2020 with cutting edge 2022, which is covered by blade guard 2030. In the conformation of FIG. 20A, blade guard 2030 obstructs cutting edge 2022 such that no portion of cutting edge 2022 is exposed or available for cutting. Blade guard 2030 is rotatable about blade 2020 to expose portions of cutting edge 2022 for cutting, as depicted in FIGS. 20C and 20D. Handle 2050 incorporates blade guard adjuster 2060 (aka, blade guard arrestor), which interacts with portions of cartridge 2010 to enable or restrict the range of rotation of blade guard 2030, in turn enabling or restricting exposure of portions of cutting edge 2022 for cutting applications.

Blade adjuster 2060 includes pawl 2064, which is movable in directions (i) C and (ii) D to (i) engage with notches 2032 on an interior edge of blade guard 2030 that is proximal to blade guard adjuster 2060, or to (ii) disengage with notches 2032, respectively. Pawl 2064 is biased toward direction C such that it engages with one of notches 2032 to prevent a rotation of blade guard 2030 that would increasingly (or potentially) expose a portion of cutting edge 2022. In embodiments where blade guard 2030 is biased toward a position that increasingly (or potentially) obstructs at least part of cutting edge 2022, pawl 2064 in its biased position toward direction C allows blade guard 2030 to move towards its biased position. While the present embodiment depicts blade guard adjuster as present on handle 2050 and interacting with portions of cartridge 2010 (e.g., blade guard 2030), embodiments are contemplated where a blade guard adjuster is incorporated solely in cartridge 2010, incorporated solely in handle 2050, or is an optional feature added to either the cartridge, the handle, or the assembled tool 2000 as an additional part.

FIG. 20B depicts additional features of tool 2000. Portions of tool 2000 are transparent to show locking mechanism 2040, which is used to lock blade guard 2030 as disclosed above with respect to FIGS. 19A-19D, for example. FIG. 20B also reveals features of blade guard adjuster 2060, including lever spring 2062 and more clearly pawl 2064. In the conformation of FIG. 20B, locking mechanism 2040 is in an unlocked conformation, permitting rotation of blade guard adjuster to expose portions of cutting edge 2022 as well as cover of the cutting edge. Spring lever 2062 applies a force on blade guard adjuster 2060 in the C direction such that pawl 2064 is biased to direction C and engaging one of groves 2032, which prevents blade guard 2030 from exposing more (or any) of cutting edge 2022 while allowing blade guard 2030 to return to a biased position covering (or increasingly covering) cutting edge 2022. Blade guard adjuster 2060 can be viewed as setting the maximum that blade guard 2030 can expose cutting edge 2022, even though locking mechanism 2040 is otherwise in the unlocked position. In general, to expose a portion of cutting edge 2022, a user must pull blade guard adjuster 2060 in the D direction, against the force of spring lever 2062, to disengage pawl 2064 from one of notches 2032, thus permitting rotation of blade guard 2030 to expose portions of cutting edge 2022. It is contemplated that blade guard adjuster 2060 be finger operable, and suitable tensive elements be applied as previously described.

FIG. 20C depicts tool 2000 in a conformation where blade guard 2030 is prevented from exposing more than a relatively small portion of blade edge 2022, depicted as portion 2022*c*. In the present conformation, a user simultaneously depressed blade guard adjuster 2060 in direction D (see FIG. 20B) while pressing the edge of blade guard 2030 that covers blade 2020 against a work surface for cutting, causing blade guard 2030 to rotate in direction A. Blade guard adjuster 2060 was then released, allowing it to move in direction C (see FIG. 20B) and for pawl 2064 to engage with one of notches 2032, setting a maximum exposure for blade guard 2030 to expose up to portion 2022*c* of cutting edge 2022.

FIG. 20D depicts tool 2000 in a conformation where blade guard 2030 is prevented from exposing more than a relatively large portion of blade edge 2022, depicted as portion 2022*d*. In this conformation, a user simultaneously depressed blade guard adjuster 2060 in direction D (see FIG. 20B) while pressing the edge of blade guard 2030 that covers blade 2020 against a work surface for cutting, causing blade guard 2030 to rotate in direction A. Blade guard adjuster 2060 was then released, allowing it to move in direction C (see FIG. 20B) and for pawl 2064 to engage with one of notches 2032, setting a maximum exposure for blade guard 2030 to expose up to portion 2022*d* of cutting edge 2022, which in this embodiment is the maximum amount of cutting edge 2022 that can be exposed.

FIGS. 21A-21D depict a further embodiment of tools and cartridges of the inventive subject matter. Tool 2100 of FIG.

Figure 21A:
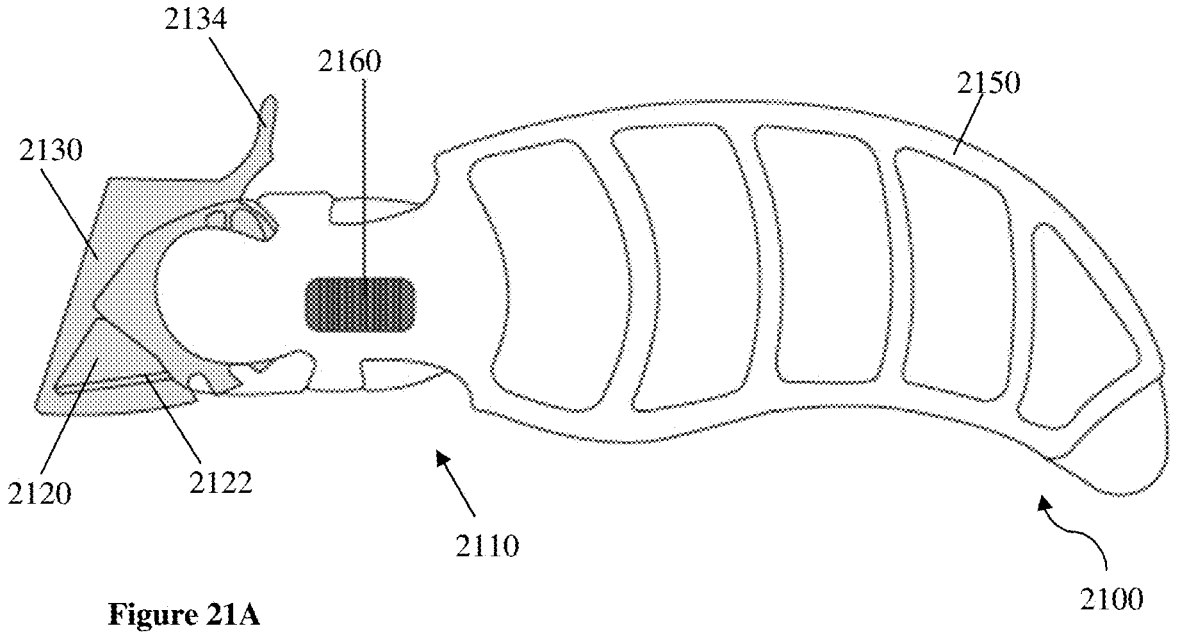
FIGS. 21A-21D show side views of an embodiment of a cartridge having an adjustable blade guard coupled to a handle having a mechanism to adjust the blade guard.

21A includes cartridge 2110 and handle 2150. Cartridge 2110 includes blade 2120 with cutting edge 2122, which is covered by blade guard 2130. Blade guard 2130 can be rotated about blade 2120 by applying pressure to trigger 2134. In the conformation of FIG. 21A, blade guard 2130 obstructs cutting edge 2122 such that no portion of cutting edge 2122 is exposed or available for cutting. Blade guard 2130 is rotatable about blade 2120 to expose portions of cutting edge 2122 for cutting, as depicted in FIGS. 21C and 21D. Handle 2150 incorporates blade guard adjuster 2160 (aka, blade guard arrestor), which interacts with portions of cartridge 2110 to enable or restrict the range of rotation of blade guard 2130, in turn enabling or restricting exposure of portions of cutting edge 2122 for cutting applications. While the present embodiment depicts blade guard adjuster 2160 as present on handle 2150 and interacting with portions of cartridge 2110 (e.g., blade guard 2130), embodiments are contemplated where a blade guard adjuster is incorporated solely in cartridge 2110, incorporated solely in handle 2150, or is an optional feature added to either the cartridge, the handle, or the assembled tool 2100 as an additional part.

Figure 21B:
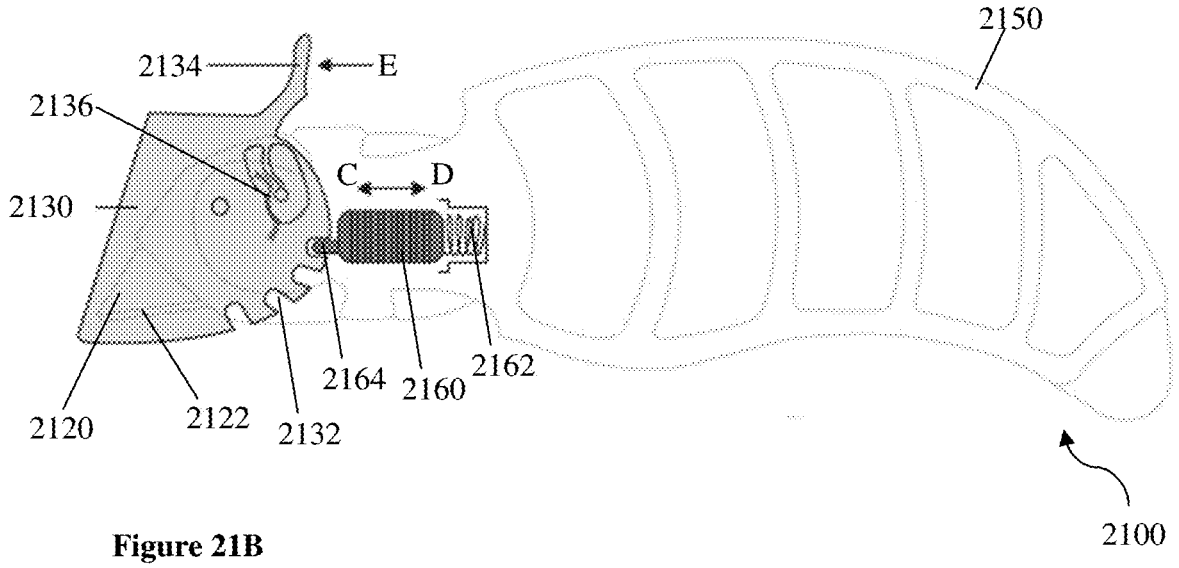
Figure 21C:
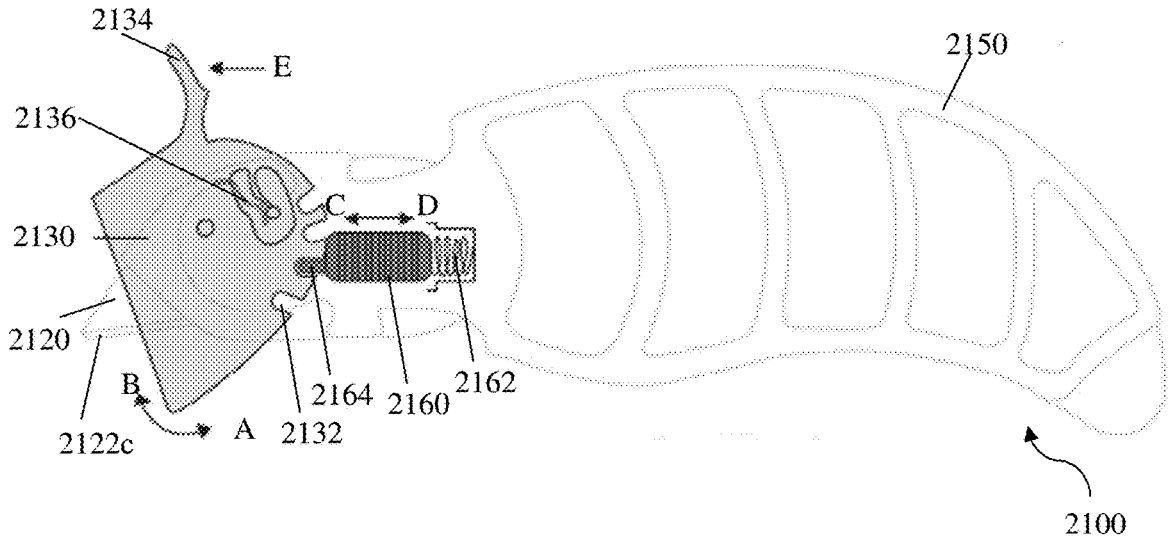
Figure 21D:
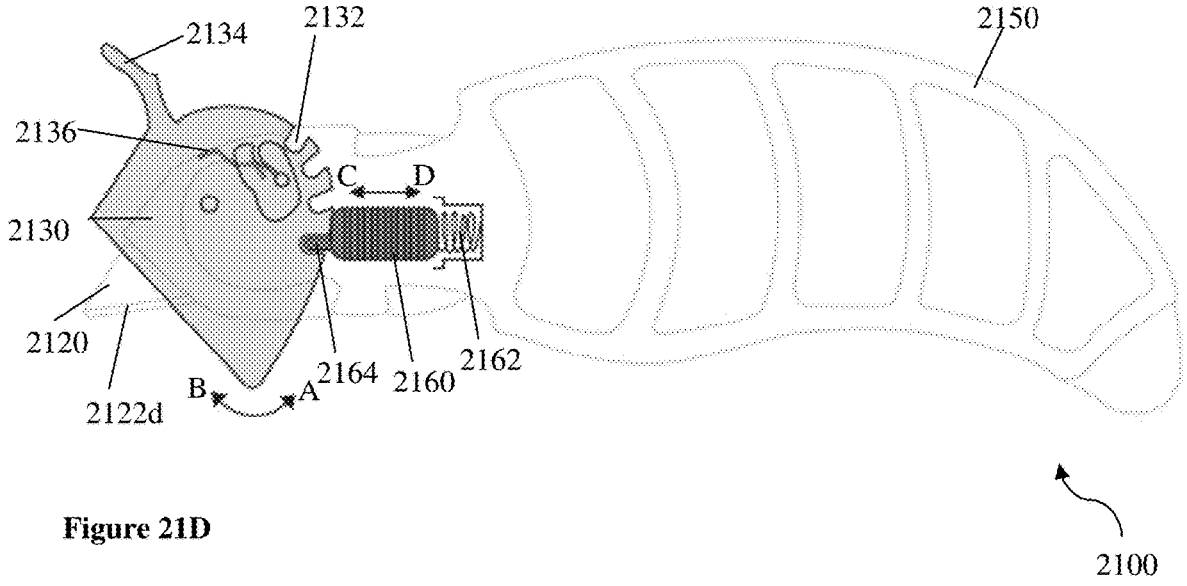

FIG. 21B depicts additional features of tool 2100. Portions of tool 2100 are transparent to show features of blade guard adjuster 2160, including spring 2162 and pin 2164, as well as features of blade guard 2130, including groves 2132, and spring lever 2136. In the conformation of FIG. 21B, spring 2162 applies a force on blade guard adjuster 2160 in the C direction such that pin 2164 is biased to direction C and engages one of groves 2132, which prevents blade guard 2130 from exposing more (or any) of cutting edge 2122. Blade guard adjuster 2160 can be viewed as setting the maximum that blade guard 2130 can expose cutting edge 2122. In general, to expose a portion of cutting edge 2122, a user must push trigger 2134 in the E direction, against the force of spring lever 2136, while (preferably after) blade guard adjuster 2160 is slid in the D direction to disengage pin 2164 from one of groves 2132, thus permitting rotation of blade guard 2130 to expose portions of cutting edge 2122. It is contemplated that blade guard adjuster 2160 be finger operable, and suitable tensive elements be applied as previously described.

FIG. 21C depicts tool 2100 in a conformation where blade guard 2130 is prevented from exposing more than a relatively smaller portion of blade edge 2022 than in FIG. 21D, depicted as portion 2122*c*. In the present conformation, a user depresses blade guard adjuster 2160 in direction D, followed by (or simultaneously) pressing trigger 2134 in direction E, thus rotating blade guard 2130 in direction A and exposing portion 2122*c* of cutting edge 2122. Blade guard adjuster 2160 is then released, allowing it to move in direction C and for pin 2164 to engage with one of groves 2132, setting a maximum exposure for blade guard 2130 to expose up to portion 2122*c* of cutting edge 2122. In embodiments where blade guard 2130 is biased toward direction B (e.g., via spring lever 2136), depressing blade guard adjuster 2160 in direction D without applying pressure on trigger 2134 in direction E results in blade cover 2130 rotating toward direction B to a position that (increasingly) covers cutting edge 2122.

FIG. 21D depicts tool 2100 in a conformation where blade guard 2130 is prevented from exposing more than a relatively larger portion of blade edge 2022 than in FIG. 21C, depicted as portion 2122*d*. In the present conformation, a user depresses blade guard adjuster 2160 in direction D, followed by (or simultaneously) pressing trigger 2134 in direction E, thus rotating blade guard 2130 in direction A and exposing portion 2122*d* of cutting edge 2122. Blade guard adjuster 2160 is then released, allowing it to move in direction C and for pin 2164 to engage with one of groves 2132, setting a maximum exposure for blade guard 2130 to expose up to portion 2122*d* of cutting edge 2122. In embodiments where blade guard 2130 is biased toward direction B (e.g., via spring lever 2136), depressing blade guard adjuster 2160 in direction D without applying pressure on trigger 2134 in direction E results in blade cover 2130 rotating toward direction B to a position that (increasingly) covers cutting edge 2122. Groves 2132 and pin 2164 can be shaped to form edges/interfaces that allow for rotation of blade guard 2130 or prevent rotation of blade guard 2130 in one or two directions as previously described.

Figure 22A:
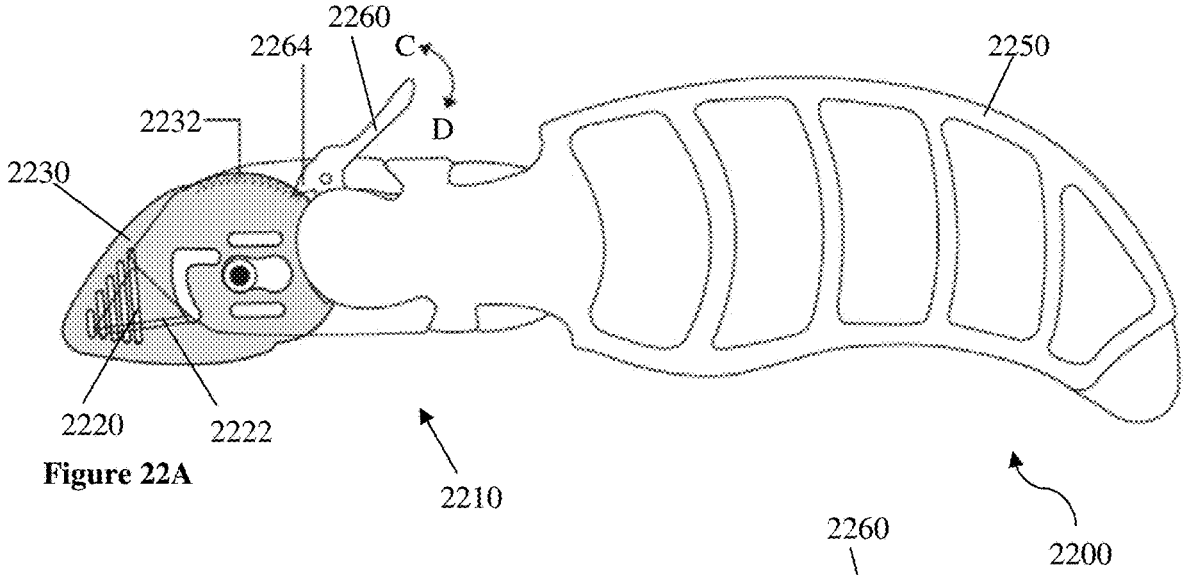
FIGS. 22A and 22D-22F show side views of an embodiment of a cartridge having an adjustable blade guard coupled to a handle.
Figure 22B:
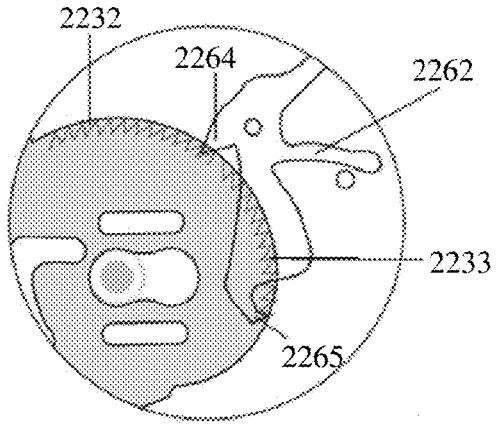
FIGS. 22B and 22C close up view of the mechanism used to adjust the blade guard of FIGS. 22A and 22D-22F.
Figure 22C:
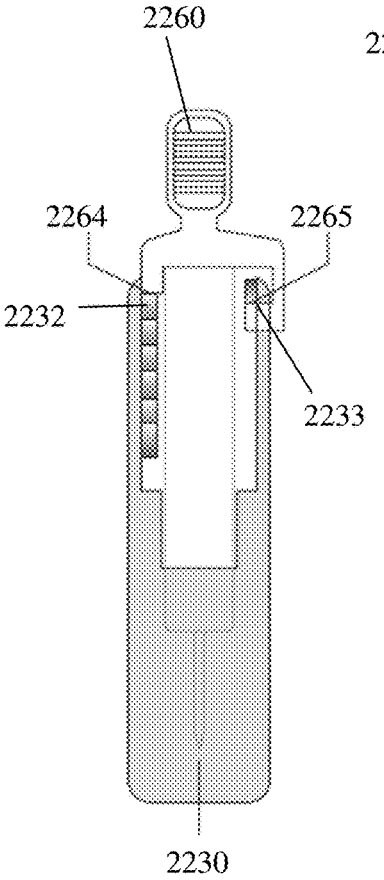
Figure 22D:
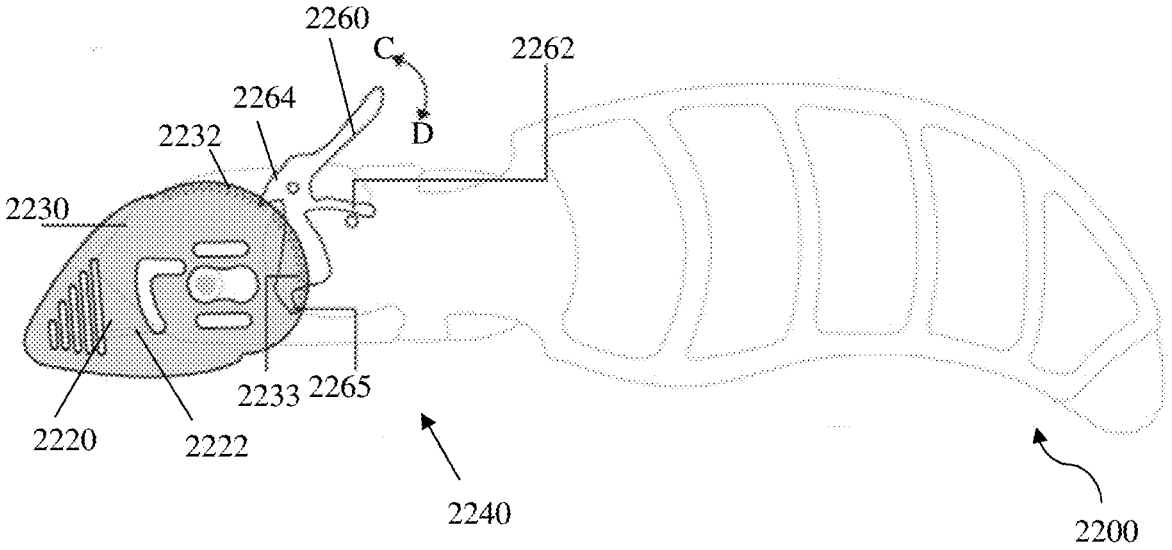
Figure 22E:
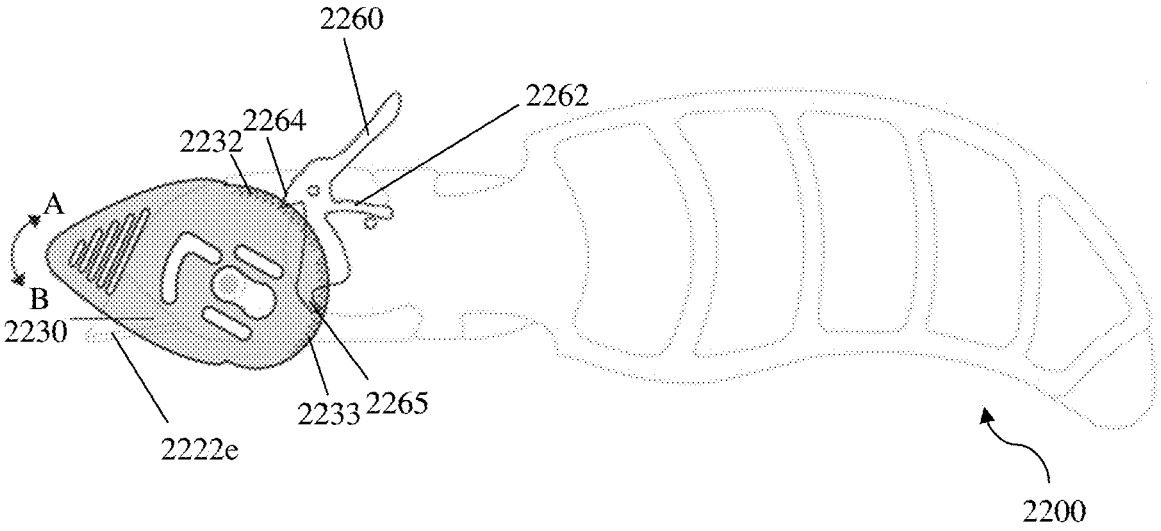
Figure 22F:
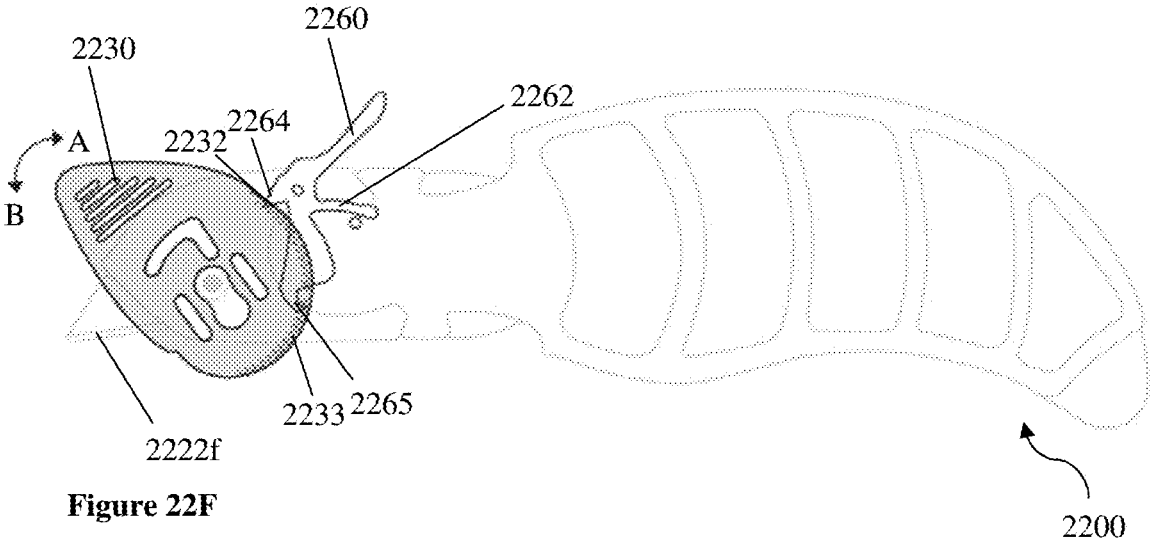

FIGS. 22A-22F depict a further embodiment of tools and cartridges of the inventive subject matter. Tool 2200 of FIG. 22A includes cartridge 2210 and handle 2250. Cartridge 2210 includes blade 2220 with cutting edge 2222, which is covered by blade guard 2230. In the conformation of FIG. 22A, blade guard 2230 obstructs cutting edge 2222 such that no portion of cutting edge 2222 is exposed or available for cutting. Blade guard 2230 is rotatable about blade 2220 to expose portions of cutting edge 2222 for cutting, as depicted in FIGS. 22E and 22F. Handle 2250 incorporates blade guard adjuster 2260 (aka, blade guard arrestor), which interacts with portions of cartridge 2210 to enable or restrict the range of rotation of blade guard 2230, in turn enabling or restricting exposure of portions of cutting edge 2222 for cutting applications.

Blade adjuster 2260 includes pawl 2264, which is movable in directions (i) C and (ii) D to (i) engage with notches 2232 on an interior edge of blade guard 2230 that is proximal to blade guard adjuster 2260, or to (ii) disengage with notches 2232, respectively. Pawl 2264 is biased toward direction C such that it engages with one of notches 2232 to prevent a rotation of blade guard 2230 that would increasingly (or potentially) expose a portion of cutting edge 2222. In embodiments where blade guard 2230 is biased toward a position that increasingly (or potentially) obstructs at least part of cutting edge 2222, pawl 2264 in its biased position toward direction C allows blade guard 2230 to move towards its biased position (e.g., toward obstructing cutting edge 2222). While the present embodiment depicts blade guard adjuster 2260 as present on handle 2250 and interacting with portions of cartridge 2210 (e.g., blade guard 2230), embodiments are contemplated where a blade guard adjuster is incorporated solely in cartridge 2210, incorporated solely in handle 2250, or is an optional feature added to either the cartridge, the handle, or the assembled tool 2200 as an additional part.

FIG. 22B depicts a close up of a side view of the interface between blade guard 2230 and blade guard adjuster 2260 with transparency to depict further features. While pawl 2264 is depicted as engaging with notches 2232, pawl 2265 is further depicted as engaging with notches 2233. Viewed from another perspective, FIG. 22B depicts that two separate but related mechanisms prevent the rotation of blade guard 2230; the interaction of pawl 2264 with notches 2232 and the interaction of pawl 2265 with notches 2233. Lever spring 2262 further serves to bias blade guard adjuster 2260 in direction C (see FIG. 22A), and is contemplated as finger operable with appropriate tensive elements as described.

FIG. 22C depicts a close up front view of the interface between blade guard 2230 and blade guard adjuster 2260 with transparency to depict further features, showing the orientation of pawl/notch paring of 2264/2232 and 2265/2233 on opposite sides of blade guard 2230 and blade guard adjuster 2260.

FIG. 22D depicts additional features of tool 2200. Portions of tool 2200 are transparent to show locking mechanism 2240, which is used to lock blade guard 2230 as disclosed above with respect to FIGS. 20A-20D, for example. FIG. 20D also shows features of blade guard adjuster 2260, including lever spring 2262 and more clearly pawls 2264 and 2265, as well as notches 2232 and 2233. In the conformation of FIG. 22B, locking mechanism 2240 is in an unlocked conformation, permitting rotation of blade guard adjuster 2230 to expose portions of cutting edge 2222 as well as cover the cutting edge. Spring lever 2262 applies a force on blade guard adjuster 2260 in the C direction such that pawl 2264 and 2265 is biased to direction C and engages one of groves 2232 and 2233, respectively. This in turn prevents blade guard 2230 from exposing more (or any) of cutting edge 2222 while allowing blade guard 2230 to return to a biased position covering (or increasingly covering) cutting edge 2222. Blade guard adjuster 2260 can be viewed as setting the maximum that blade guard 2230 can expose cutting edge 2222, even though locking mechanism 2240 is otherwise in the unlocked position. In general, to expose a portion of cutting edge 2222, a user must pull blade guard adjuster 2260 in the D direction, against the force of spring lever 2262, to disengage pawls 2264 and 2265 from one of notches 2232 and 2233, respectively, thus permitting rotation of blade guard 2230 to expose portions of cutting edge 2222. It is contemplated that blade guard adjuster 2260 be finger operable, and suitable tensive elements be applied as previously described.

FIG. 22E depicts tool 2200 in a conformation where blade guard 2230 is prevented from exposing more than a relatively small portion of blade edge 2222, depicted as portion 2022*e*. In the present conformation, a user simultaneously depressed blade guard adjuster 2260 in direction D (see FIG. 22D) while pressing the edge of blade guard 2230 that covers blade 2220 against a work surface for cutting, causing blade guard 2230 to rotate in direction A. Blade guard adjuster 2260 was then released, allowing it to move in direction C (see FIG. 22D) and for pawls 2264 and 2265 to engage with one of notches 2232 and 2233, respectively, setting a maximum exposure for blade guard 2230 to expose up to portion 2222*e* of cutting edge 2222.

FIG. 22F depicts tool 2200 in a conformation where blade guard 2230 is prevented from exposing more than a relatively large portion of blade edge 2222, depicted as portion 2022*f*. In the present conformation, a user simultaneously depressed blade guard adjuster 2260 in direction D (see FIG. 22D) while pressing the edge of blade guard 2230 that covers blade 2220 against a work surface for cutting, causing blade guard 2230 to rotate in direction A. Blade guard adjuster 2260 was then released, allowing it to move in direction C (see FIG. 22D) and for pawls 2264 and 2265 to engage with one of notches 2232 and 2233, respectively, setting a maximum exposure for blade guard 2230 to expose up to portion 2222*f* of cutting edge 2222.

The discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 23A:
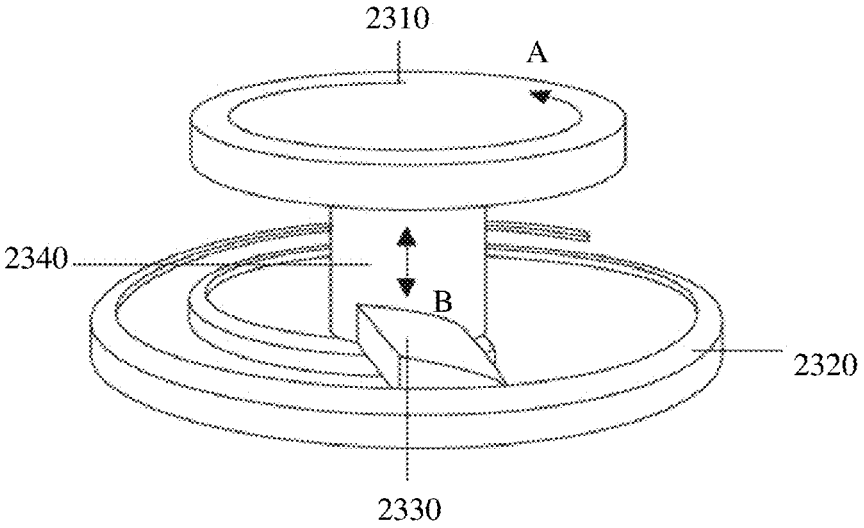
FIG. 23A shows a close up of a mechanism used to increase or decrease the force required to move a blade guard of the inventive subject matter from a rest position to a cutting position.

FIGS. 23A-23D depict blade guard force mechanisms of the inventive subject matter, and applications thereof. FIG. 23A depicts blade guard force adjuster 2300, having dial 2310, coil spring 2320, tension detent 2330, and post 2340. Blade guard force adjuster 2300 is used to adjust the resistive force of blade guards of the inventive subject matter, requiring relatively low force (e.g., 1N, 0.1N, 0.01N, 0.001N, etc) force to depress blade guards to expose a cutting edge of a blade for cutting, or requiring relatively high force (e.g., 50N, 100N, 200N, etc) to depress blade guards to expose the cutting edge of a blade. Dial 2310 is rotated in direction A to increase the resistive force of a blade guard. As dial 2310 rotates in direction A, coil spring 2320 is wound tighter against tension detent 2330 and around post 2340, requiring greater force to depress a blade guard. In contrast, rotating dial 2310 opposite to direction A causes spring coil 2320 to unspool around post 2340, reducing the force required to depress a blade guard. Dial 2310 and post 2340 can further be depressed in direction B, which releases coil spring 2320 from its tension and unspools the spring. It is contemplated that blade guard force adjuster 2300 is finger operable, and appropriate tensive elements can be used in place or in addition to coil springs.

Figure 23B:
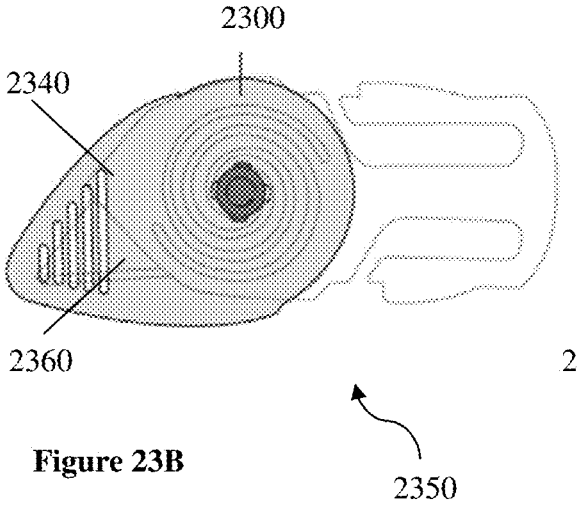
FIGS. 23B and 23C shows an embodiment of a cartridge of the inventive subject matter having a blade with a single cutting edge, a blade guard, and a mechanism of FIG. 23A to adjust the blade guard.
Figure 23C:
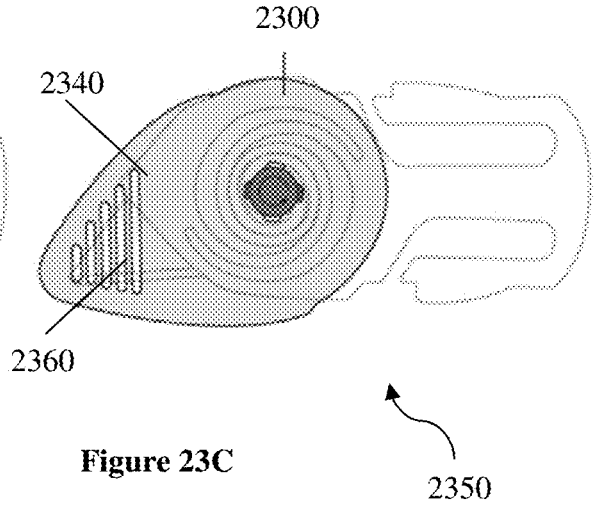
Figure 23D:
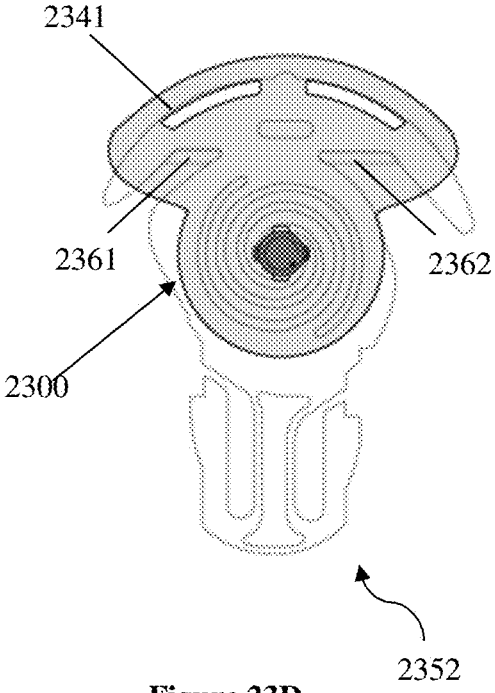
FIG. 23D shows an embodiment of a cartridge of the inventive subject matter having two cutting edges, a blade guard, and a mechanism of FIG. 23A to adjust the blade guard.

FIG. 23B depicts cartridge 2350 with blade guard 2340 and blade guard force adjuster in a low force setting (e.g., 1N, 0.1N, 0.01N, 0.001N, etc) for rotating blade guard 2340 to expose a portion of blade 2360. FIG. 23C depicts cartridge 2350 with blade guard 2340 and blade guard force adjuster in an increased force setting (e.g., 50N, 100N, 200N, etc) for rotating blade guard 2340 to expose a portion of blade 2360 (e.g., cutting edge). FIG. 23D depicts cartridge 2352 having cutting edges 2361 and 2362 positioned on opposite sides of the cartridge, with blade guard 2341 positioned rotatable over both cutting edges. Blade guard force adjuster 2300 can be used to increase or decrease the force required to displace (e.g., rotate) blade guard 2341 from covering either cutting edge 2361 or 2362.

Figure 24A:
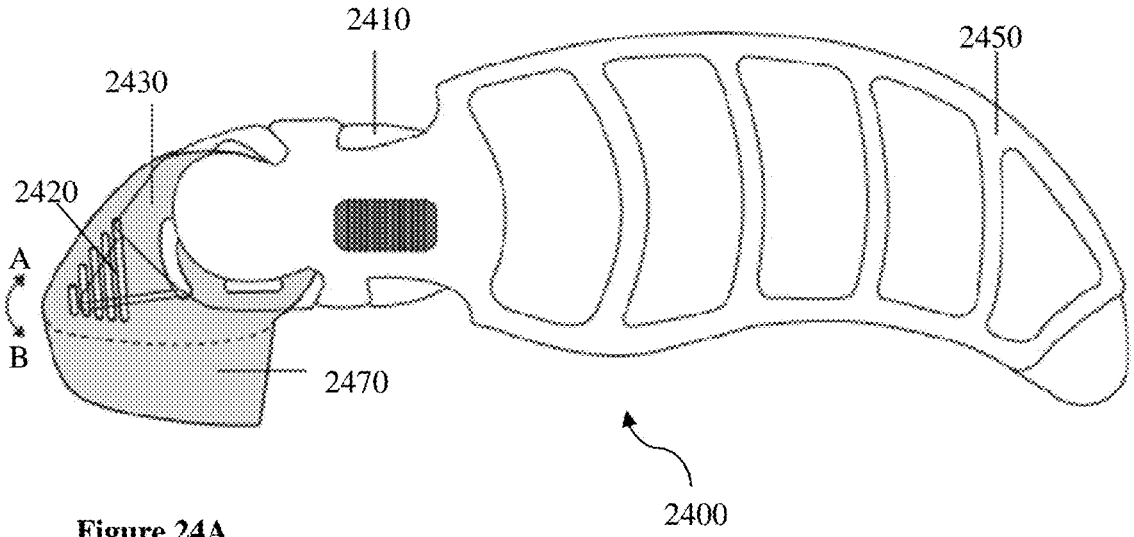
FIG. 24A shows an embodiment of a cartridge having a cutting guard and a cutting guide coupled to a handle having a mechanism to adjust the cutting guard.
Figure 24B:
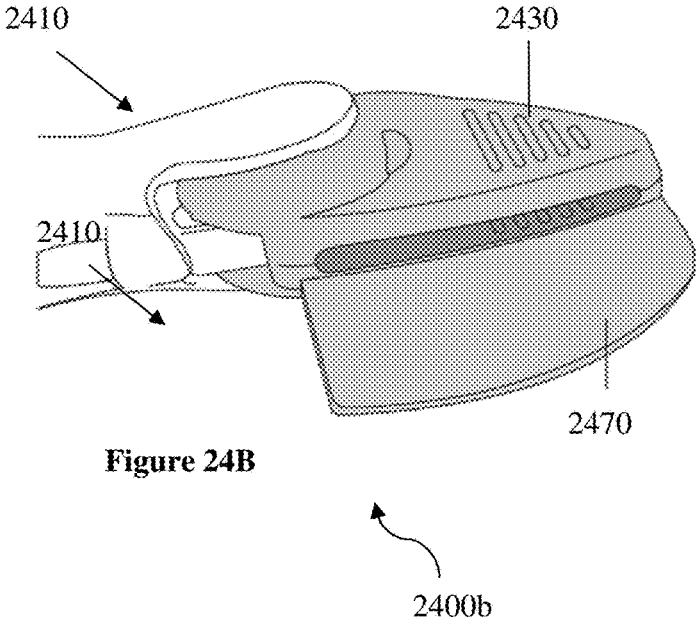
FIGS. 24B and 24C show side and front close up views, respectively, of the cartridge of FIG. 24A.
Figure 24C:
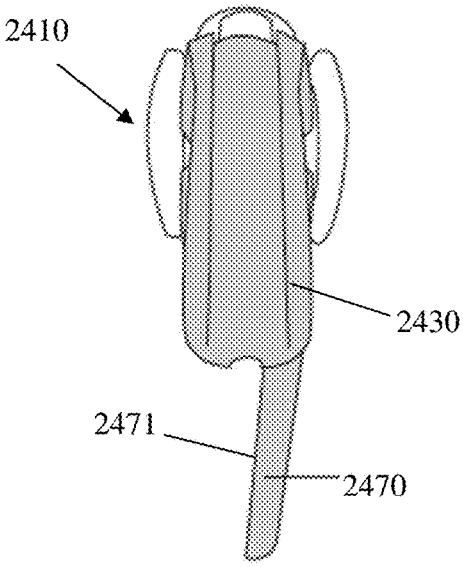

FIG. 24A-24C depict a further embodiment of cartridges and tools of the inventive subject matter including a cutting guide. Tool 2400 depicts cartridge 2410 coupled to handle 2450. Cartridge 2410 includes blade 2420 covered by blade guard 2430. Blade guard 2340 is rotatable in directions A and B, preferably with a bias toward direction B covering blade 2420. Blade guide 2470 is an extension of blade guard 2430, and extends toward a cutting direction for applying tool 2400. Preferably, blade guide 2470 extends from one side of blade guard 2430 (and one side of blade 2420) such that, when aligning to cut a work surface, a user can press inner surface 2471 of blade guide 2470 against a side or over a work surface such that the blade is aligned to cut the work surface at a desired location when the blade guard is pressed against the work surface.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, wherein the blade guard arrestor at the first setting prevents the blade guard from completely covering the cutting edge; and a blade guard retractor with an on setting and an off setting, wherein the on setting allows the blade cover to move from the first flexed position to the resting position.

2. The cartridge of claim 1, wherein the blade guard arrestor at the first setting allows the blade guard to cover more of the cutting edge than at the second setting.

3. The cartridge of claim 1, wherein the blade guard is movable between a resting position and a second flexed position different than the first flexed position.

4. The cartridge of claim 1, wherein the blade guard arrestor can be changed from a first setting to a third setting different than the second setting.

5. A cartridge comprising:

a handle-coupling member configured to reversibly mate with a handle;

a blade with a cutting edge;

a blade guard movable with respect to the blade between a resting position and a flexed position, wherein the blade guard at least partially covers the cutting edge in the resting position, and wherein a force is required to move the blade guard from the resting position toward the flexed position; and a blade guard force adjuster, wherein the blade guard force adjuster allows a user to change the force.

6. The cartridge of claim 5, wherein the blade guard force adjuster can be set by the user between 10N and 0.01N.

7. The cartridge of claim 5, further comprising a blade guard arrestor, wherein the blade guard arrestor prevents a movement of the blade cover and can be changed from a first setting to a second setting.

8. The cartridge of claim 5, wherein (i) the blade guard arrestor at the first setting prevents the blade guard from completely covering the cutting edge, or (ii) the blade guard arrestor in the first position prevents the blade guard from completely exposing the cutting edge.

9. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, wherein the blade guard arrestor at the first setting prevents the blade guard from completely covering the cutting edge; and a blade guard retractor with an on setting and an off setting, wherein the off setting prevents the blade guard from moving from the first flexed position to the resting position.

10. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, wherein the blade guard arrestor at the first setting prevents the blade guard from completely covering the cutting edge; and a blade guard force adjuster, wherein a force is required to move the blade guard from the resting position toward the first flexed position, and the blade guard force adjuster allows a user to change the force.

11. The cartridge of claim 10, wherein the blade guard force adjuster can be set by the user between 10N and 0.01N.

12. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position; and a blade guard arrestor, wherein the blade guard arrestor prevents a movement of the blade cover and can be changed from a first setting to a second setting, wherein the blade guard arrestor at the first setting prevents the blade guard from completely covering the cutting edge, wherein the blade guard arrestor is at least partially operated by a mechanism on the handle.

13. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, wherein the blade guard arrestor at the first setting prevents the blade guard from completely covering the cutting edge; and a blade guard retractor with an on setting and an off setting, wherein the off setting prevents the blade guard from move from the first flexed position.

14. The cartridge of claim 13, wherein the blade guard arrestor at the first setting allows the blade guard to expose more of the cutting edge than at the second setting.

15. The cartridge of claim 13, further comprising a blade guard retractor with an on setting and an off setting, wherein the on setting allows the blade cover to move from the first flexed position to the resting position.

16. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, and wherein the blade guard arrestor in the first setting prevents the blade guard from completely exposing the cutting edge; and a blade guard retractor with an on setting and an off setting, wherein the off setting prevents the blade cover from moving from the first flexed position to the resting position.

17. The cartridge of claim 16, wherein the blade guard force adjuster can be set by the user between 10N and 0.01N.

18. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position;

a blade guard arrestor, wherein the blade guard arrestor prevents a movement of the blade cover and can be changed from a first setting to a second setting, and wherein the blade guard arrestor in the first setting prevents the blade guard from completely exposing the cutting edge; and a blade guard force adjuster, wherein a force is required to move the blade guard from the resting position toward the first flexed position, and the blade guard force adjuster allows a user to change the force.

19. A cartridge comprising:

a handle-coupling member configured to reversibly mate with a handle;

a blade with a cutting edge;

a blade guard movable with respect to the blade between a resting position and a first flexed position, wherein the blade guard covers a greater portion of the cutting edge in the resting position than in the first flexed position; and a blade guard arrestor, wherein the blade guard arrestor prevents a movement of the blade cover and can be changed from a first setting to a second setting, and wherein the blade guard arrestor in the first setting prevents the blade guard from completely exposing the cutting edge, wherein the blade guard arrestor is at least partially operated by a mechanism on the handle.

* * * * *